US012331939B2

(12) United States Patent
Mun et al.

(10) Patent No.: US 12,331,939 B2
(45) Date of Patent: Jun. 17, 2025

(54) INDOOR UNIT OF AN AIR CONDITIONER

(71) Applicant: LG ELECTRONICS INC., Seoul (KR)

(72) Inventors: Seongkuk Mun, Seoul (KR); Junseok Bae, Seoul (KR); Eunsun Lee, Seoul (KR); Kangyoung Kim, Seoul (KR); Hakjae Kim, Seoul (KR); Taeyun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/387,335

(22) Filed: Nov. 6, 2023

(65) Prior Publication Data

US 2024/0068675 A1 Feb. 29, 2024

Related U.S. Application Data

(63) Continuation of application No. 16/978,138, filed as application No. PCT/KR2019/002677 on Mar. 7, 2019, now Pat. No. 11,852,358.

(30) Foreign Application Priority Data

Mar. 7, 2018 (KR) ..... 10-2018-0027005
Feb. 14, 2019 (KR) ..... 10-2019-0017449

(51) Int. Cl.
*F24F 1/0018* (2019.01)
*F24F 1/0007* (2019.01)
(Continued)

(52) U.S. Cl.
CPC ..... *F24F 1/0018* (2013.01); *F24F 1/0007* (2013.01); *F24F 1/0011* (2013.01);
(Continued)

(58) Field of Classification Search
CPC ..... F24F 1/0018; F24F 1/0011; F24F 13/082; F24F 13/1426
See application file for complete search history.

(56) References Cited

U.S. PATENT DOCUMENTS 2,057,494 A * 10/1936 Leigh ..... F24F 13/075 454/258
4,702,155 A 10/1987 Hildebrand ..... B60H 1/3435 454/316
(Continued)

FOREIGN PATENT DOCUMENTS

CN 1142591 2/1997
CN 1293342 5/2001
(Continued)

OTHER PUBLICATIONS

Sixuan et al. "Within the new air conditioning machine ventilation mode and its transmission mechanism is introduced," TCL Air Conditioner, Xhongshan Co., Ltd. (4 Pages).

*Primary Examiner* — Allen R. B. Schult
(74) *Attorney, Agent, or Firm* — Bryan Cave Leighton Paisner LLP

(57) ABSTRACT

A front end of a steering grill from which air is discharged protrudes further than the front surface of a door assembly, and the steering grill is steered by a steering assembly, and thus conditioned air may be provided by a directed air movement to a long-distance target region, and since the front end of the steering grill protrudes further than the front surface of the door assembly, the occurrence of flow resistance as a result of a cabinet assembly or the door assembly interfering with the discharged air may be minimized, and the direction of the steering grill may be instantly changed, by means of steering, from any one direction to another among up, down, left, right, upper left, lower left, upper right, or lower right.

15 Claims, 30 Drawing Sheets

(51) Int. Cl.

| | |
|---|---|
| ***F24F 1/0011*** | (2019.01) |
| ***F24F 1/0029*** | (2019.01) |
| ***F24F 1/005*** | (2019.01) |
| ***F24F 13/08*** | (2006.01) |
| ***F24F 13/14*** | (2006.01) |

(52) U.S. Cl.

CPC ..... *F24F 1/0029* (2013.01); *F24F 1/005* (2019.02); *F24F 13/082* (2013.01); *F24F 13/1426* (2013.01); *F24F 2013/1446* (2013.01); *F24F 2013/146* (2013.01)

(56) References Cited

U.S. PATENT DOCUMENTS

| | | | | |
|---|---|---|---|---|
| 5,775,119 | A | 7/1998 | Yamada et al. | |
| 5,871,334 | A | 2/1999 | Suzuki et al. | |
| 5,958,112 | A | 9/1999 | Nojima | |
| 6,358,139 | B1 | 3/2002 | Renz | |
| 10,047,972 | B2 | 8/2018 | Jeong | |
| 10,309,683 | B2 | 6/2019 | Choi et al. | |
| 11,852,358 | B2 * | 12/2023 | Mun | F24F 1/0018 |
| 2005/0279118 | A1 | 12/2005 | Son | |
| 2015/0090429 | A1 | 4/2015 | Jeong | |
| 2015/0377242 | A1 | 12/2015 | Furuhashi et al. | |
| 2017/0045259 | A1 | 2/2017 | Choi et al. | |
| 2018/0209687 | A1 | 7/2018 | Chun et al. | |
| 2018/0283729 | A1 | 10/2018 | Terasawa | F24F 13/1426 |

FOREIGN PATENT DOCUMENTS

| | | | |
|---|---|---|---|
| CN | 1755206 | | 4/2006 |
| CN | 1782517 | A | 6/2006 |
| CN | 101078553 | | 11/2007 |
| CN | 101086353 | | 12/2007 |
| CN | 101464040 | | 6/2009 |
| CN | 101576286 | | 11/2009 |
| CN | 101737871 | | 6/2010 |
| CN | 102313327 | A | 1/2012 |
| CN | 104515202 | A | 4/2015 |
| CN | 104515284 | A | 4/2015 |
| CN | 104697144 | B | 6/2015 |
| CN | 105008813 | A | 10/2015 |
| CN | 105318433 | A | 2/2016 |
| CN | 105333494 | | 2/2016 |
| CN | 105588194 | A | 5/2016 |
| CN | 105605670 | | 5/2016 |
| CN | 105783226 | | 7/2016 |
| CN | 106152459 | A | 11/2016 |
| CN | 205897475 | | 1/2017 |
| CN | 106468459 | A | 3/2017 |
| CN | 106766059 | | 5/2017 |
| CN | 107023887 | A | 8/2017 |
| CN | 107036161 | A | 8/2017 |
| CN | 107327966 | A | 11/2017 |
| CN | 107388369 | A | 11/2017 |
| CN | 107525126 | A | 12/2017 |
| CN | 206929869 | | 1/2018 |
| DE | 102012203573 | | 9/2013 |
| JP | 10160232 | A | 6/1998 |
| JP | 2017144898 | A | 8/2017 |
| KR | 100458468 | B1 | 11/2004 |
| KR | 20100086314 | A | 7/2010 |
| KR | 10-2011-0029871 | A | 3/2011 |
| KR | 20110023980 | A | 3/2011 |
| KR | 10-2012-0064492 | A | 6/2012 |
| KR | 20120111822 | A | 10/2012 |
| KR | 10-2014-0012437 | A | 2/2014 |
| KR | 10-2014-0019106 | A | 2/2014 |
| KR | 2014012437 | A * | 2/2014 |
| KR | 1020140034383 | A | 3/2014 |
| KR | 10-1561738 | B1 | 5/2015 |
| KR | 10-2016-0051095 | A | 5/2016 |
| KR | 1020170010293 | A | 1/2017 |
| KR | 1020180000287 | A | 1/2018 |

* cited by examiner

3430

INDOOR UNIT OF AN AIR CONDITIONER

CROSS-REFERENCE TO RELATED APPLICATION

This application is a Continuation application of U.S. Ser. No. 16/978,138, filed Sep. 3, 2020, which is a National Stage Application of International Application No. PCT/KR2019/002677, filed on Mar. 7, 2019, which claims benefit of and priority to Korean Patent Application Nos.: KR10-2018-0027005, filed on Mar. 7, 2018, and KR10-2019-0017449, filed on Feb. 14, 2019, all of which are hereby incorporated by reference in their entirety for all purposes as if fully set forth herein.

TECHNICAL FIELD

The present disclosure relates to an indoor unit of an air conditioner, and more particularly, to an indoor unit of an air conditioner including a long-distance fan assembly moving in a forward and rearward direction to be exposed to an outside space of a cabinet assembly.

BACKGROUND ART

A split-type air conditioner may include an indoor unit disposed in an indoor space and an outdoor unit disposed in an outdoor space and may cool, heat, or dehumidify indoor air through refrigerants circulating between the indoor unit and the outdoor unit.

Examples of indoor unit of the split-type air conditioner include a stand-type indoor unit vertically installed on the indoor floor, a wall-mounted indoor unit mounted on the indoor wall, and a ceiling-type indoor unit mounted on the indoor ceiling. The indoor unit of the split-type air conditioner in related art includes an indoor fan disposed inside a cabinet, a problem exists that the conditioned air may not be remotely discharged.

According to Korean Patent No. 10-1191413, a circulator remotely flows air around the indoor unit.

According to Korean Patent No. 10-1191413, an air circulator is disposed in the indoor unit and may not directly flow the conditioned air and may remotely flow indoor air above the indoor unit.

As the air circulator does not directly flow the conditioned air, there is a problem that the air circulator may not concentrate and supply the conditioned air to a target area and may not selectively condition the target area where temperature imbalance is generated.

According to Korean Patent Publication No. 10-2017-0010293, a cabinet of an indoor unit defines an opening and includes a door unit to open and close the opening. According to Korean Patent Publication No. 10-2017-0010293, the door unit is movable in a forward and rearward direction, and when the indoor unit is not operated, the door unit closes the opening, and when the indoor unit is operated, the door unit is moved forward to open the opening.

However, according to Korean Patent Publication No. 10-2017-0010293, a door unit moves in a forward and rearward direction to open and close an opening, but as the door unit is disposed in front of the opened opening, it blocks the flow of air discharged through the opening. For example, according to Korean Patent Publication No. 10-2017-0010293, the opening opened by the door unit is not suitable for remotely flowing the air.

Additionally, according to Korean Patent Publication No. 10-2017-0010293, the door is moved forward to open the opening, and as a blowing fan is disposed inside an exterior panel, the air flowed by the blowing fan generates resistance with a structure inside the exterior panel, which causes a lot of flow loss to remotely flow the air.

SUMMARY

The present disclosure is directed to an indoor unit of an air conditioner to provide conditioned air to a remote target area with directed air movement.

The present disclosure is directed to an indoor unit of an air conditioner discharging directed air movement at an outside of an outer surface of the indoor unit when the indoor unit provides the directed air movement to the target area.

The present disclosure is directed to an indoor unit of an air conditioner discharging air when a steering grill protrudes further forward than a front surface of a door assembly during operation.

The present disclosure is directed to an indoor unit of an air conditioner providing conditioned air from an inside of a cabinet assembly to a steering grill protruding out of the cabinet assembly through an independent flow path.

The present disclosure is directed to an indoor unit of an air conditioner tilting a steering grill in at least one of an upward direction, a downward direction, a leftward direction, a rightward direction, a leftward and upward direction, a leftward and downward direction, a rightward and upward direction, or a rightward and downward direction.

The present disclosure is directed to an indoor unit of an air conditioner in which a steering grill may be immediately tilted from one of the upward direction, the downward direction, the leftward direction, the rightward direction, the leftward and upward direction, the leftward and downward direction, the rightward and upward direction, or the rightward or downward direction to another one thereof.

The present disclosure is directed to an indoor unit of an air conditioner to minimize interference between a discharged directed air movement and a cabinet assembly when the steering grill is tilted.

Objectives are not limited to the above-described ones, and other objectives that have not been mentioned can be clearly understood by one having ordinary skill in the art to which the present disclosure pertains from the following descriptions.

According to the present disclosure, an indoor unit of an air conditioner may provide conditioned air to a remote target area with directed air movement as a front end of the steering grill to discharge air protrudes further than a front surface of a door assembly and the steering grill is tilted by the steering assembly.

The front end of the steering grill protrudes further than the front surface of the door assembly to minimize flow resistance caused by interference of the discharged air with a cabinet assembly or a door assembly.

The front end of the steering grill protrudes further than the front surface of the door assembly when the steering grill is tilted to prevent interference between the discharged air and the door assembly.

The steering grill may be tilted when a center of the steering grill is disposed on a central axis (C1) passing a front discharge outlet in a forward and rearward direction to minimize air leakage between the front discharge outlet and the steering grill even when tilting.

A first steering assembly and a second steering assembly are rotatably coupled to two portions of the steering grill and rotate upward, downward, leftward, rightward, leftward and upward, rightward and upward, leftward and downward, and rightward and downward with respect to the central axis (C1) passing the front discharge outlet in the forward and rearward direction based on the operation of pushing or pulling coupled portions.

The first steering assembly and the second steering assembly form an angle of 90 degrees with respect to the central axis (C1) to minimize the operations of the first steering assembly and the second steering assembly when the steering grill rotates upward, downward, leftward, rightward, leftward and upward, rightward and upward, leftward and downward, and rightward and downward.

The first steering assembly may be disposed above or below the central axis (C1) and the second steering assembly may be disposed on the left side or right side of the central axis (C1) to rotate at least one of the first steering assembly or the second steering assembly upward, downward, leftward, and rightward.

The steering assembly may be disposed on a steering base to cover an inner space (S3) of an inner fan housing of the fan housing to minimize interference with the discharged air.

The steering assembly may be disposed in the inner space (S3) of the inner fan housing and may be assembled to the steering grill through the steering base to minimize a distance between the steering grill and the fan housing. As the distance between the steering grill and the fan housing is minimized, a length needed to operate the steering assembly may be reduced and a rotation angle of the steering grill may be precisely controlled.

As a joint assembly is rotatably assembled with the steering base and the steering grill, the tilting angle of the steering grill may be precisely implemented based on operations of the first steering assembly and the second steering assembly.

As the joint assembly may be a ball joint, the steering grill may be freely tilted.

The joint assembly includes a first joint bracket assembled to the steering grill, a second joint bracket assembled to the steering base, and a cross axle rotatably assembled to the first joint bracket through a first rotary shaft and rotatably assembled to the second joint bracket through a second rotary shaft, to freely obtain tilting directions of the steering grill through a combination of the first rotary shaft with the second rotary shaft, and the cross axle is supported by each of the first joint bracket and the second joint bracket to minimize vibration of the steering grill during operation.

The first rotary shaft intersects with the second rotary shaft by 90 degrees and the cross axle may be rotatably assembled to each of the first joint bracket and the second joint bracket to immediately tilt from one of the upward direction, the downward direction, the leftward direction, the rightward direction, the leftward and upward direction, the leftward and downward direction, the rightward and upward direction, or the rightward or downward direction to another thereof.

The first joint bracket includes a 1-1 shaft supporter and a 1-2 shaft supporter that are vertically disposed and the first rotary shaft of the cross axle includes a 1-1 rotary shaft rotatably assembled to the 1-1 shaft supporter and a 1-2 rotary shaft rotatably assembled to the 1-2 shaft supporter to firmly support the rotating cross axle.

The 1-1 shaft cap may be coupled to the 1-1 rotary shaft through the 1-1 shaft supporter, may be rotatably assembled with the 1-1 shaft supporter, and a 1-2 shaft cap may be coupled to the 1-2 rotary shaft through the 1-2 shaft supporter and may be rotatably assembled to the 1-2 shaft supporter to rotate the cross axle when the cross axle is firmly assembled to the shaft supporters.

The second joint bracket includes a 2-1 shaft supporter and a 2-2 shaft supporter that are disposed in the vertical direction and the second rotary shaft of the cross axle includes the 2-1 rotary shaft rotatably assembled to the 2-1 shaft supporter and the 2-2 rotary shaft rotatably assembled to the 2-2 shaft supporter to firmly support the rotating cross axle.

The 2-1 shaft cap may be coupled to the 2-1 rotary shaft through the 2-1 shaft supporter, and may be rotatably assembled with the 2-1 shaft supporter and a 2-2 shaft cap may be coupled to the 2-2 rotary shaft through the 2-2 shaft supporter, and may be rotatably assembled to the 2-2 shaft supporter to rotate it when the cross axle is firmly assembled to each of the shaft supporters.

The steering assembly includes a steering body coupled to the fan housing; a steering actuator assembled to the steering body; a moving rack movably assembled to the steering body and moving along the steering body based on operation of the steering actuator; and an adjust assembly assembled to be rotatable relative to the moving rack and assembled to be rotatable relative to the steering grill, and the adjust assembly is rotatable relative to at least one of the moving rack or the steering grill based on the movement of the moving rack and the steering assembly pushes or pulls the steering grill to tilt the steering grill.

The steering actuator may be a motor and may include a rack guide disposed on the steering body, to which the moving rack may be assembled to be movable, and configured to guide the moving direction of the moving rack; a moving rack gear disposed on the moving rack; and a steering gear coupled to a motor shaft of a motor, engaged with the moving rack gear, and configured to provide a driving force to the moving rack based on the operation of the steering motor, and may precisely control a moving distance of the moving rack based on a number of revolutions of the steering motor.

The adjust assembly includes: a first ball hinge coupled to the moving rack; a second ball hinge coupled to the steering grill; a first ball cap disposed between the first ball hinge and the second ball hinge, configured to surround a portion of an outer surface of the first ball hinge, and being rotatable relative to the first ball hinge; a second ball cap disposed between the first ball cap and the second ball hinge, configured to surround a portion of an outer surface of the second ball hinge, and rotatable relative to the second ball hinge; and an elastic member disposed between the first ball cap and the second ball cap, configured to provide an elastic force to the first ball cap and the second ball cap, contact the first ball cap to the first ball hinge, and contact the second ball cap to the second ball hinge. When the steering actuator is operated, relative rotation occurs in at least one of the first ball hinge or the second ball hinge to correspond to a distance and an angle between the steering grill and the steering base during steering.

The first ball hinge, the first ball cap, the elastic member, the second ball cap, and the second ball hinge are accommodated inside the adjust housing to firmly support the first ball hinge and the second ball hinge when the relative rotation occurs at the first ball hinge and the second ball hinge. In addition, the elastic member provides a sufficient elastic force to each of the first ball cap and the second ball cap to prevent excessive rotation and engagement between the first ball hinge and the second ball hinge.

Advantageous Effects

An indoor unit of an air conditioner according to the present disclosure has one or more of the following advantageous effects that are described hereunder.

First, according to the present disclosure, there is an advantage in that a front end of a steering grill through which air is discharged protrudes from a front surface of a door assembly and the steering grill is tilted by the steering assembly, to provide conditioned air to a remote target area with directed air movement.

Second, according to the present disclosure, there is an advantage in that the front end of the steering grill protrudes further than the front surface of the door assembly to minimize flow resistance caused by interference of discharged air with a cabinet assembly or a door assembly.

Third, according to the present disclosure, there is an advantage in that, when the steering grill is tilted, the front end of the steering grill protrudes further than the front surface of the door assembly to prevent interference of the discharged air with the door assembly.

Fourth, according to the present disclosure, there is an advantage in that the steering grill is tilted when a center of the steering grill is disposed on a central axis (C1) passing a front discharge outlet in a forward and rearward direction to minimize air leakage between a front discharge outlet and the steering grill even when tilting.

Fifth, according to the present disclosure, there is an advantage in that a first steering assembly and a second steering assembly are rotatably coupled to two portions of the steering grill and rotate upward, downward, leftward, rightward, leftward and upward, rightward and upward, leftward and downward, and rightward and downward with respect to the central axis (C1) passing the front discharge outlet in the forward and rearward direction based on the operation of pushing or pulling coupled portions.

Sixth, according to the present disclosure, there is an advantage in that the first steering assembly and the second steering assembly form an angle of 90 degrees with respect to the central axis (C1) to minimize the operations of the first steering assembly and the second steering assembly during tilting.

Seventh, according to the present disclosure, there is an advantage in that the first steering assembly may be disposed above or below the central axis (C1) and the second steering assembly may be disposed on the left side or right side of the central axis (C1) to rotate at least one of the first steering assembly or the second steering assembly upward, downward, leftward, and rightward.

Eighth, according to the present disclosure, there is an advantage in that the steering assembly is disposed on the steering base covering the inner space (S3) of an inner fan housing of the fan housing to minimize interference with the discharged air.

Ninth, according to the present disclosure, there is an advantage in that the steering assembly may be disposed in the inner space (S3) of the inner fan housing of the steering assembly and assembled to the steering grill through the steering base to minimize a distance between the steering grill and the fan housing.

Tenth, according to the present disclosure, there is an advantage in that the joint assembly may be rotatably assembled to each of the steering base and the steering grill to precisely obtain a tilting angle of the steering grill based on operations of the first steering assembly and the second steering assembly.

Eleventh, according to the present disclosure, there is an advantage in that. as the joint assembly may be a ball joint, and thus the steering grill may be freely tilted.

Twelfth, according to the present disclosure, there is an advantage in that the tilting direction of the steering grill may be freely implemented through a combination of a first rotary shaft and a second rotary shaft disposed on the cross axle of the joint assembly.

Thirteenth, according to the present disclosure, there is an advantage in that the cross axle may be supported by each of the first joint bracket and the second joint bracket to minimize vibration of the steering grill during operation.

Fourteenth, according to the present disclosure, there is an advantage in that a tilting direction of the steering grill may be changed from one of an upward direction, a downward direction, a leftward direction, a rightward direction, a leftward and upward direction, a leftward and downward direction, or a rightward and downward direction to another thereof.

BRIEF DESCRIPTION OF DRAWINGS

The accompanying drawings constitute a part of this specification and illustrate one or more embodiments of the present disclosure and together with the specification, explain the present disclosure.

DETAILED DESCRIPTION

Figure 1:
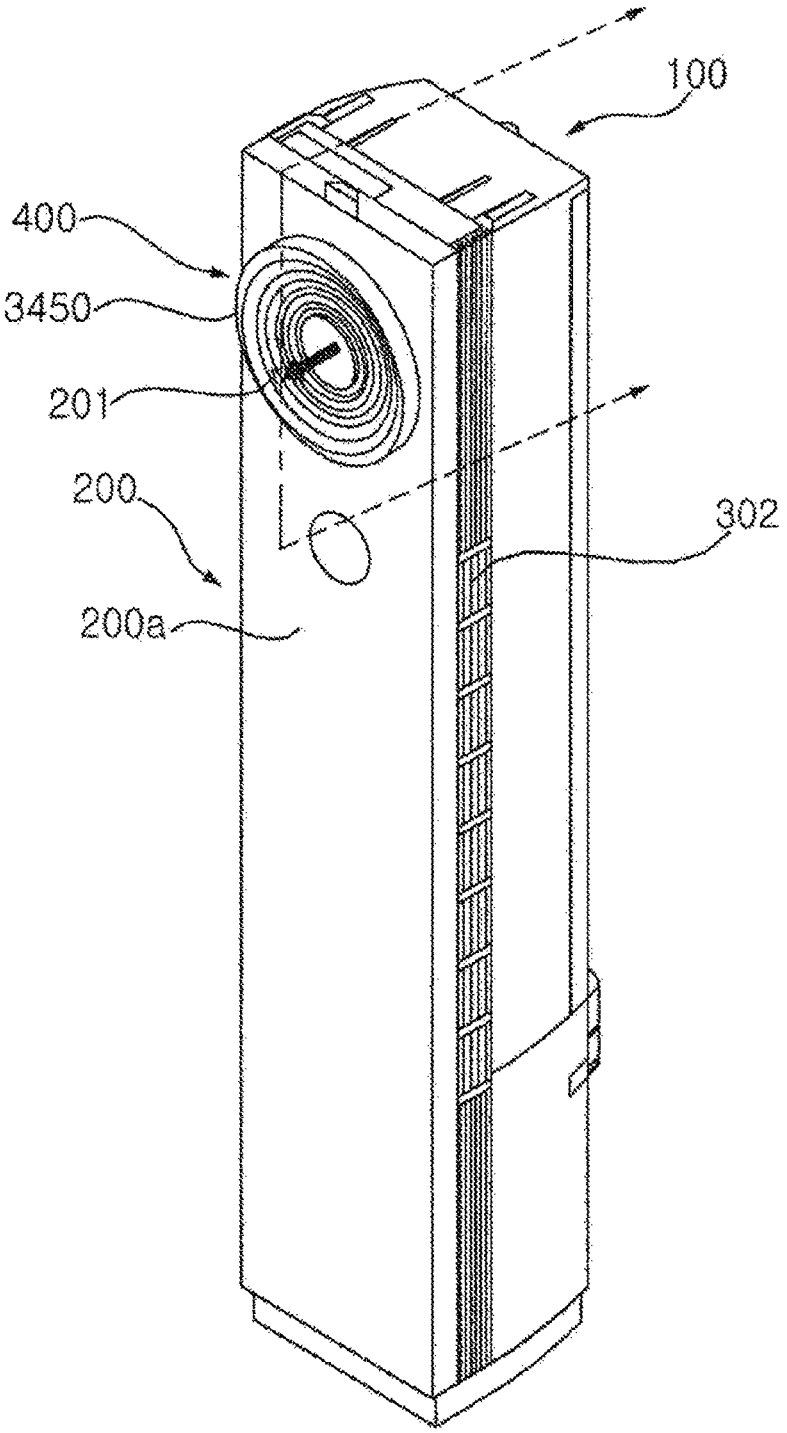
FIG. 1 is a perspective view showing an indoor unit of an air conditioner according to an embodiment of the present disclosure.

Reference will now be made to the exemplary embodiments illustrated in the drawings, and specific language will be used here to describe the same. It will nevertheless be understood that no limitation of the scope of the invention is thereby intended. Alterations and further modifications of the inventive features illustrated here, and additional applications of the principles of the inventions as illustrated here, which would occur to a person skilled in the relevant art and having possession of this disclosure, are to be considered within the scope of the invention.

As used herein, various singular forms "a," "an" and "the" are intended to include various plural forms as well, unless context clearly indicates otherwise. For example, a term "a" or "an" shall mean "one or more," even though a phrase "one or more" is also used herein. Use of the optional plural "(s)," "(es)," or "(ies)" means that one or more of the indicated feature is present.

As used herein, a term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, features described with respect to certain embodiments may be combined in or with various other embodiments in any permutational or combinatory manner Different aspects or elements of example embodiments, as disclosed herein, may be combined in a similar manner.

Various terminology used herein can imply direct or indirect, full or partial, temporary or permanent, action or inaction. For example, when an element is referred to as being "on," "connected" or "coupled" to another element, then the element can be directly on, connected or coupled to the other element or intervening elements can be present, including indirect or direct variants. In contrast, when an element is referred to as being "directly connected" or "directly coupled" to another element, there are no intervening elements present.

Figure 2:
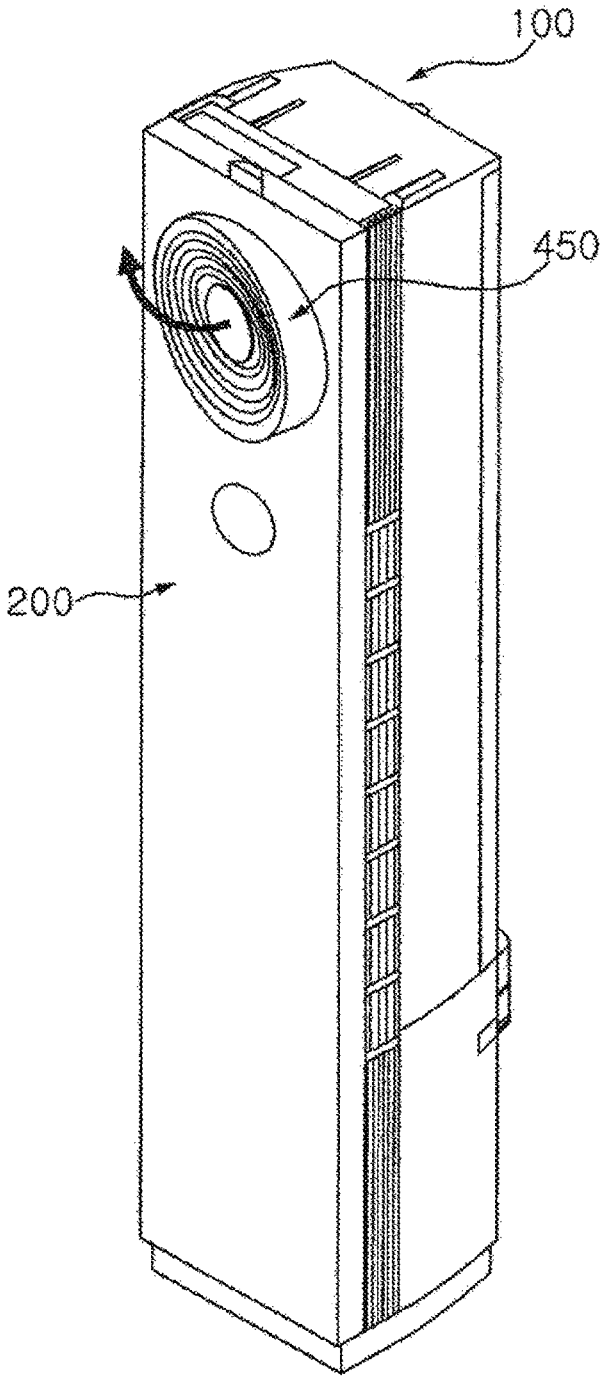
FIG. 2 is an exemplary view showing a steering grill in FIG. 1 tilted leftward.
Figure 3:
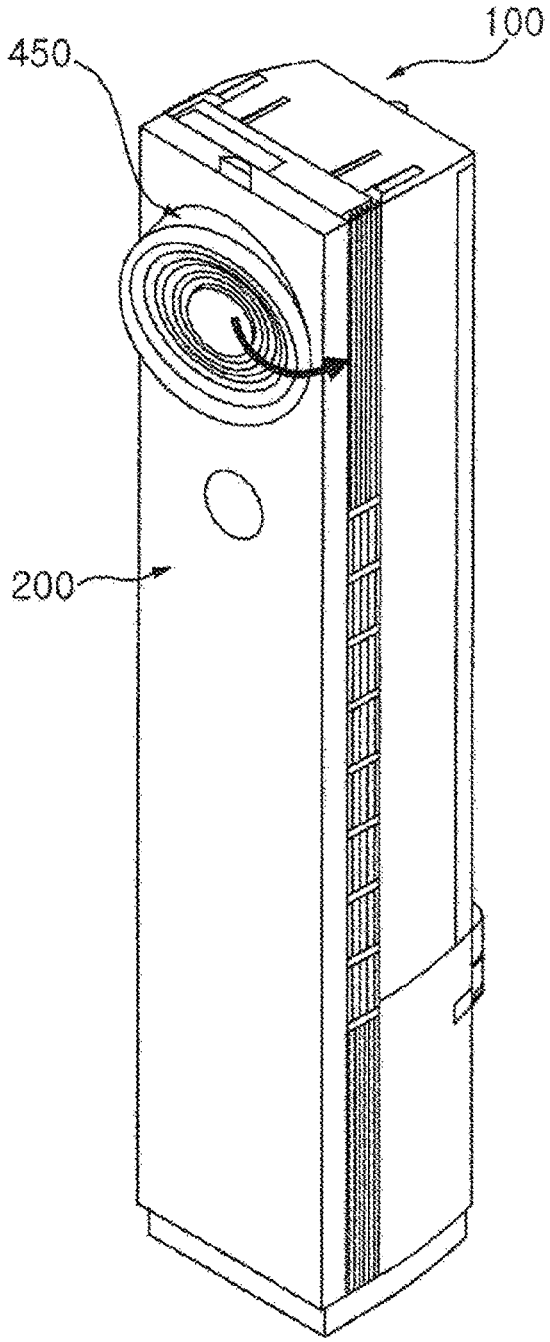
FIG. 3 is an exemplary view showing a steering grill in FIG. 1 tilted rightward.
Figure 4:
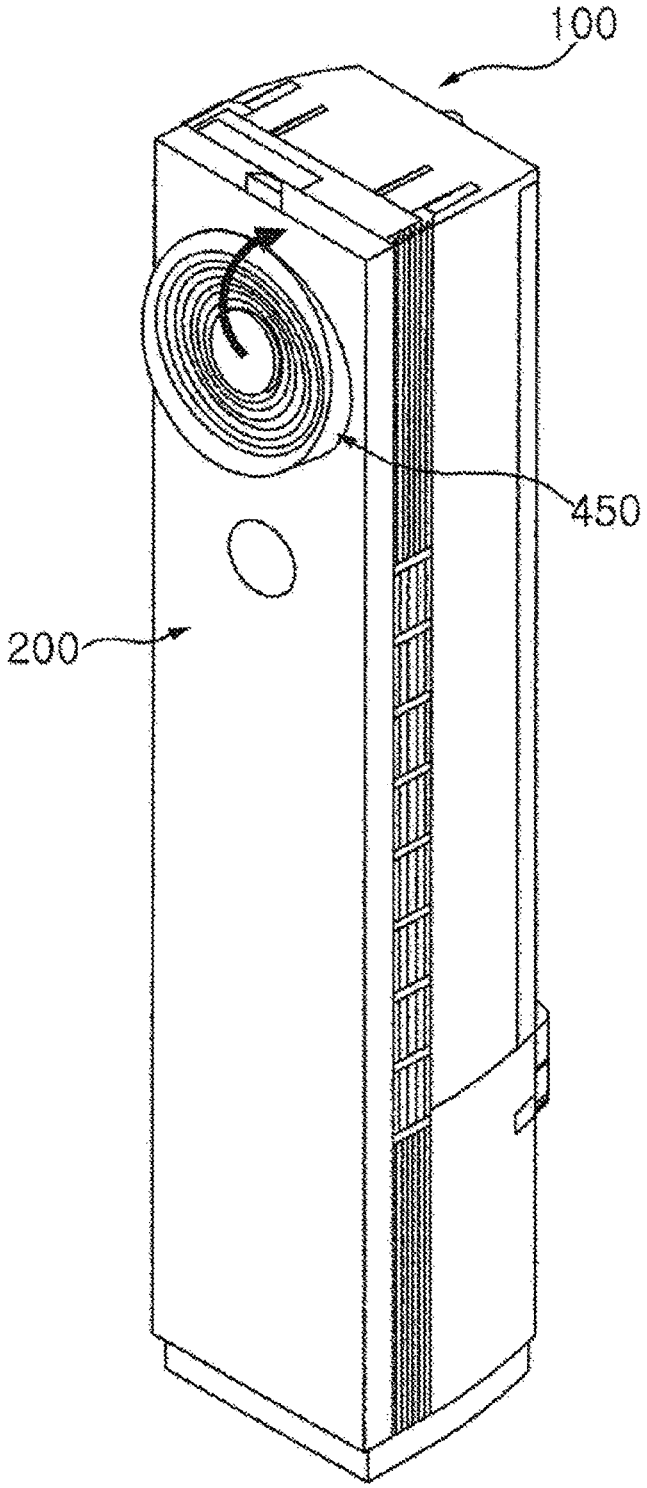
FIG. 4 is an exemplary view showing a steering grill in FIG. 1 tilted upward.
Figure 5:
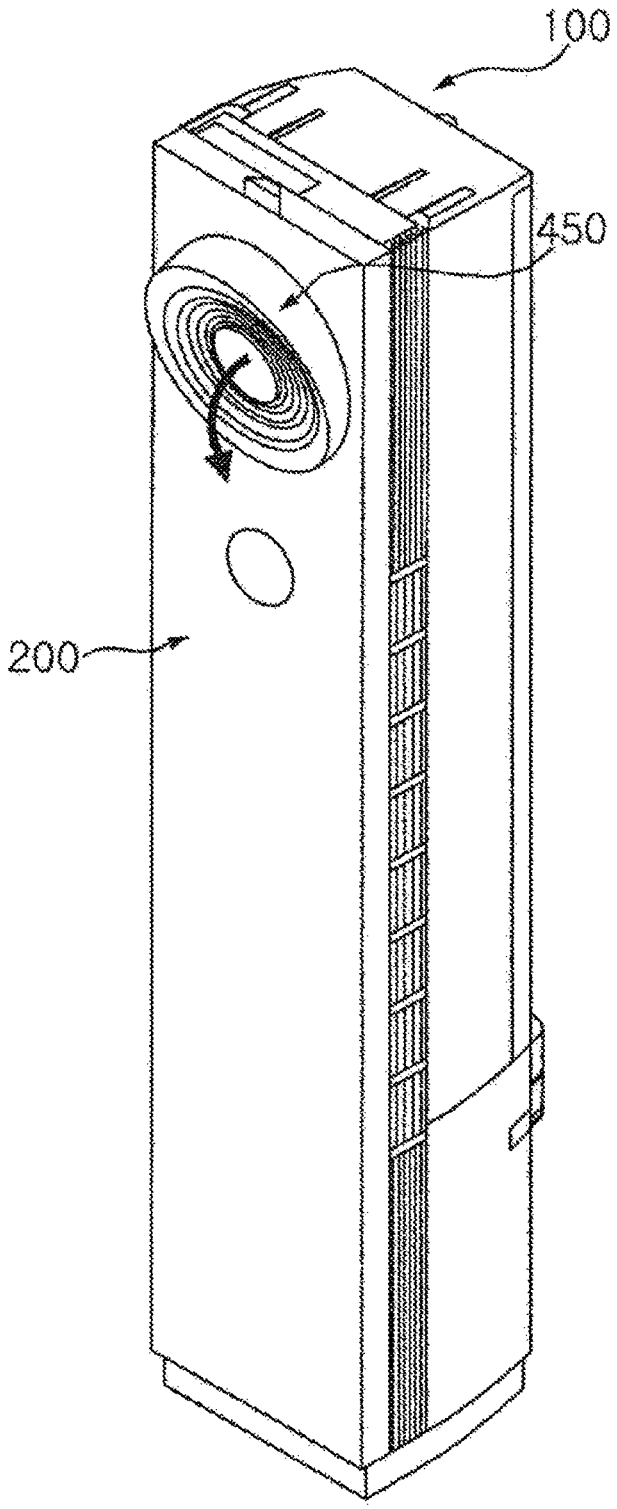
FIG. 5 is an exemplary view showing a steering grill in FIG. 1 tilted downward.
Figure 6:
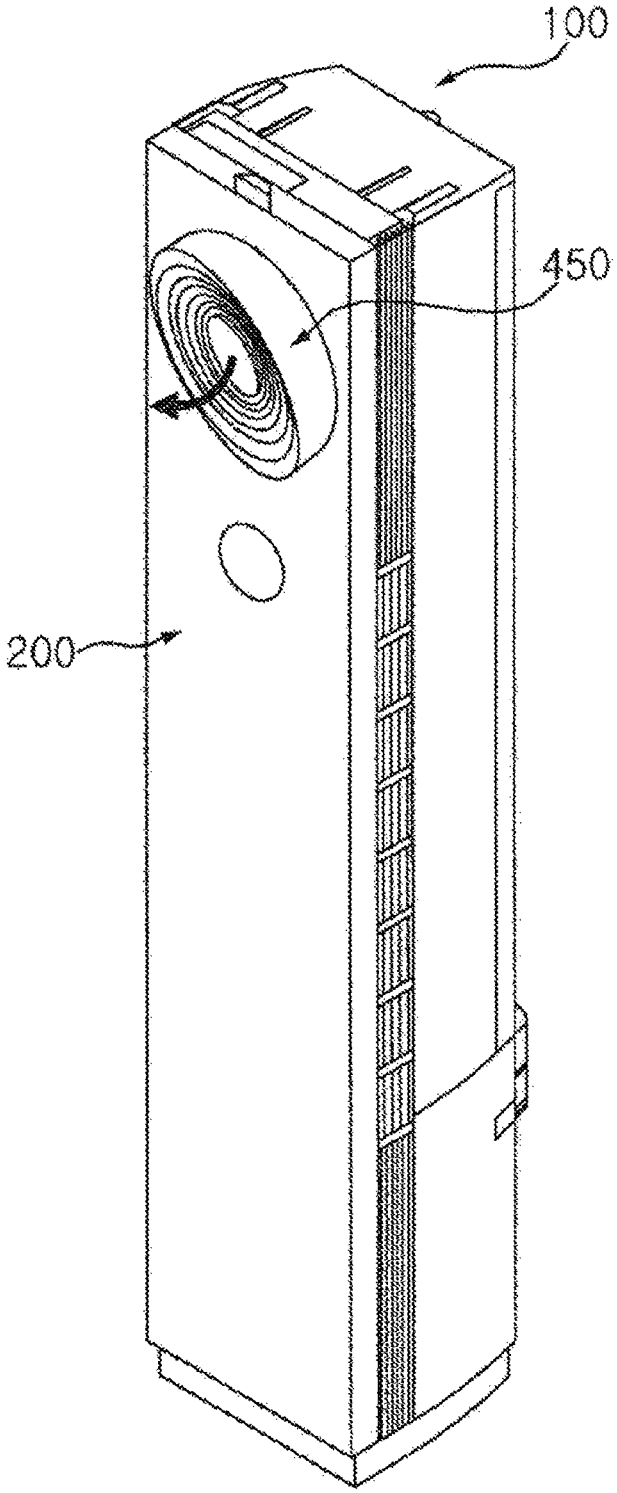
FIG. 6 is an exemplary view showing the steering grill in FIG. 1 tilted rightward and downward.
Figure 7:
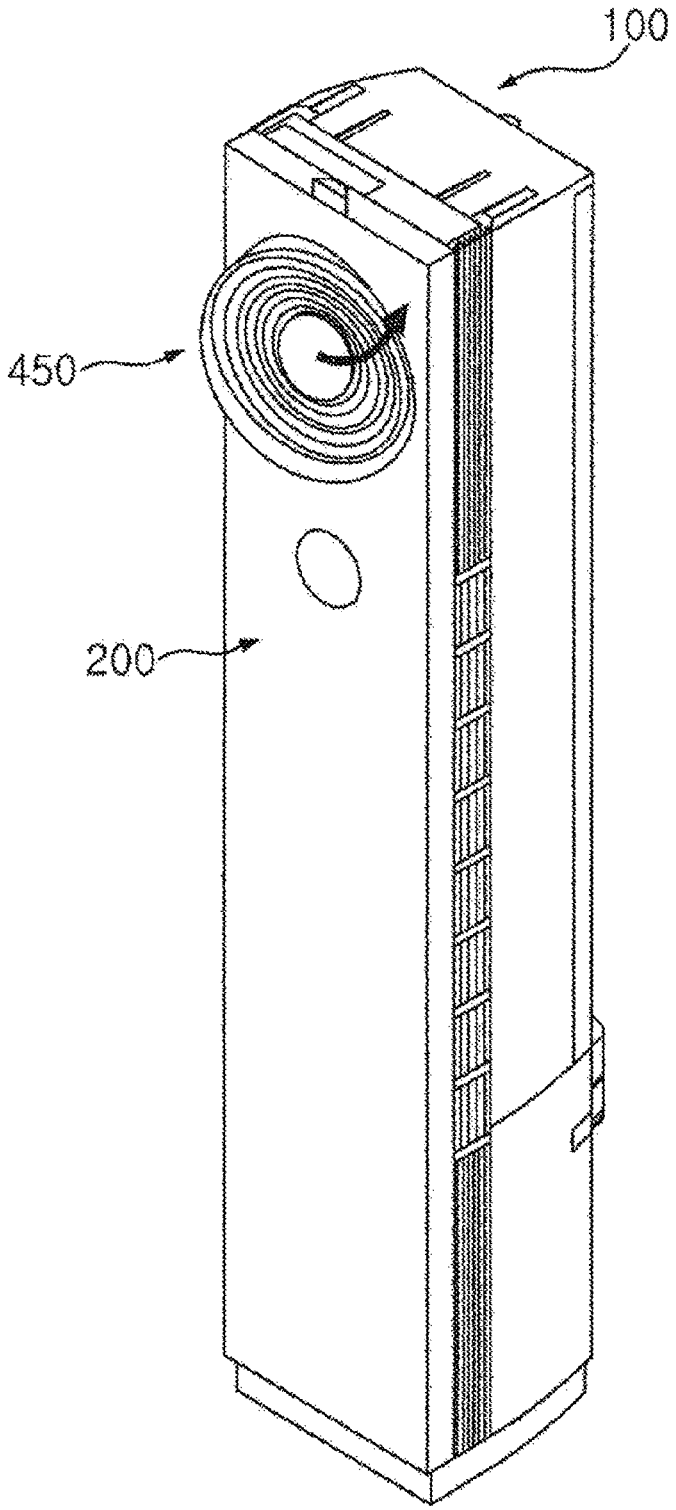
FIG. 7 is an exemplary view showing the steering grill in FIG. 1 tilted leftward and upward.

FIG. 1 is a perspective view showing an indoor unit of an air conditioner according to an embodiment of the present disclosure. FIG. 2 is an exemplary view showing a steering grill in FIG. 1 tilted leftward. FIG. 3 is an exemplary view showing a steering grill in FIG. 1 tilted rightward. FIG. 4 is an exemplary view showing a steering grill in FIG. 1 tilted upward. FIG. 5 is an exemplary view showing a steering grill in FIG. 1 tilted downward. FIG. 6 is an exemplary view showing a steering grill in FIG. 1 tilted rightward and downward. FIG. 7 is an exemplary view showing a steering grill in FIG. 1 tilted leftward and upward.

According to this embodiment, the air conditioner includes an indoor unit and an outdoor unit (not shown) connected to the indoor unit through a refrigerant pipe and to circulate refrigerant.

The outdoor unit includes a compressor (not shown) to compress a refrigerant, an outdoor heat exchanger (not shown) to receive refrigerant from the compressor and condense the refrigerant, an outdoor fan (not shown) to supply air to the outdoor heat exchanger, and an accumulator (not shown) to receive the refrigerant discharged by the indoor unit and provide only gas refrigerant to the compressor.

The outdoor unit may further include a four-way valve (not shown) to operate the indoor unit in a cooling mode or a heating mode. When the air conditioner is operated in the cooling mode, the indoor unit evaporates the refrigerant and cools the indoor air. When the air conditioner is operated in the heating mode, the indoor unit condenses the refrigerant to heat the indoor air.

<<<Configuration of Indoor Unit>>>

The indoor unit includes a cabinet assembly 100 to define an opening at a front surface thereof, a suction inlet 101 at a rear surface thereof, and an inner space (S), a door assembly 200 assembled to the cabinet assembly 100, to define a front discharge outlet 201, cover a front surface of the cabinet assembly 100, and open and close a front surface of the cabinet assembly 100, fan assemblies 300 and 400 disposed in the cabinet assembly 100 to discharge air in the inner space (S) to an indoor space, a heat exchange assembly 500 disposed between the fan assembly 300, 400 and the cabinet assembly 100 to heat-exchange the suctioned indoor air with refrigerant, and a filter assembly 600 disposed at a rear surface of the cabinet assembly 100 to filter air flowing to the suction inlet 101.

The indoor unit includes the suction inlet 101 disposed on the rear surface of the cabinet assembly 100, a side discharge outlet 301 disposed at a side surface of the cabinet assembly 100, and a front discharge outlet 201 disposed on a front surface of the cabinet assembly 100.

The air suctioned through the suction inlet 101 is discharged into the indoor space through the front discharge outlet 201 or the side discharge outlet 301.

The suction inlet 101 may be disposed on the rear surface of the cabinet assembly 100.

The side discharge outlets 301 may be disposed on the left side and the right side of the cabinet assembly 100.

The front discharge outlet 201 may be disposed in the door assembly 200. The front discharge outlet 201 penetrates the door assembly 200.

When viewed from the front, the front discharge outlet 201 may be disposed at an upper portion of the door assembly 100 to flow the air discharged from the front discharge outlet 201 to a remote indoor space. The front discharge outlet 201 is preferably disposed above the middle of the door assembly 200.

In one embodiment, the fan assemblies 300 and 400 include a short-distance fan assembly 300 and a long-distance fan assembly 400. In another embodiment, the short-distance fan assembly 300 is omitted and only the long-distance fan assembly 400 may be disposed. When the short-distance fan assembly 300 is omitted, the side discharge outlet 301 is also omitted and the conditioned air may only be discharged to the front discharge outlet 201.

The short-distance fan assembly 300 and the long-distance fan assembly 400 are each disposed in front of the heat exchange assembly 500. In addition, the short-distance fan assembly 300 and the long-distance fan assembly 400 are each disposed in front of the filter assembly 600. In one embodiment, the heat exchange assembly 500 is disposed in front of the filter assembly 600 and the fan assemblies 300 and 400 are each disposed in front of the heat exchange assembly 500.

The air is introduced into the short-distance fan assembly 300 and the long-distance fan assembly 400 through the heat exchange assembly 500. In this case, the air may be conditioned while passing through the heat exchange assembly 500 and the conditioned air may then be introduced into the short-distance fan assembly 300 and the long-distance fan assembly 400.

The heat exchange assembly 500 is disposed inside the cabinet assembly 100, is disposed in front of the suction inlet 101, and covers the entire suction inlet 101.

The suction inlet 101 may be disposed on the rear surface of the cabinet assembly 100 and may be disposed vertically. The heat exchange assembly 500 covers the entire suction inlet 101 to pass the air suctioned to the suction inlet 101 through the heat exchange assembly 500.

The heat exchange assembly 500 faces the suction inlet 101 and the rear surface of the cabinet assembly 100 and may be disposed vertically.

The heat exchange assembly 500 may be vertically disposed to minimize an installation space of the heat exchange assembly 500 and contact the short-distance fan assembly 300 and the long-distance fan assembly 400 with the front surface of the heat exchange assembly 500.

The short-distance fan assembly 300 and the long-distance fan assembly 400 each may contact the front surface of the heat exchange assembly 500 to effectively minimize the inner space of the cabinet assembly 100.

In particular, as the filter assembly 600, the heat exchange assembly 500, and the fan assemblies 300, 400 are all vertically disposed and sequentially stacked from a rear side to a front side thereof to minimize a thickness in a forward and rearward direction of the indoor unit.

When the heat exchange assembly 500 is disposed inside the cabinet assembly 100, the heat exchange assembly 500 may be inclined forward and rearward to occupy more installation space than the heat exchange assembly 500 that is vertically disposed, which causes an increase in thickness in the forward and rearward direction of the indoor unit.

The short-distance fan assembly 300 and the long-distance fan assembly 400 are each manufactured to have a length corresponding to a height of the heat exchange assembly 500.

The short-distance fan assembly 300 and the long-distance fan assembly 400 may each be vertically stacked. In one embodiment, the long-distance fan assembly 400 is disposed above the short-distance fan assembly 300. As the long-distance fan assembly 400 is disposed above the short-distance fan assembly 300, the discharge air discharged from the long-distance fan assembly 400 may flow to a remote place in the indoor space.

The short-distance fan assembly 300 discharges air laterally with respect to the cabinet assembly 100. The short-distance fan assembly 300 may provide an indirect air movement to users. The short-distance fan assembly 300 simultaneously discharges air to the left side and the right side of the cabinet assembly 100.

The long-distance fan assembly 400 may be disposed above the short-distance fan assembly 300 and may be disposed in the cabinet assembly 100 at an upper portion thereof.

The long-distance fan assembly 400 discharges air to the front discharge outlet 201 disposed in the cabinet assembly 100. The long-distance fan assembly 300 provides a directed air movement to the user.

The long-distance fan assembly 400 remotely discharges the air. If the long-distance fan assembly 400 only functions to remotely supply the air in the indoor space, the long-distance fan assembly 400 may be disposed on the upper portion of the indoor unit.

According to one embodiment, the long-distance fan assembly 400 may provide the directed air movement to an indoor target area. The target area may be an area having a large deviation between a target temperature and a room temperature. The target area may be an area where a user or a pet is active.

The long-distance fan assembly 400 includes a direction-adjustable steering grill 3450 to supply the directed air movement to the target area.

In one embodiment, the long-distance fan assembly 400 protrudes from the cabinet assembly 100 only during operation and is concealed in the cabinet assembly 100 when not in operation.

When the long-distance fan assembly 400 is operated, the long-distance fan assembly 400 passes through the front discharge outlet 201 of the door assembly 200 and protrudes further forward than the door assembly 200.

The long-distance fan assembly 400 protrudes from the front discharge outlet 201 to minimize interference of the directed air movement with the door assembly 200. When the long-distance fan assembly 400 is disposed inside the cabinet assembly 100 to discharge the air, air resistance is generated during passing through the front discharge outlet 201.

In one embodiment, when the long-distance fan assembly 400 provides a directed air movement to the indoor space, the steering grill 3450 of an example component of the long-distance fan assembly 400 penetrates the front discharge outlet 201 and protrudes further forward than the cabinet assembly 100.

Only the example component of the long-distance fan assembly 400 (e.g., the steering grill in this embodiment) penetrates the door assembly 200 to minimize a moving distance of the long-distance fan assembly 400 and obtain desired effects.

In particular, the long-distance fan assembly 400 may adjust an angle of the steering grill 3450 protruding out of the front discharge outlet 201. A direction of the steering grill 3450 is not limited to a specific angle or direction.

The steering grill 3450 may be disposed upward, downward, leftward, rightward, or diagonally with respect to the front surface of the cabinet assembly 100 when the steering grill 3450 protrudes from the front discharge outlet 201.

In addition, in one embodiment, the long-distance fan assembly 400 may immediately change the direction of the steering grill 3450 from a first specific direction to a second specific direction.

Referring to FIG. 2, the long-distance fan assembly 400 may protrude further forward than the door assembly 200 through the front discharge outlet 201. In particular, the steering grill 3450 protrudes further forward than a front surface 200*a* of the door assembly 200.

A state in which the steering grill 3450 protrudes further forward than the door assembly 200 is referred to as "a projection state".

When the steering grill 3450 is in the projection state, the steering grill 3450 may entirely protrude from the front surface of the door assembly 200. In one embodiment, the front surface of the steering grill 3450 partially protrudes further forward than the front surface 200*a* of the door assembly 200.

Referring to FIGS. 3 to 8, the steering grill 3450 may be tilted in any direction in the projection state. When viewed from the front of the cabinet assembly 100, the steering grill 3450 is tiltable upward, downward, leftward, rightward, or diagonally.

In the projection state, the steering grill 3450 may be tilted in any direction to provide directed air movement to the indoor target area.

Hereinafter, components of the indoor unit according to one embodiment are described in more detail.

<<Configuration of Short-Distance Fan Assembly>>

The short-distance fan assembly 300 discharges air to a side discharge outlet 301 of the cabinet assembly 100. The short-distance fan assembly 300 discharges the air to the side discharge outlet 301 and provides indirect air movement to users.

The short-distance fan assembly 300 may be disposed in front of the heat exchange assembly 500. The short-distance fan assembly 300 includes a plurality of fans 310 vertically stacked. In one embodiment, the short-distance fan assembly 300 includes three fans 310 vertically stacked.

In one embodiment, the fan 310 uses a centrifugal mixed flow fan. The fan 310 suctions air in an axial direction and discharges the air in a circumferential direction.

The fan 310 suctions the air from the rear side thereof, discharges the air in the circumferential direction thereof, and the air discharged in the circumferential direction flows to the front side thereof.

The short-distance fan assembly 300 includes a fan casing 320 defining openings at a front side and a rear side thereof and coupled to the cabinet assembly 100 and a plurality of fans 310 coupled to the fan casing 320 and disposed in the fan casing 320.

The fan casing 320 has a box shape and defines openings at a front surface and a rear surface thereof. The fan casing 320 may be coupled to the cabinet assembly 100.

The front surface of the fan casing 320 faces the door assembly 200. The rear surface of the fan casing 320 faces the heat exchange assembly 500.

The front surface of the fan casing 320 contacts the door assembly 200 and is closed.

In one embodiment, a portion of the side surface of the fan casing 320 may be exposed to an outside. The fan casing 320 exposed to the outside defines a side discharge outlet 301. A discharge vane may be disposed in the side discharge outlet 302 to control an air discharge direction. The side discharge outlets 301 are disposed on the left side and the right side of the fan casing 320.

The fan 310 may be disposed inside the fan casing 320. The plurality of fans 310 are disposed on the same plane and are vertically stacked in a row.

The fan 310 uses the centrifugal mixed flow fan to suction the air from the rear surface of the fan casing 320 and then discharge the air forward in the circumferential direction.

Figure 8:
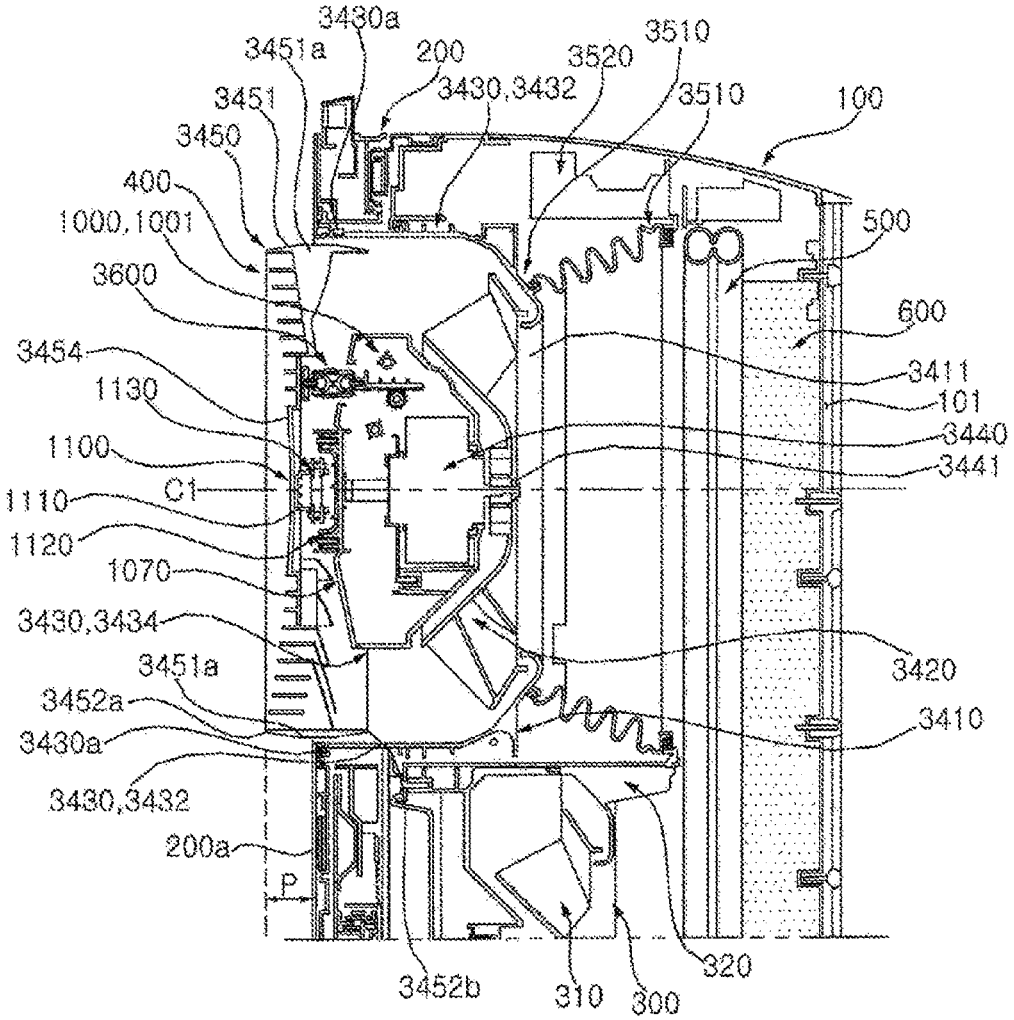
FIG. 8 is a cross-sectional view showing a long-distance fan assembly in FIG. 1.
Figure 9:
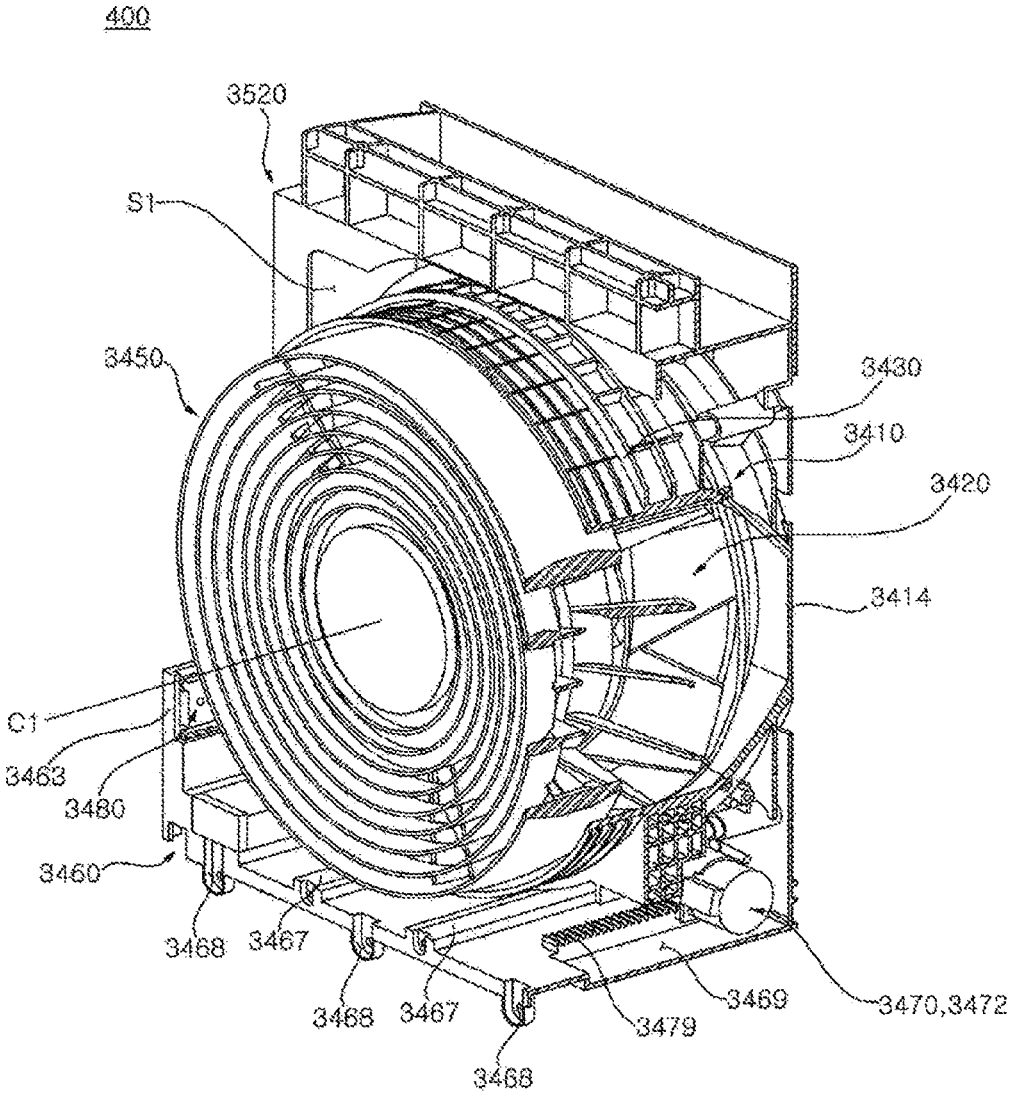
FIG. 9 is a partially cut-away perspective view showing a long-distance fan assembly according to an embodiment of the present disclosure.
Figure 10:
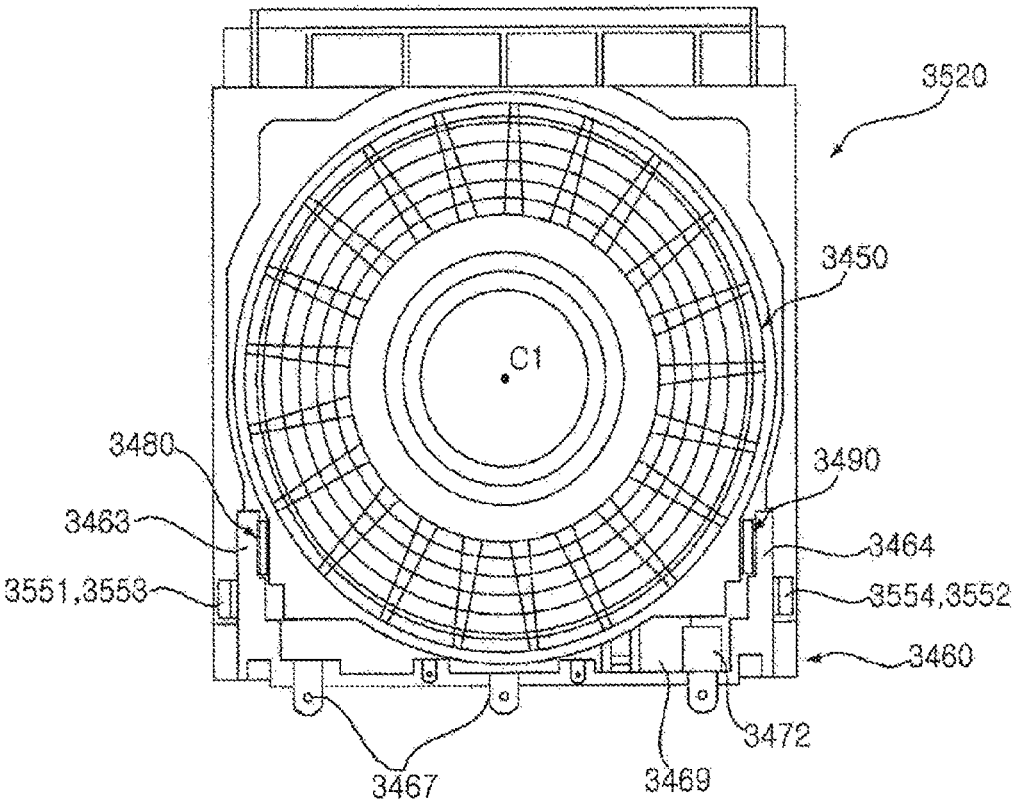
FIG. 10 is a front view showing a long-distance fan assembly according to an embodiment of the present disclosure.
Figure 11:
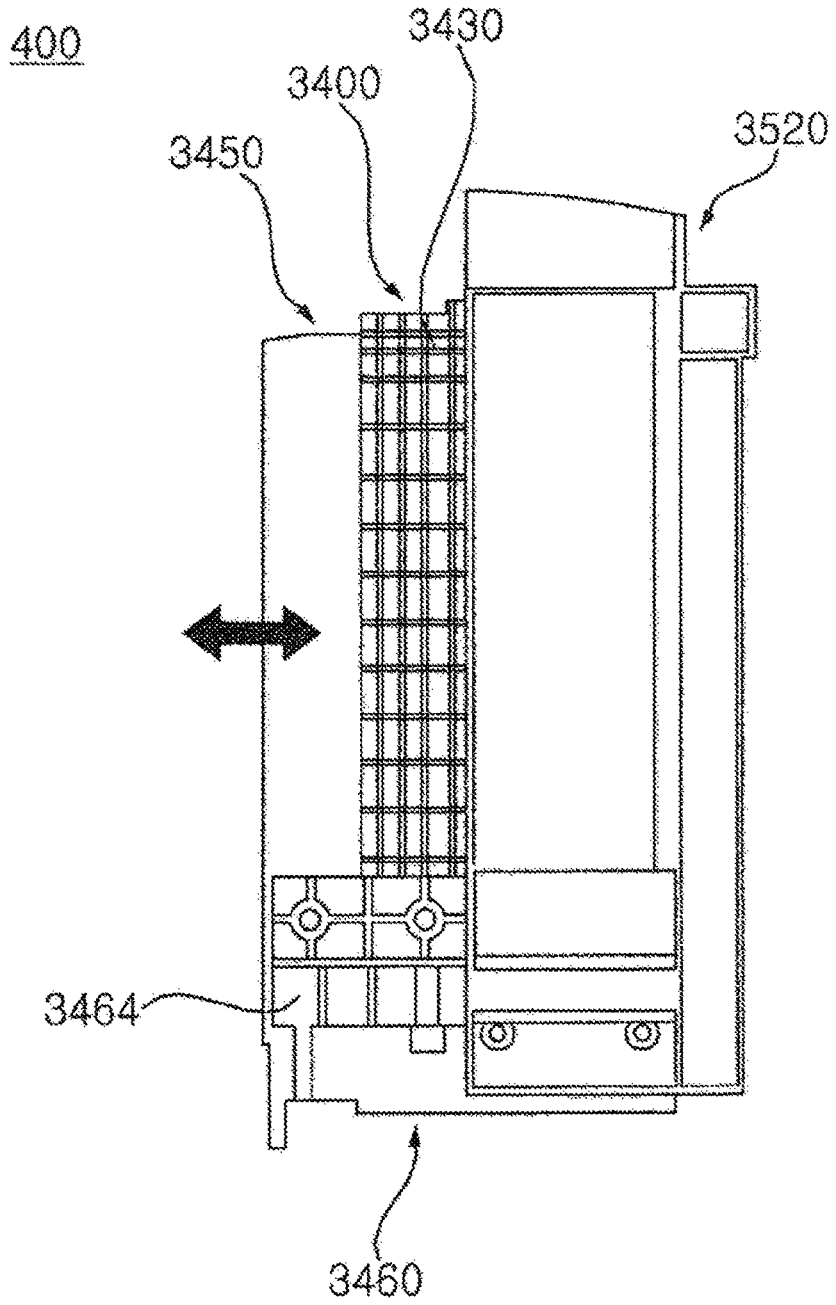
FIG. 11 is a right side view showing the long-distance fan assembly in FIG. 9.
Figure 12:
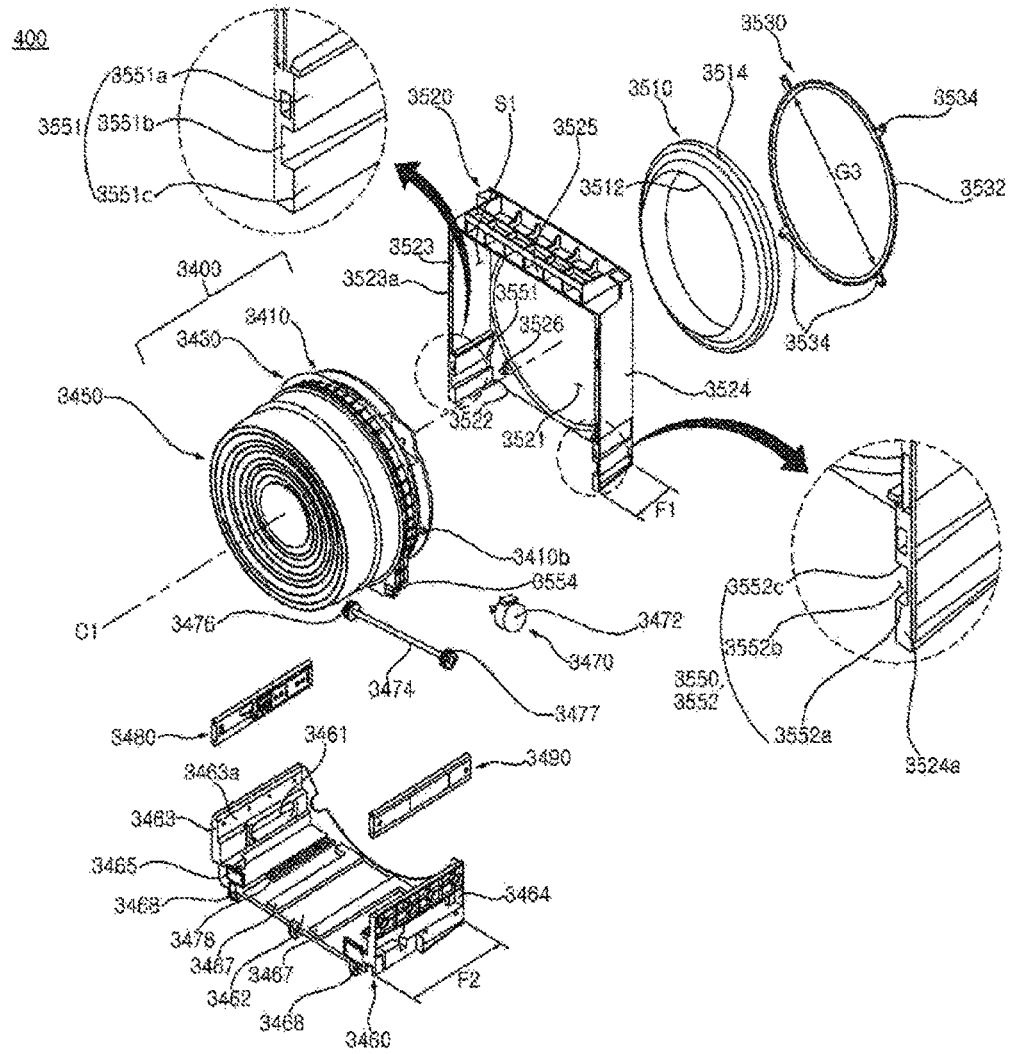
FIG. 12 is an exploded perspective view showing the long-distance fan assembly in FIG. 10.
Figure 13:
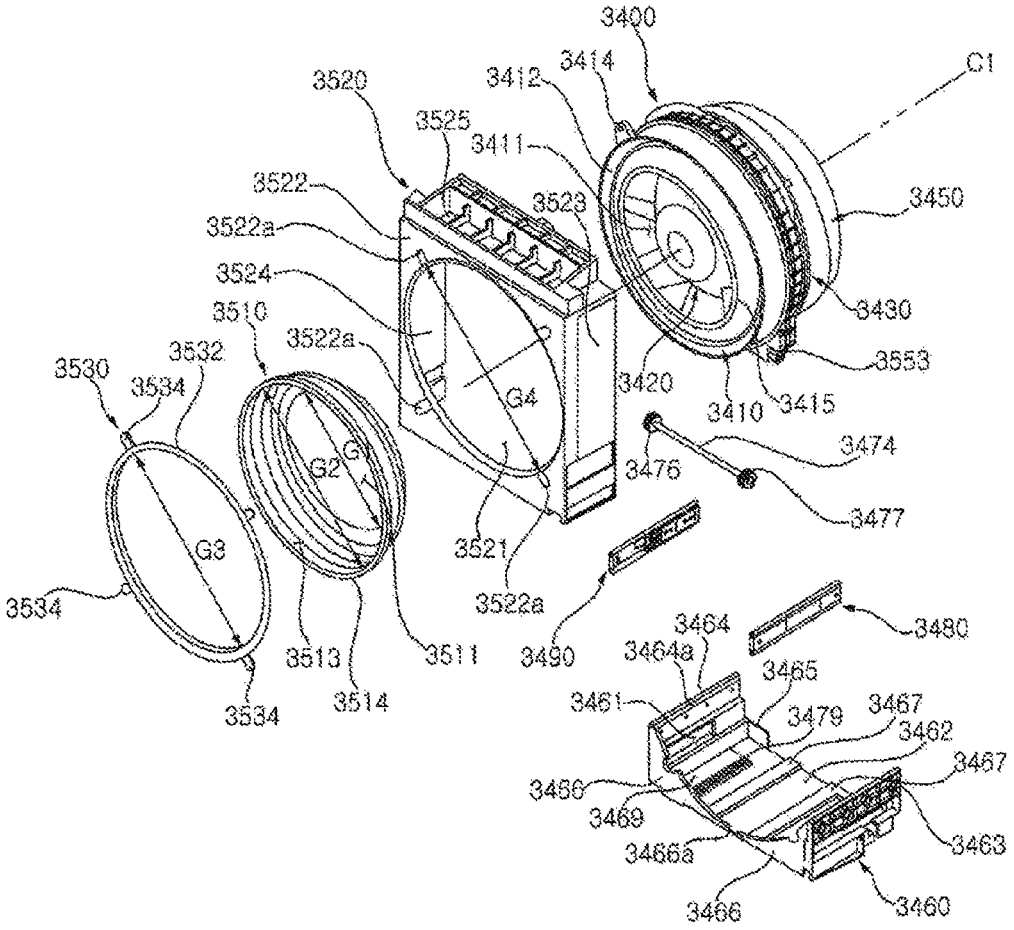
FIG. 13 is an exploded perspective view showing the long-distance fan assembly in FIG. 12 viewed from the rear.
Figure 14:
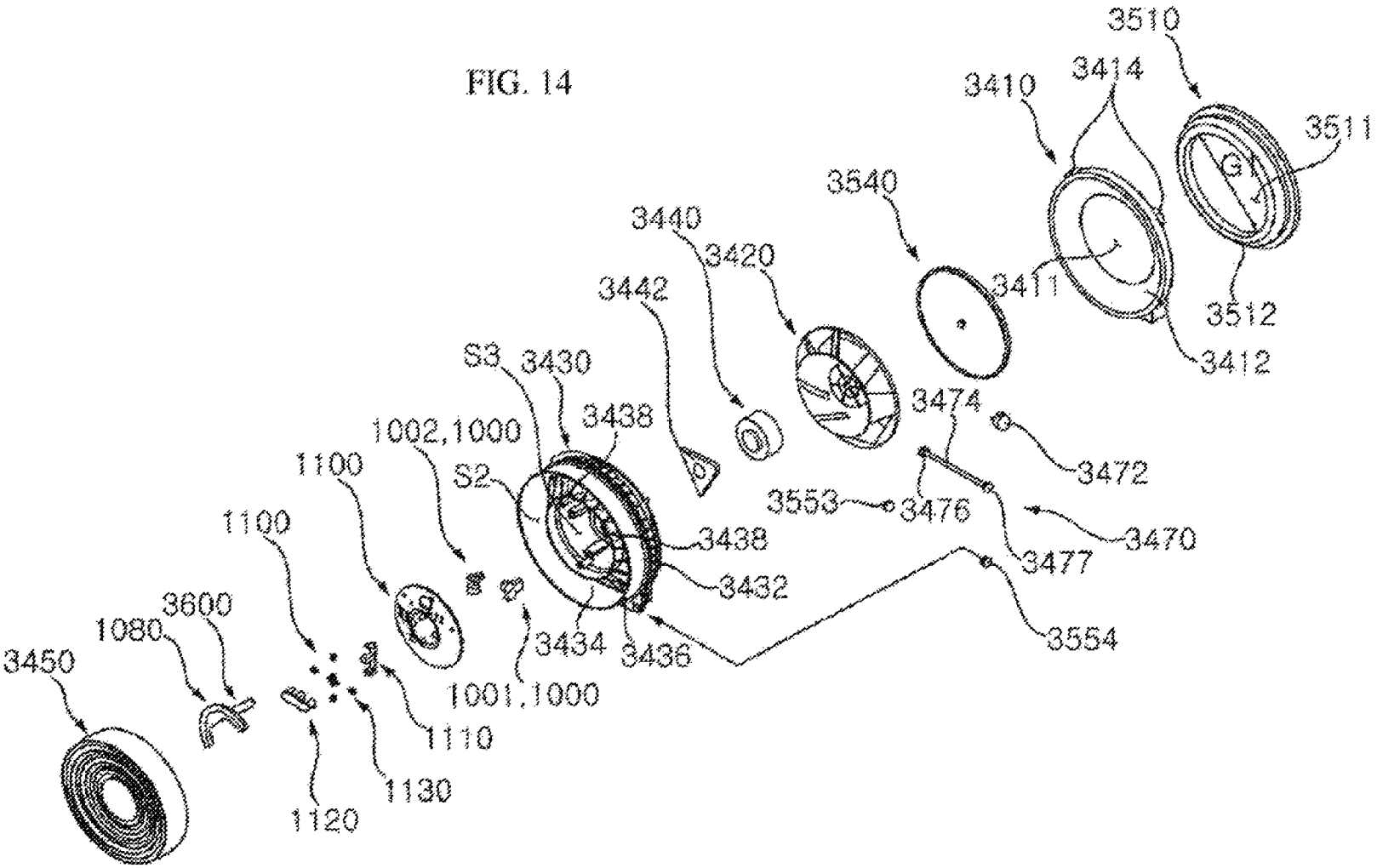
FIG. 14 is an exploded perspective view showing the fan housing assembly in FIG. 12.
Figure 15:
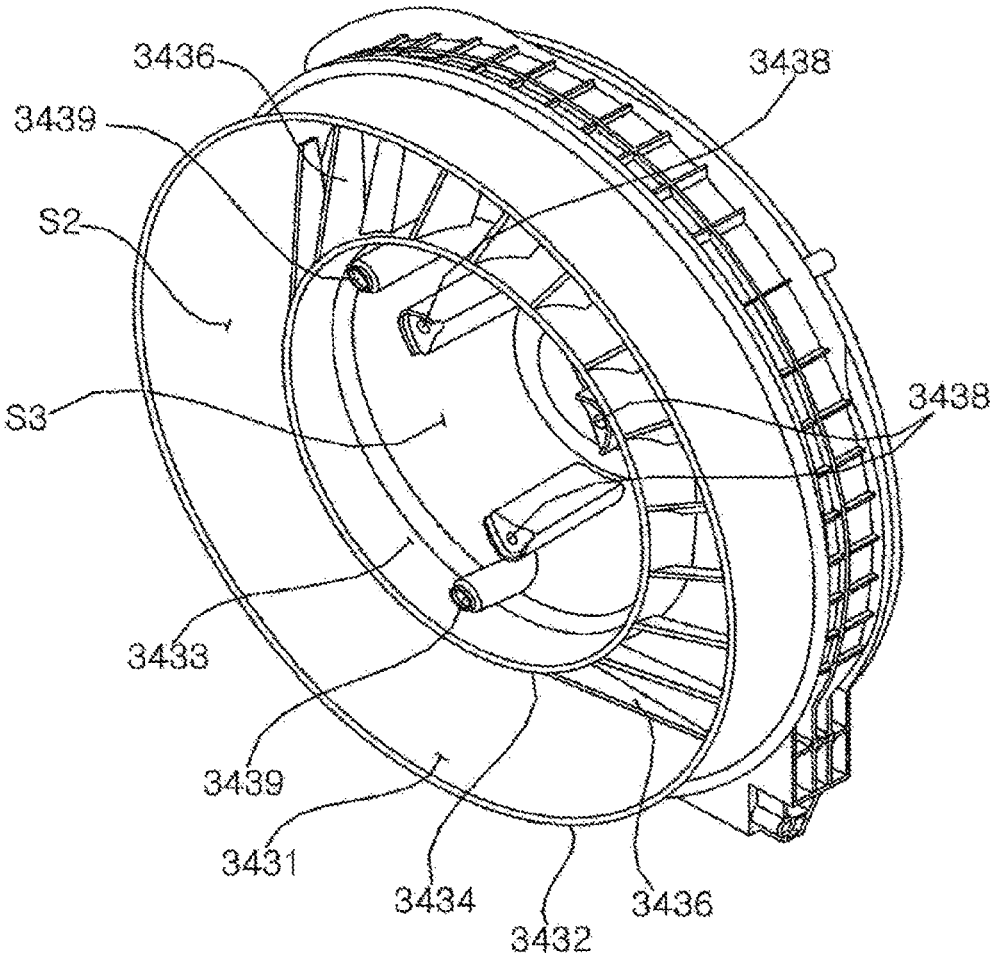
FIG. 15 is a perspective view showing the front fan housing in FIG. 14.
Figure 16:
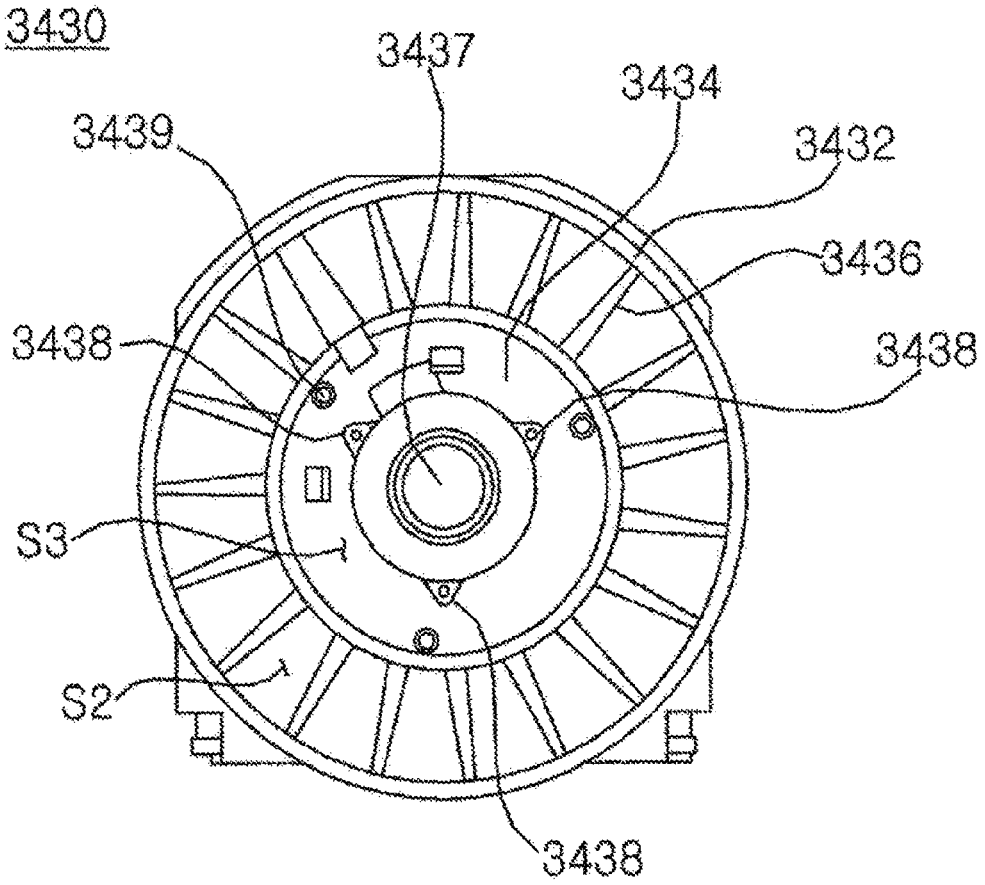
FIG. 16 is a front view showing the front fan housing in FIG. 15.
Figure 17:
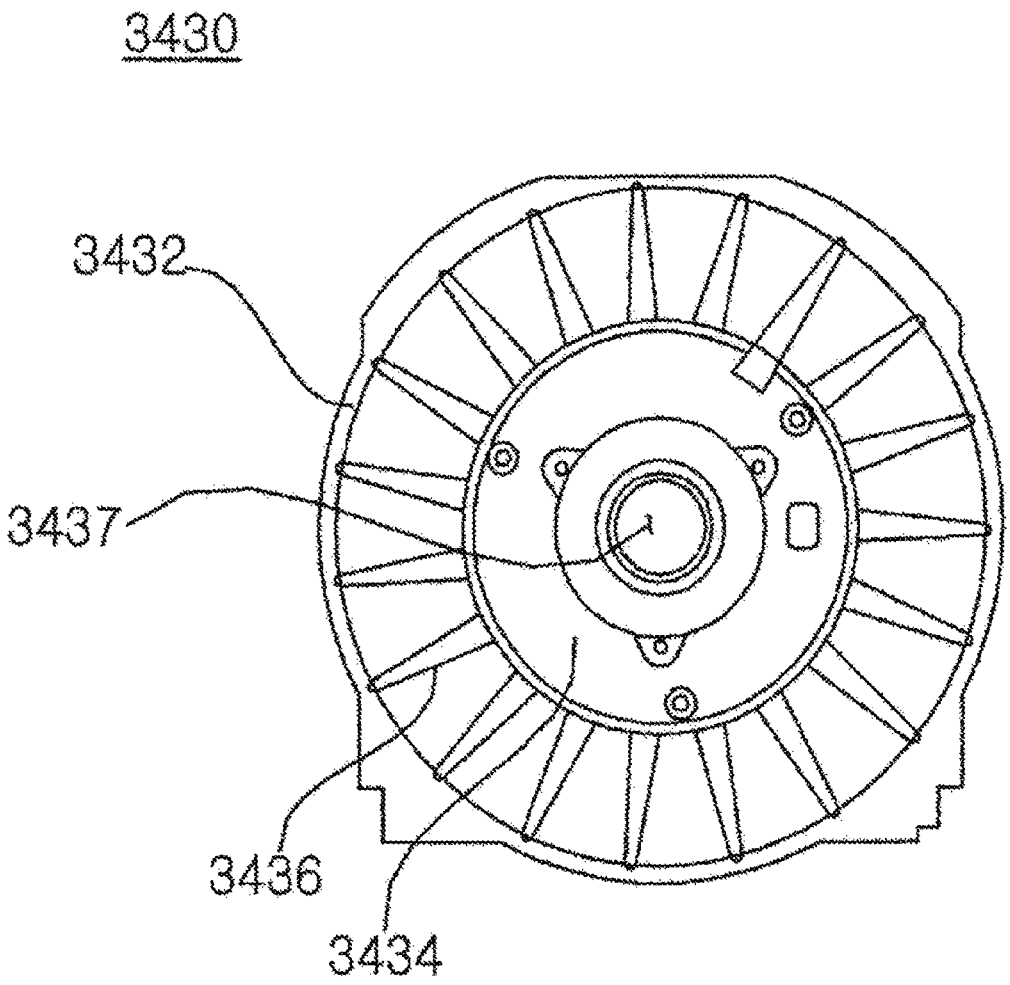
FIG. 17 is a rear view showing the front fan housing in FIG. 15.
Figure 18:
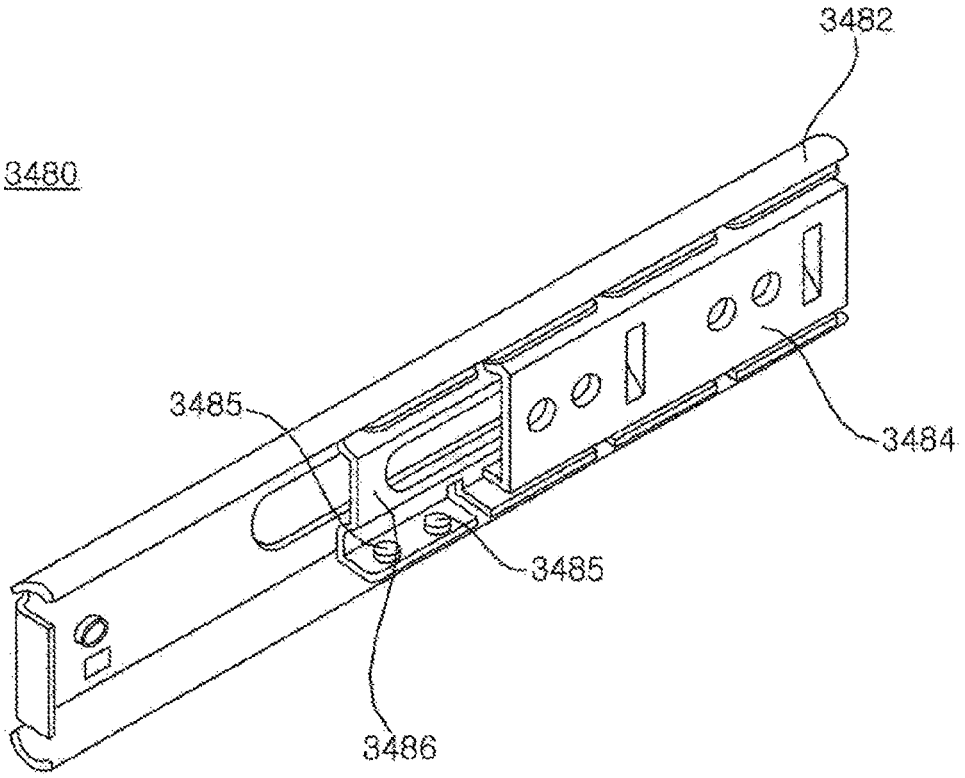
FIG. 18 is a perspective view showing a guide rail in FIG. 12.
Figure 19:
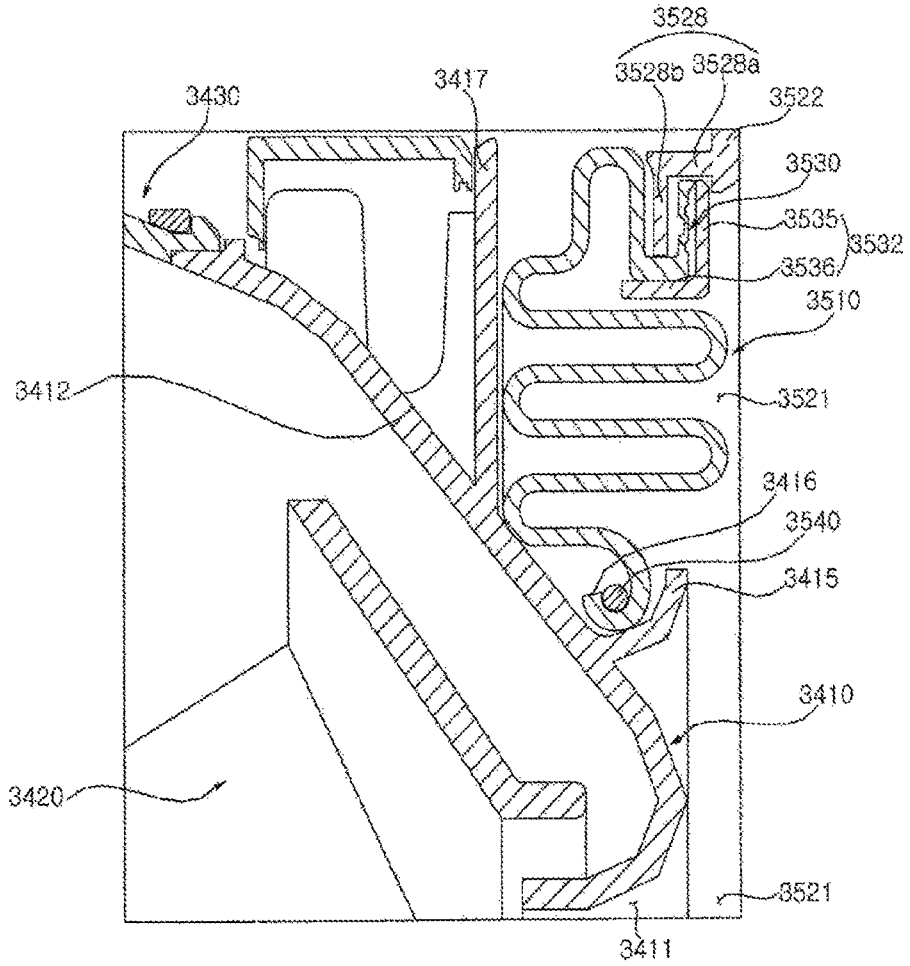
FIG. 19 is a cross-sectional view showing an air guide in FIG. 12 before operation.

FIG. 8 is a cross-sectional view showing a long-distance fan assembly in FIG. 1. FIG. 9 is a partially cut-away perspective view showing a long-distance fan assembly according to an embodiment of the present disclosure. FIG. 10 is a front view showing a long-distance fan assembly according to an embodiment of the present disclosure. FIG. 11 is a right side view showing the long-distance fan assembly in FIG. 9. FIG. 12 is an exploded perspective view showing the long-distance fan assembly in FIG. 10. FIG. 13 is an exploded perspective view showing the long-distance fan assembly in FIG. 12 viewed from the rear. FIG. 14 is an exploded perspective view showing the fan housing assembly in FIG. 12. FIG. 15 is a perspective view showing the front fan housing in FIG. 14. FIG. 16 is a front view showing the front fan housing in FIG. 15. FIG. 17 is a rear view showing the front fan housing in FIG. 15. FIG. 18 is a perspective view showing the guide rail in FIG. 12. FIG. 19 is a cross-sectional view showing the air guide in FIG. 12 before operation.

<<Configuration of Long-Distance Fan Assembly>>

The long-distance fan assembly 400 is movable relative to the cabinet assembly 100 in a forward and rearward direction. The long-distance fan assembly 400 discharges air to a front of the door assembly 200 and provides direct air to an indoor space.

The long-distance fan assembly 400 passes through a front discharge outlet 201 of the door assembly 200 only during operation and protrudes further forward than a front surface 200*a* of the door assembly 200. In such a case, the long-distance fan assembly 400 is in a projection state.

The long-distance fan assembly 400 is disposed inside the cabinet assembly 100 and is moved in the forward and rearward direction inside the cabinet assembly 100 only during operation.

The long-distance fan assembly 400 may be disposed in front of the heat exchange assembly 500 and is disposed behind the door assembly 200. The long-distance fan assembly 400 may be disposed above the short-distance fan assembly 300 and is disposed below an upper wall of the cabinet assembly 100.

The long-distance fan assembly 400 discharges air through the front discharge outlet 201 defined in the door assembly 200 and the steering grill 3450 of the long-distance fan assembly 400 may be disposed in front of the front discharge outlet 201.

The steering grill 3450 may be disposed outside the front discharge outlet 201 to minimize air resistance due to structures such as the cabinet assembly 100 or the door assembly 200.

The long-distance fan assembly 400 provides a structure tiltable in an upward direction, a downward direction, a leftward direction, a rightward direction, or a diagonal direction. The long-distance fan assembly 400 may discharge the air to a remote place of the indoor space and may improve indoor air circulation.

The long-distance fan assembly 400 includes a guide housing (e.g., in one embodiment, an upper guide housing and a lower guide housing described below) disposed inside the cabinet assembly, a fan housing assembly 3400 assembled to be movable relative to the guide housing and to discharge air in the inner space (S) to the front discharge outlet, and an actuator 3470 disposed in at least one of the cabinet assembly 100 or the guide housing and to move the fan housing assembly along the guide housing.

The guide housing includes an upper guide housing 3520 disposed in front of the heat exchange assembly 500 and defining a guide housing suction inlet 3521 to introduce air passing through the heat exchange assembly 500 and a lower guide housing 3460 assembled to the upper guide housing 3520 to place the front fan housing 3430, and to guide forward and rearward movement of the front fan housing 3430.

The fan housing assembly 3400 includes a rear fan housing 3410 defining a fan suction inlet 3411 communicating with the guide housing suction inlet 3521 and disposed in the upper guide housing 3520, a fan 3420 disposed in front of the rear fan housing 3410 to discharge air suctioned by the fan suction inlet 3411 in a diagonal direction, a front fan housing 3430 disposed in front of the rear fan housing 3410, coupled to the rear fan housing 3410, disposed in front of the fan 3420, assembled to the fan 3420, to guide air pressurized by the fan 3420 in the diagonal direction, a fan motor 3440 disposed in front of the front fan housing 3430, including a motor shaft 3441 assembled to the fan 3420 through the front fan housing 3430, to rotate the fan 3420, a steering grill 3450 disposed in front of each of the front fan housing 3430 and the fan motor 3440, tiltable in any direction with respect to the front fan housing 3430, to control a discharge direction of air guided by the front fan housing 3430, and a steering assembly 1000 disposed between the front fan housing 3430 and the steering grill 3450 and configured to push or pull the steering grill 3450 to tilt the steering grill 3450 with respect to a central axis (C1) of the steering grill 3450.

The actuator 3470 may be disposed in at least one of the front fan housing 3430 or the lower guide housing 3460 and provides a driving force when the front fan housing 3430 moves in the forward and rearward direction.

The long-distance fan assembly 400 further includes an air guide 3510 opened in the forward and rearward direction, connecting the rear fan housing 3410 to the upper guide housing 3520, to guide the air suctioned by the guide housing suction inlet 3521 into the fan suction inlet 3411, may be made of an elastic material, in order to expand or contract when the front fan housing 3430 moves in the forward and rearward direction.

For convenience of description, the assembly moved in the forward and rearward direction by an actuator 3470 of the long-distance fan assembly 400 is referred to as "a fan housing assembly 3400". The fan housing assembly 3400 includes a rear fan housing 3410, a front fan housing 3430, a fan 3420, a steering grill 3450, a fan motor 3440, and a steering assembly 1000.

The fan housing assembly 3400 may be moved in the forward and rearward direction by the actuator 3470. A first guide rail 3480 and a second guide rail 3490 may be further disposed between the front fan housing 3430 and the lower guide housing 3460 to easily slide the front fan housing 3430.

The lower guide housing 3460 and the upper guide housing 3520 are coupled structures and may each be coupled to at least one of the cabinet assembly 100 or the short-distance fan assembly 300.

The air that has passed through the heat exchange assembly 500 passes through the guide housing suction inlet 3521, the fan suction inlet 3411, the fan 3420, and the front fan housing 3430, and is discharged from the steering grill 3450.

The upper guide housing 3520 and the lower guide housing 3460 may be integrated with each other. The integrated upper guide housing 3520 and lower guide housing 3460 may be referred to as "a guide housing".

The guide housing defines an opening at a front surface thereof to move the fan housing assembly 3400 in the forward and rearward direction and defines a guide housing suction inlet 3521 at a rear surface thereof to suction the air.

In one embodiment, the upper guide housing 3520 and the lower guide housing 3460 are respectively fabricated and assembled to move the fan housing assembly 3400 in the forward and rearward direction.

<Configuration of Upper Guide Housing>

The upper guide housing 3520 constitutes an upper portion of a guide housing. The upper guide housing 3520 surrounds a fan housing assembly 3400. The upper guide housing 3520 guides air that has passed through a heat exchange assembly 500 to the fan housing assembly 3400.

The upper guide housing 3520 prevents air passing through the heat exchange assembly 500 from flowing into the steering grill 3450 through other flow paths except for the guide housing suction inlet 3521.

The guide housing suction inlet 3521 provides a unified flow path for guiding the cooled air to the steering grill 3450 to minimize contact of the cooled air with the door assembly 200.

The upper guide housing 3520 preferably has an area capable of covering the front surface of the heat exchange assembly 500. In one embodiment, the upper guide housing 3520 has a shape and an area to cover the upper remaining area not covered by the short-distance fan assembly 300.

The upper guide housing 3520 may be assembled to the lower guide housing 3460 and may be disposed on the lower guide housing 3460. The upper guide housing 3520 and the lower guide housing 3460 may be integrated with each other through fastening.

The fan housing assembly is disposed inside each of the upper guide housing 3520 and the lower guide housing 3460 and is movable relative to each of the upper guide housing 3520 and the lower guide housing 3460 in the forward and rearward direction.

The upper guide housing 3520 has a rectangular parallelepiped shape and defines openings at the front surface and the rear surface thereof.

The upper guide housing 3520 includes a rear wall 3522 defining a guide housing suction inlet 3521, a left wall 3523 and a right wall 3524 protruding forward from a side edge of the rear wall 3522, and a top wall 3525 protruding forward from an upper edge of the rear wall 3522.

The guide housing suction inlet 3521 penetrates the rear wall 3522 in the forward and rearward direction. The guide housing suction inlet 3521 has a circular shape when viewed from the front. The guide housing suction inlet 3521 is larger than the fan suction inlet 3411. The fan suction inlet 3411 also has a circular shape when viewed from the front. The diameter of the guide housing suction inlet 3521 is greater than the diameter of the fan suction inlet 3411.

The left wall 3523 is disposed on the left when viewed from the front and the right wall 3524 is disposed on the right. The left wall 3523 and the right wall 3524 face each other.

The top wall 3525 connects the rear wall 2522, the left wall 3523, and the right wall 3524. The fan housing assembly is disposed under the top wall 3525.

When not in operation, the fan housing assembly is disposed between the left wall 3523, the right wall 3524, and the top wall 3525. In operation, the fan housing assembly may be moved forward.

Even when the fan housing assembly is moved forward to a maximum position, the rear fan housing 3410 is disposed inside the upper guide housing 3520. In one embodiment, when the fan housing assembly is moved forward to a maximum position, a rear end 3410*b* of the rear fan housing 3410 is disposed at a rear side of a front end 3523*a* of the left wall 3523 and a front end 3524*a* of the right wall 3524.

When the fan housing assembly moves out of the upper guide housing 3520 during operation to return to an initial position thereof, if an external shock is applied, the fan housing assembly may be engaged with the upper guide housing 3520 and may not be returned to the initial position thereof.

Further, when the fan housing assembly moves out of the upper guide housing 3520, a flow distance of air flowing from the guide housing suction inlet 3521 to the fan suction inlet 3411 may be increased.

A fixer 3526 may be disposed in the rear wall 3522 to fix the air guide 3510. The fixer 3526 protrudes forward from the front surface of the rear wall 3522. A plurality of fixers 3526 are disposed and each fixer 3526 is disposed outside the guide housing suction inlet 3521. In one embodiment, the fixers 3526 are disposed in four places.

In one embodiment, a lower surface 3527 of the upper guide housing 3520 is opened. In another embodiment, the lower surface 3527 may be closed.

In one embodiment, as the lower guide housing 3460 is disposed under the upper guide housing 3520 and the lower guide housing 3460 closes the lower surface 3527, the lower surface 3527 may be manufactured to have an open shape.

A horizontal width of the rear wall 3522 is greater than a horizontal width of the heat exchange assembly 500 and air passing through the heat exchange assembly 500 preferably flows into only the guide housing suction inlet 3521.

When the width of the rear wall 3522 is narrower than the width of the heat exchange assembly 500, the air passing through the heat exchange assembly 500 may flow to the door assembly 200 through the outside portion of the long-distance fan assembly 400. This structure allows cold air to be used to cool the door assembly 200 when cooling to occur dew formation.

The front surface of the rear wall 3522 preferably faces the front surface of the heat exchange assembly 500 and the rear wall 3522 preferably contacts the front surface of the heat exchange assembly 500. The rear wall 3522 may contact the front surface of the heat exchange assembly 500 to effectively flow the heat-exchanged air to the guide housing suction inlet 3521.

A length in a forward and rearward direction of each of the left wall 3523, the right wall 3524, and the top wall 3525 is referred to as "F1".

At least one of the left wall 3523 or the right wall 3524 defines a guide groove 3550. The guide groove 3550 is disposed in the forward and rearward direction.

The guide groove 3550 supports the fan housing assembly 3400 and guides the forward and rearward movement of the fan housing assembly 3400.

A guide groove 3550 defined in the left wall 3523 is referred to as "a first guide groove 3551" and a guide groove 3550 defined in the right wall 3524 is referred to as "a second guide groove 3552".

The first guide groove 3551 may be provided in the storage space (S1) and may be concave toward the left wall 3523. The second guide groove 3552 may be concave toward the right wall 3524 in the storage space (S1).

The first guide groove 3551 may be defined on an inner surface of the left wall 3523, extends long in the forward and rearward direction, and opens toward the inner space (S1). The second guide groove 3552 may be defined on an inner surface of the right wall 3524, extends long in the forward and rearward direction, and opens toward the inner space (S1).

The first guide groove 3551 includes a lower surface 3551*a*, a side surface 3551*b*, and an upper surface 3551*c* and the second guide groove 3522 includes a lower surface 3552*a*, a side surface 3552*b*, and an upper surface 3552*c*.

The lower surface 3551*a* of the first guide groove 3551 and the lower surface 3552*a* of the second guide groove 3552 each support the load of the fan housing assembly 3400.

The first guide roller 3553 and the second guide roller 3554 of the fan housing assembly 3400 described below are moved in the forward and rearward direction along the first guide groove 3551 and the second guide groove 3552.

The first guide groove 3551 and the second guide groove 3552 each provide moving spaces of the first guide roller 3553 and the second guide roller 3554 and each support the first guide roller 3553 and the second guide roller 3554.

<Configuration of Lower Guide Housing>

The lower guide housing 3460 constitutes a lower portion of a guide housing. The lower guide housing 3460 movably supports the fan housing assembly 3400 and guides the fan housing assembly 3400 in a forward and rearward direction.

There is no particular restriction on a shape of the lower guide housing 3460 and the lower guide housing 3460 may have a shape capable of supporting the fan housing assembly 3400 and guiding the frontward and rearward movement.

The lower guide housing 3460 may be assembled to the upper guide housing 3520 and provides a storage space (S1) to accommodate the fan housing assembly 3400. In one embodiment, only the rear side of the fan housing assembly 3400 is accommodated and a front side thereof may be exposed outside the storage space S1. In another embodiment, the storage space S1 may accommodate the entire fan housing assembly 3400.

In one embodiment, the lower guide housing 3460 is disposed on the fan casing 320.

The lower guide housing 3460 has a longer length in the forward and rearward direction than that of the upper guide housing 3520 because the lower guide housing 3460 supports the fan housing assembly 3400 and guides the forward and rearward movement of the fan housing assembly 3400. The length in the forward and rearward direction of the lower guide housing 3460 is referred to as "F2". The length (F2) in the forward and rearward direction of the lower guide housing 3460 is longer than the length (F1) in the forward and rearward direction of the upper guide housing 3520.

The lower guide housing 3460 closes the lower surface of the upper guide housing 3520 and movably supports the fan housing assembly 3400. The fan housing assembly 3400 may be moved in the forward and rearward direction by an actuator 3470 when the fan housing assembly 3400 is supported on the lower guide housing 3460.

The lower guide housing 3460 includes a housing base 3462 disposed under the fan housing assembly 3400, a left side wall 3463 and a right side wall 3464 extending upward from both edges of the housing base 3462, a stopper 3465 disposed on at least one of the housing base 3462, the left side wall 3463, or the right side wall 3464 to limit a forward movement of the fan housing assembly 3400, a base guide 3467 disposed on the housing base 3462, interfering with the fan housing assembly 3400 (e.g., in one embodiment, the front fan housing), to guide the forward and rearward direction of the fan housing 3400, and a cable penetration portion 3461 disposed on at least one of the left side wall 3463 or the right side wall 3464, extending long in a forward and rearward direction, having a long shape, and through which a cable (not shown) coupled to the actuator 3470 passes.

In one embodiment, the lower guide housing 3460 includes a housing rear wall 3466 connecting the housing base 3462, the left side wall 3463, and the right side wall 3464 and disposed at a rear side of the housing base 3462, the left side wall 3463, and the right side wall 3464. The housing rear wall 3466 functions as a stopper to limit the rearward movement of the fan housing assembly 3400.

The housing rear wall 3466 faces the rear wall 3522 of the upper guide housing 3520 and is disposed in front of the rear wall 3522.

An upper end 3466*a* of the housing rear wall 3466 has the same line as the guide housing suction inlet 3521. For example, the upper end 3466*a* of the housing rear wall 3466 has the same radius of curvature as the radius of curvature of the guide housing suction inlet 3521. The upper end 3466*a* of the housing rear wall 3466 may not cover the guide housing suction inlet 3521 in the forward and rearward direction.

The housing rear wall 3466 connects the housing base 3462, the left side wall 3463, and the right side wall 3464 to improve rigidity of the lower guide housing 3460 and prevent excessive rearward movement of the fan housing assembly 3400.

The stopper 3465 is disposed in front of the housing rear wall 3466. In one embodiment, the stoppers 3465 are disposed on the left side and the right side of the housing base 3562. One of the stoppers 3465 connects the housing base 3462 and the left side wall 3463 and the other one thereof connects the housing base 3462 and the right side wall 3464.

When the fan housing assembly 3400 is excessively moved forward, the fan housing assembly 3400 is supported by the stopper 3465 and the movement of the fan housing assembly 3400 is stopped.

The cable penetration portion 3461 communicates the outer space of the guide housing with the inner storage space (S1) of the guide housing.

The cable penetration portions 3461 are disposed on the left side wall 3463 and the right side wall 3464. The cable penetration portions 3461 penetrate the left side wall 3463 and the right side wall 3464 in the horizontal direction. The cable penetration portion 3461 extends long in the forward and rearward direction. The cable penetration portion 3461 provides a space where the cable may be moved in the forward and rearward direction along with the fan housing assembly 3400. In one embodiment, the cable penetration portion 3461 has a length corresponding to the forward and rearward moving distance of the fan housing assembly 3400.

When the cable penetration portion 3461 has a short length that does not correspond to the moving distance of the fan housing assembly 3400, the connection with the actuator 3470 may be separated.

The cable penetration portion 3461 extends long in the forward and rearward direction and communicates an inner side of the lower guide housing 3460 and an outer side of the lower guide housing 3460. The cable penetration portion 3461 provides a space where a wire connected to the guide motor may also be moved in the forward and rearward direction when the fan housing assembly is moved. The wire may be moved along the cable penetration portion 3461 to provide reliability of connection with the guide motor 3472.

The lower guide housing 3460 includes a fastener 3468 to couple with the fan casing 320 of the short-distance fan assembly. The fastener 3468 is disposed on the housing base 3462.

The base guide 3467 is disposed in a forward and rearward direction that is a moving direction of the fan housing assembly 3400. Two base guides 3467 are disposed, a first one thereof is disposed near the left side wall 3463 and a second one thereof is disposed near the right side wall 3464.

The base guide 3467 protrudes upward from an upper surface of the housing base 3462. The base guide 3467 is inserted into a groove defined in the lower surface of the front fan housing 3430. The base guide 3467 limits the horizontal movement of the fan housing assembly 3400.

<Configuration of Rear Fan Housing>

The rear fan housing 3410 forms a rear surface of a fan housing assembly. The rear fan housing 3410 may be disposed in front of a heat exchange assembly 500.

In one embodiment, the rear fan housing 3410 is disposed at a front side of an upper guide housing 3520, and more specifically, at a front side of a rear wall 3522. The rear fan housing 3410 may be disposed inside the upper guide housing 3520.

The rear fan housing 3410 includes a rear fan housing body 3412 to cover a rear surface of the front fan housing 3430, a fan suction inlet 3411 disposed in the rear fan housing body 3412 and penetrating in a forward and rearward direction, and a fastener 3414 disposed in the rear fan housing body 3412 and coupled to the front fan housing 3430.

A plurality of fasteners 3414 are disposed to be assembled with the front fan housing 3430. The fastener 3414 protrudes radially outward from the rear fan housing body 3412.

The rear fan housing 3410 has a donut shape and defines a fan suction inlet 3411 when viewed from the front. In particular, the rear fan housing body 3412 has a donut shape when viewed from the front.

The rear fan housing 3410 surrounds the fan 3420 together with the front fan housing 3430. The fan 3420 is disposed between the rear fan housing 3410 and the front fan housing 3430.

The rear fan housing 3410 covers the rear surface of the front fan housing 3430 and is assembled to a rear end of the front fan housing 3430.

The rear fan housing 3410 may be vertically disposed with respect to the floor. The rear fan housing 3410 faces the front surface of the heat exchange assembly 500.

The fan suction inlet 3411 is parallel to the guide housing suction inlet 3521 and faces each other. A diameter of the fan suction inlet 3411 is less than a diameter of the guide housing suction inlet 3521. The air guide 3510 connects the fan suction inlet 3411 to the guide housing suction inlet 3521. The fan suction inlet 3411 faces the front surface of the heat exchange assembly 500.

The rear fan housing body 3412 may be concave from the front side to the rear side thereof.

The air guide 3510 is disposed at the rear side of the rear fan housing 3410 and may be coupled to the rear surface of the rear fan housing 3410. In particular, the air guide 3510 may be assembled to the rear fan housing body 3412 and surrounds the fan suction inlet 3411.

<Configuration of Front Fan Housing>

The front fan housing 3430 has a cylindrical shape, is opened in a forward and rearward direction, and provides a flow path structure to guide air flowed by the fan 3420 to a steering grill 3450. In addition, in one embodiment, the fan motor 3440 is assembled to the front fan housing 3430 and the front fan housing 3430 provides an installation structure for installing the fan motor 3440.

The fan motor 3440 may be disposed at a front side of the front fan housing 3430, the fan 3420 is disposed at a rear side thereof, and a lower guide housing 3460 is disposed at a lower side thereof.

The front fan housing 3430 may be assembled to the lower guide housing 3460 and is movable in the forward and rearward direction with respect to the lower guide housing 3460.

The front fan housing 3430 includes an outer fan housing 3432 opened in a forward and rearward direction and having a cylindrical shape, an inner fan housing 3434 defining an opening opened to a front, disposed in the outer fan housing 3432 and to accommodate the fan motor 3440, a vane 3436 connecting the outer fan housing 3432 to the inner fan housing 3434, and a motor installation portion 3448 disposed in the inner fan housing 3434 and assembled with the fan motor 3440.

The outer fan housing 3432 has a cylindrical shape and defines openings at a front surface and a rear surface thereof and the inner fan housing 3434 is disposed therein. The outer fan housing 3432 may receive a driving force from the actuator 3470 and may be moved in the forward and rearward direction.

An open front surface of the outer fan housing 3432 is referred to as "a first fan opening surface 3431". In one embodiment, the first fan opening surface 3431 has a circular shape when viewed from the front. The rear end of the steering grill 3450 may be inserted into the first fan opening surface 3431.

An inner space of the outer fan housing 3432 opened in the forward and rearward direction is referred to as "a space (S2)". The first fan opening surface 3431 forms a front surface of the space (S2).

The inner fan housing 3434 defines an opening at a front side thereof and has a bowl shape and concave from a front side to a rear side thereof. A concave inner space of the inner fan housing 3434 is referred to as "a space (S3)". The fan motor 3440 may be disposed in the space (S3) and may be coupled to the inner fan housing 3434.

The open front surface of the inner fan housing 3434 is referred to as "a second fan opening surface 3433". The second fan opening surface 3433 may have various shapes. In one embodiment, the second fan opening surface 3433 has a circular shape in consideration of air flow.

The second fan opening surface 3433 forms a front surface of the space (S3). The first fan opening surface 3431 is disposed in front of the second fan opening surface 3433. The second fan opening surface 3433 is disposed inside the first fan opening surface 3431.

The first fan opening surface 3431 and the second fan opening surface 3433 are spaced apart from each other in the forward and rearward direction to provide a space to tilt the steering grill 3450. The rear end of the steering grill 3450 may be disposed between the first fan opening surface 3431 and the second fan opening surface 3433.

A motor installation portion 3438 may be disposed in the inner fan housing 3434 to couple the fan motor 3440.

The motor installation portion 3438 may be disposed in the space (S3) and may protrude forward from the inner fan housing 3434. The fan motor 3440 further includes a motor mount 3442 and the motor mount 3442 may be coupled to the motor installation portion 3438.

The motor installation portion 3438 may be disposed in the inner fan housing 3434. The motor installation portions 3438 are disposed at equal distances with respect to a central axis (C1).

A motor shaft of the fan motor 3440 passes through the inner fan housing 3434 and is disposed toward the rear, and is coupled to a fan 3420 disposed at the rear side of the inner fan housing 3434. The inner fan housing 3434 defines a shaft hole 3437 through which the motor shaft of the fan motor 3440 passes.

As the fan motor 3440 is disposed at the front side of the inner fan housing 3434 and is inserted into the space (S3), interference with the discharged air may be minimized.

In particular, a steering base 1070 described below is coupled to the inner fan housing 3434 and closes the space (S3). The fan motor 3440 is disposed outside a flow path of the discharged air to minimize resistance to the discharged air. In particular, the fan motor 3440 is disposed at the front side of the inner fan housing 3434 to block resistance to air suctioned from the rear portion thereof.

The inner fan housing 3434 defines a fastening boss 3439 to fix the steering base 1070 and support the steering base 1070. The fastening bosses 3439 are disposed in three places and are spaced apart from one another with the same distance with respect to the central axis (C1).

The fastening boss 3439 and the motor installation portion 3438 are disposed inside the space (S3). When the steering base 1070 is assembled to the fastening boss 3439, the motor installation portion 3438 is concealed by the steering base 1070.

The inner fan housing 3434 is spaced apart from the outer fan housing 3432 by a predetermined distance and the vane 3436 integrates the outer fan housing 3432 with the inner fan housing 3434.

The outer fan housing 3432, the inner fan housing 3434, and the vane 3436 provide straight movement to the air discharged by the fan 3420.

Meanwhile, a first guide roller 3553 and a second guide roller 3554 are disposed outside the front fan housing 3430.

The first guide roller 3553 and the second guide roller 3554 are moved in the forward and rearward direction of the first guide groove 3551 and the second guide groove 3552 disposed in the upper guide housing 3520.

The first guide roller 3553 is inserted into the first guide groove 3551, moved along the first guide groove 3551 in the forward and rearward direction, and is supported by the first guide groove 3551.

The second guide roller 3554 is inserted into the second guide groove 3552, is moved along the second guide groove 3552 in the forward and rearward direction, and is supported by the second guide groove 3552.

The first guide roller 3553 includes a roller shaft coupled to the front fan housing 3430 and a roller rotatably coupled to the roller shaft. The roller shaft is horizontally disposed.

The second guide roller 3554 includes a roller shaft coupled to the front fan housing 3430 and a roller rotatably coupled to the roller shaft. The roller shaft is horizontally disposed.

The roller shaft of the first guide roller 3553 and the roller shaft of the second guide roller 3554 may be disposed in a line.

The first guide roller 3553 is disposed on the left side of the front fan housing 3430 and the second guide roller 3554 is disposed on the right side of the front fan housing 3430.

The fan housing assembly 3400 is supported by the first guide roller 3553 and the second guide roller 3554 and a lower end of the fan housing assembly 3400 is spaced apart from a housing base 3462 of the lower guide housing 3460.

When the first guide roller 3553 and the second guide roller 3554 are not provided, load of the fan housing assembly 3400 is applied to an actuator 3470, and the actuator 3470 may move the fan housing assembly 3400 forward or rearward when the actuator 3470 supports the load of the fan housing assembly 3400.

The lower end of the fan housing assembly 3400 is spaced apart by the support of the first guide roller 3553 and the second guide roller 3554 to reduce operating load of the actuator 3470.

<Fan Configuration>

The fan 3420 may be disposed between a rear fan housing 3410 and a front fan housing 3430. The fan 3420 may be disposed inside the assembled rear fan housing 3410 and front fan housing 3430 and is rotated therein.

The fan 3420 discharges air suctioned through a fan suction inlet 3411 in a diagonal direction. The fan 3420 suctions the air through the fan suction inlet 3411 disposed at a rear side thereof and discharges the air in a circumferential direction. The discharge direction of the air discharged by the fan housing assembly is a diagonal direction. In one embodiment, the diagonal direction refers to a direction between a forward direction and the circumferential direction.

<Configuration of Air Guide and Air Guide Bracket>

The air guide 3510 couples a fan housing assembly 34000 to a guide housing (e.g., in one embodiment, an upper guide housing) and connects the guide housing suction inlet 3521 to a fan suction inlet 3411.

The air guide 3510 defines an opening opened in a forward and rearward direction and introduces air. Specifically, the air guide 3510 connects the rear fan housing 3410 to an upper guide housing 3520 and guides the air suctioned by the guide housing suction inlet 3521 to the fan suction inlet 3411.

The air guide 3510 may be made of elastic material and may be expanded or contracted when the front fan housing 3430 moves in the forward and rearward direction.

As the air guide 3510 may be made of the elastic material, an additional component is needed to couple to the guide housing and the fan housing assembly 3400.

The long-distance fan assembly 400 further includes a first air guide bracket 3530 to couple the air guide 3510 to the guide housing (e.g., in one embodiment, an upper guide housing) and a second air guide bracket 3540 to couple the air guide 3510 to the fan housing assembly 3400 (e.g., in one embodiment, a rear fan housing).

The air guide 3510 may be made of elastic material and may have a cylindrical shape.

The air guide 3510 defines an air guide outlet 3511 at a front side thereof (e.g., in one embodiment, toward the fan housing assembly) and defines an air guide inlet 3513 at a rear side thereof (e.g., in one embodiment, toward the guide housing).

The air guide outlet 3511 may have a diameter of G1 and the air guide inlet 3513 may have a diameter of G2. G1 and G2 may be the same, but in at least one embodiment, G2 is greater than G1.

A size of the G1 corresponds to a size of the fan suction inlet 3411 and a size of the G2 corresponds to a size of the guide housing suction inlet 3521.

In one embodiment, G1 is preferably greater than the diameter of the fan suction inlet 3411 and the fan suction inlet 3411 is disposed inside the air guide outlet 3511.

Similarly, G2 is preferably greater than a diameter (G4) of the guide housing suction inlet 3521.

The first air guide bracket 3530 couples the rear end 3514 of the air guide 3510 to the guide housing (e.g., in one embodiment, the upper guide housing). The second air guide bracket 3540 couples the front end 3512 of the air guide 3510 to the fan housing assembly 3400.

The first air guide bracket 3530 includes a bracket body 3532 having a ring shape and a bracket fastener 3534 disposed on the bracket body 3532 and protruding outward from the bracket body 3532.

The bracket body 3532 has a circular shape and a diameter of the bracket body 3532 is referred to as "G3". The diameter (G3) of the bracket body 3532 is less than the diameter (G2) of the air guide inlet 3513 and is greater than the diameter (G4) of the guide housing suction inlet 3521.

The rear end 3513 of the air guide passes through the guide housing suction inlet 3521 and may be disposed on the rear surface of the rear wall 3522 and the bracket body 3532 may contact the rear end 3513 of the air guide to the rear wall 3522.

In one embodiment, a bracket insert 3528 may be disposed on the rear wall 3522 of the upper guide housing 3520.

As the bracket insert 3528 is additionally disposed, the guide housing suction inlet 3521 is referred to as a space inward an inner edge of the bracket insert 3528.

The bracket insert 3528 includes a first insertion wall **3528*a* protruding forward from the rear wall 3522 and a second insertion wall 3528*b* protruding from the first insertion wall 3528*a* toward the central axis (C1) of the fan housing assembly 3400**.

The bracket insert 3528 has a forward-concave end due to the structures of the first insertion wall **3528*a* and the second insertion wall 3528*b***.

The bracket body 3532 includes a first bracket body 3535 to face the second insertion wall **3528*b* and a second bracket body 3536 protruding forward from the inner edge of the first bracket body 3535. The first bracket body 3535 and the second bracket body 3536** have a bent shape.

An air guide rear end 3513 may be disposed between the first bracket body 3535 and the second insertion wall **3528*b* and the first bracket body 3535 contacts the rear end 3513 with the second insert wall 3528*b***.

The second bracket body 3536 may be disposed inside the inner edge of the first insertion wall **3528*a*. An air guide 3510 may be disposed between the second bracket body 3536 and the first insertion wall 3528*a***.

A fastening member (e.g., in one embodiment, a screw) is fastened to the rear wall 3522 through the bracket fastener 3534.

A first bracket installation portion **3522*a*, in which the bracket fastener 3534 is disposed, may be disposed on a rear surface of the rear wall 3522. The first bracket installation portion 3522*a* may have a concave shape, and the bracket fastener 3534 is partially inserted, and an operator may align an assembly position of the bracket fastener 3534 using the first bracket installation portion 3522*a***.

A plurality of bracket fasteners 3534 may be disposed, and in one embodiment, four bracket fasteners are disposed. The bracket fastener 3534 protrudes radially outward with respect to the central axis (C1) of the fan housing assembly 3400 and may be disposed at equal distance with respect to the central axis (C1).

The first air guide bracket 3530 is coupled to the rear surface of the rear wall 3522 to prevent the rear end 3513 of the air guide 3510 from being separated when the fan housing assembly 3400 is moved in the forward and rearward direction.

In addition, there is an advantage that, as the first air guide bracket 3530 is assembled to the rear surface of the rear wall 3522, the air guide 3510 may be easily replaced.

In addition, as the first air guide bracket 3530 pressurizes the entire rear end 3513 of the air guide 3510 to contact with the rear wall 3522, the entire rear end 3513 of the air guide 3510 is uniformly supported and may be prevented from tearing at a specific position. In particular, the fastening member to fix the first air guide bracket 3530 may not penetrate the air guide 3510 to prevent damage to the air guide 3510.

In one embodiment, the second air guide bracket 3540 uses a snap ring.

The second bracket installation portion 3415 may be disposed on the rear surface of the rear fan housing 3410 to dispose the second air guide bracket 3540 using the snap ring.

The second bracket installation portion 3415 has a ring shape when viewed from the rear and is disposed outside than the fan suction inlet 3411. The second bracket installation portion 3415 may be a rib extending rearward and outward from the rear surface of the rear fan housing 3410 and defines, at an outer side thereof, a groove 3416 into which the second air guide bracket 3540 is inserted. The groove 3416 opens radially outward with respect to the central axis (C1) of the fan housing assembly 3400 and may be concave toward the central axis (C1).

In addition, a guide wall 3417 may be disposed on a rear surface of the rear fan housing 3410 to receive the air guide 3510 in a right position. The guide wall 3417 faces the second insertion wall 3528*b* and is disposed in front of the second insertion wall 3528*b*.

When viewed from the rear of the rear fan housing 3410, the guide wall 3417 has a donut shape.

<Actuator Configuration>

The actuator 3470 provides a driving force to move the fan housing assembly 3400 in a forward and rearward direction. The actuator 3470 may move the fan housing assembly 3400 in the forward and rearward direction based on a control signal of a controller.

When an indoor unit is operated, the actuator 3470 moves the fan housing assembly 3400 forward, and when the indoor unit is stopped, the actuator 3470 moves the fan housing assembly 3400 rearward.

The actuator 3470 may move the fan housing assembly 3400 in the forward and rearward direction. For example, the actuator 3470 may include a hydraulic cylinder or a linear motor to move the fan housing assembly 3400 in the forward and rearward direction.

In one embodiment, the actuator 3470 transmits a motor driving force to the fan housing assembly 3400 to move the fan housing assembly 3400 forward or rearward.

In one embodiment, as the first guide roller 3553 and the second guide roller 3554 disposed in the fan housing assembly 3400 each support the load of the fan housing assembly 3400, the actuator 3470 may minimize the operating load occurring based on the forward movement or the rearward movement of the assembly 3400.

In one embodiment, the central axis (C1) of the fan housing assembly and a center of the front discharge outlet 201 may be identical to each other. The actuator 3470 moves the fan housing assembly 3400 forward or rearward along the central axis (C1).

The guide housing (e.g., in one embodiment, the upper guide housing or the lower guide housing) guides the forward and rearward movement of the fan housing assembly 3400.

The actuator 3470 includes a guide motor 3472 disposed on the fan housing assembly 3400 to provide a driving force to move the fan housing assembly 3400 in the forward and rearward direction, a guide shaft 3474 disposed in the fan housing assembly 3400 to receive a rotational force of the guide motor 3472 and rotate, a first guide gear 3476 coupled at a left side of the guide shaft 3474 and rotating with the guide shaft 3474, a second guide gear 3477 coupled to a right side of the guide shaft 3474 and rotating together with the guide shaft 3474, a first rack 3478 disposed in the lower guide housing 3460 and engaged with the first guide gear 3476, and a second rack 3479 disposed in the lower guide housing 3460 and engaged with the second guide gear 3477.

In one embodiment, the guide motor 3472, the first guide gear 3476, the second guide gear 3477, and the guide shaft 3474 are each disposed in the front fan housing 3430 and are moved together when the fan housing assembly 3400 moves forward or rearward.

The first rack 3478 engaged with the first guide gear 3476 and the second rack 3479 engaged with the second guide gear 3477 are each disposed in the lower guide housing 3460.

In another embodiment, the guide motor 3472, the first guide gear 3476, the second guide gear 3477, and the guide shaft 3474 are each disposed on the lower guide housing 3460 and the first rack 3478 and a second rack 3479 may be disposed under the front fan housing 3430.

The fan housing assembly 3400 moves forward or rearward by the engagement of the racks 3478 and 3479 with the guide gears 3476 and 3477.

In one embodiment, one guide motor 3472 is used and a guide shaft 3474 is disposed to uniformly move the front fan housing 3430. The first guide gear 3476 and the second guide gear 3477 are disposed at both ends of the guide shaft 3474. The guide shaft 3474 is horizontally disposed.

In one embodiment, the first guide gear 3476 is disposed on the left side of the guide shaft 3474 and the second guide gear 3477 is disposed on the right side of the guide shaft 3474.

Racks 3478 and 3479 engaged with the guide gears 3476 and 3477 are disposed on the left side and the right side of the lower guide housing 3460, respectively.

In one embodiment, the first guide gear 3476 and the second guide gear 3477 are disposed on the first rack 3478 and the second rack 3479, respectively. The first guide gear 3476 and the second guide gear 3477 move in the forward and rearward direction along the first rack 3478 and the second rack 3479, respectively.

The first rack 3478 and the second rack 3479 are each disposed on the upper surface of the housing base 3462 of the lower guide housing 3460 and each protrude upward from the housing base 3462.

The first rack 3478 and the second rack 3479 are disposed under the guide gears 3476 and 3477, respectively, and interfere with the guide gears 3476 and 3477 through the engagement, respectively.

The first guide gear 3476 may be moved in the forward and rearward direction along the first rack 3478 and the second guide gear 3477 may also be moved in the forward and rearward direction along the second rack 3479.

The guide motor 3472 may be disposed at the lower left or lower right of the front fan housing 3430. The motor shaft of the guide motor 3472 may be directly coupled to each of the first guide gear 3476 or the second guide gear 3477.

When the guide motor 3472 is rotated, the first guide gear 3476 and the second guide gear 3477 are simultaneously rotated based on the rotational force of the guide motor 3472 and the left side and the right side of the fan housing assembly 3400 may be moved forward or rearward based on the same force.

The guide motor 3472 may be moved together with the fan housing assembly 3400 and the lower guide housing 3460 defines a motor guide groove 3469 to move the guide motor 3472. The motor guide groove 3469 may be disposed in the forward and rearward direction, which is a moving direction of the guide motor 3472.

The housing base 3462 of the lower guide housing 3460 defines the motor guide groove 3469 and the motor guide groove 3469 may be concave downward from the housing base 3462.

The motor guide groove 3469 may be disposed outside the first rack 3478 or the second rack 3479. The motor guide groove 3469 may be concave downward from the first rack 3478 or the second rack 3479.

The installation and movement space of the guide motor 3472 may be provided due to the motor guide groove 3469 and an overall height of the long-distance fan assembly 400 may be minimized. In particular, the motor guide groove 3469 is concave downward to directly couple the guide motor 3472 to the first guide gear 3476 or the second guide gear 3477 and to minimize a number of power transmission components.

A first guide rail 3480 and the second guide rail 3490 are further disposed between the fan housing assembly 3400 (e.g., in one embodiment, the front fan housing 3430 and the lower guide housing 3460) to easily slide the fan housing assembly 3400.

The first guide rail 3480 couples the left side of the lower guide housing 3460 to the left side of the fan housing assembly. The first guide rail 3480 supports the load of the fan housing assembly and guides the moving direction of the fan housing assembly.

In one embodiment, the first guide rail 3480 is coupled to each of the left side wall 3463 of the lower guide housing 3460 and the front fan housing 3430 to generate the sliding.

The second guide rail 3490 connects the right side of the lower guide housing 3460 to the right side of the fan housing assembly. The second guide rail 3490 supports the load of the fan housing assembly and guides the moving direction of the fan housing assembly. In one embodiment, the second guide rail 3490 is coupled to each of the right side wall 3464 of the lower guide housing 3460 and the front fan housing 3430 to generate the sliding.

The first guide rail 3480 and the second guide rail 3490 may be bilaterally symmetrical to each other with respect to the central axis (C1) of the fan housing assembly.

The first guide rail 3480 and the second guide rail 3490 support a portion of the load of the fan housing assembly to easily implement the forward and rearward movement of the fan housing assembly.

The first guide rail 3480 and the second guide rail 3490 are disposed above the first rack 3478 and the second rack 3479, respectively. The first guide rail 3480 and the second guide rail 3490 support the left side and the right side of the fan housing assembly 3400, respectively, and guide the moving directions of the left side and the right side of the fan housing assembly 3400, respectively.

The first guide rail 3480 and the second guide rail 3490 may be bilaterally symmetrical to each other relative to the central axis (C1) to move the left side and the right side of the fan housing assembly at the same speed and distance.

When the moving speed and distance of the left side or right side of the fan housing assembly are non-uniform, the long-distance assembly 400 may be moved from one side to the other side. In addition, when the moving speed and moving distance of the left side or the right side of the fan housing assembly are each non-uniform, the steering grill 3450 may not be accurately inserted into the front discharge outlet 201.

The first guide rail 3480 and the second guide rail 3490 minimize friction when the front fan housing 3430 is moved through rolling friction.

As the first guide rail 3480 and the second guide rail 3490 have the same configuration and may be bilaterally symmetrical to each other, an example configuration of the first guide rail 3480 is described.

The guide rail 3480 includes a long rail housing 3482 extending long in a forward and rearward direction and disposed in the guide housing (e.g., in one embodiment, the lower guide housing), a short rail housing 3484 extending in a forward and rearward direction and having a shorter length than that of the long rail housing 3482 and disposed in the fan housing assembly (e.g., in one embodiment, the front fan housing), and a bearing housing 3486 disposed between the long rail housing 3482 and the short rail housing 3484, assembled to be movable relative to each of the long rail housing 3482 and the short rail housing 3484, and to reduce friction with each of the long rail housing 3482 and the short rail housing 3484 through the rolling friction with the bearing 3485 when the short rail housing 3484 moves.

The bearing housing 3486 may be assembled to the long rail housing 3482 and may be moved along a longitudinal direction of the long rail housing 3482. The short rail housing 3484 may be assembled to the bearing housing 3486 and may be moved along the longitudinal direction of the bearing housing 3486.

For example, the short rail housing 3484 is assembled to be movable relative to the bearing housing 3486 and the bearing housing 3486 is assembled to be movable relative to the long rail housing 3482.

The bearing housing 3486 is shorter than the long rail housing 3482 and is longer than the short rail housing 3484. The bearing housing 3486 and the short rail housing 3484 may each slide only within the length of the long rail housing 3482.

The length of the long rail housing 3482 corresponds to a length (F2) in the forward and rearward direction of the lower guide housing 3460. In one embodiment, the left side wall 3463 and the right side wall 3464 includes the rail installation portions 3463*a* and 3464*a* on inner surfaces thereof, to which the long rail housing 3482 is coupled. In one embodiment, the rail installation portions 3463*a* and 3464*a* are each disposed above the cable penetration portion 3465.

Figure 20:
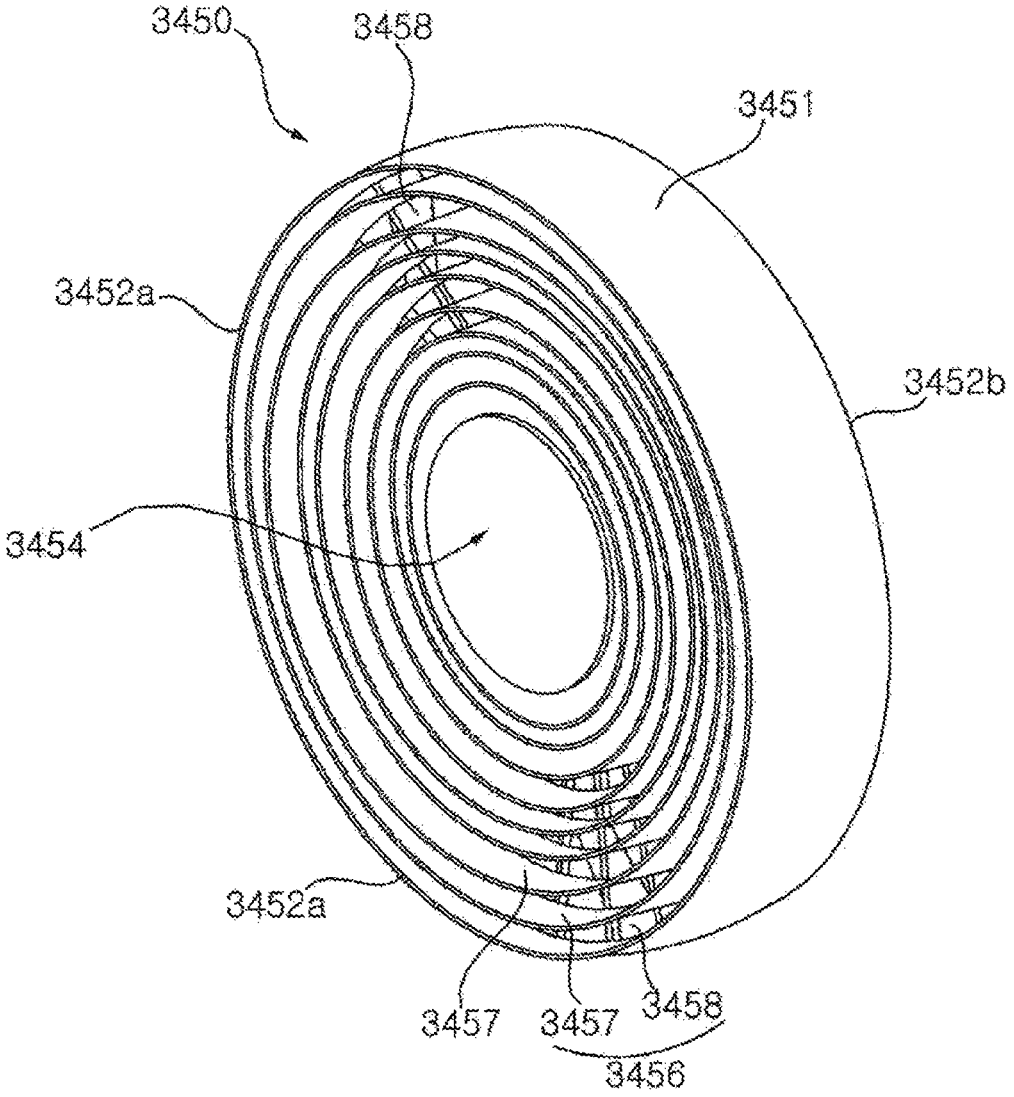
FIG. 20 is a perspective view showing a steering grill in FIG. 14.
Figure 21:
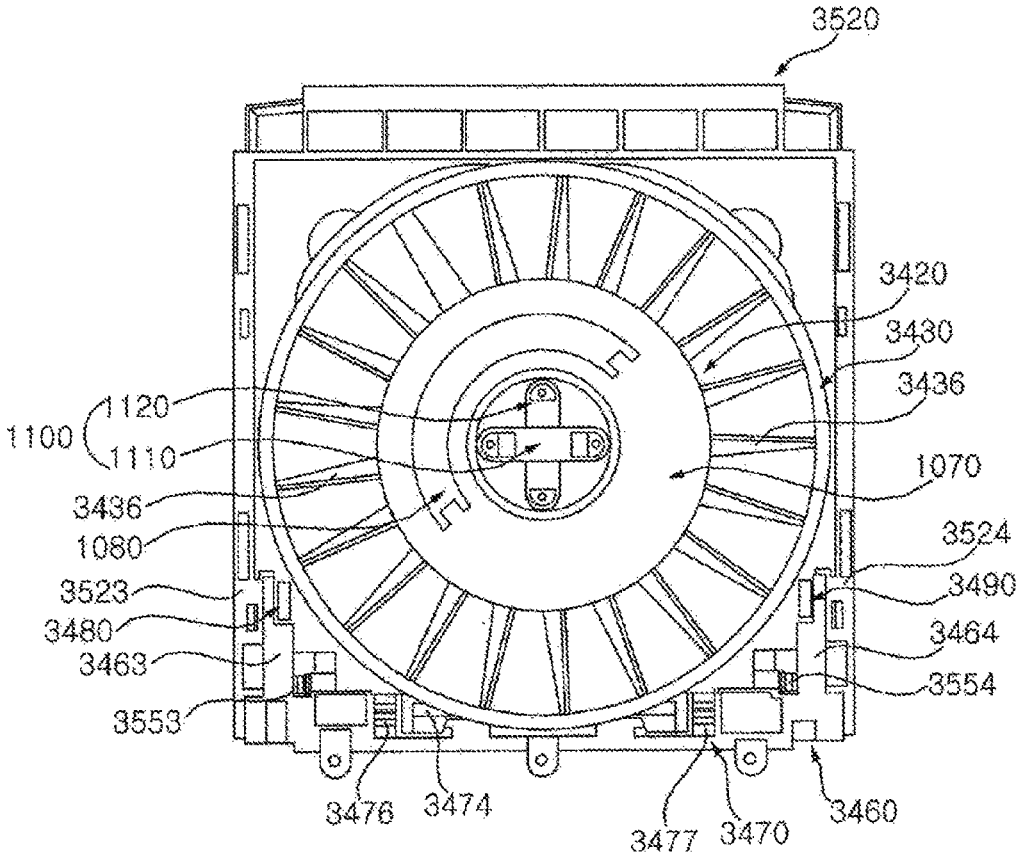
FIG. 21 is a front view showing a fan housing assembly in FIG. 10 from which a steering grill is separated.
Figure 22:
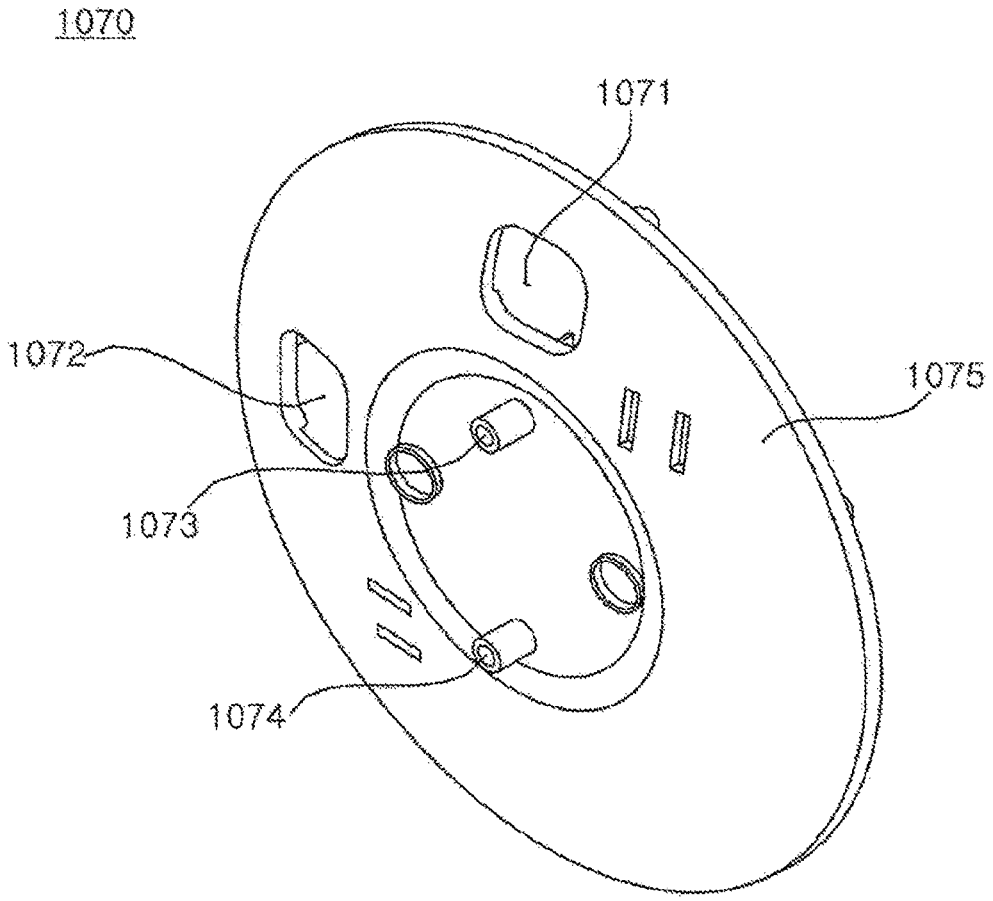
FIG. 22 is a perspective view showing a steering base in FIG. 14.
Figure 23:
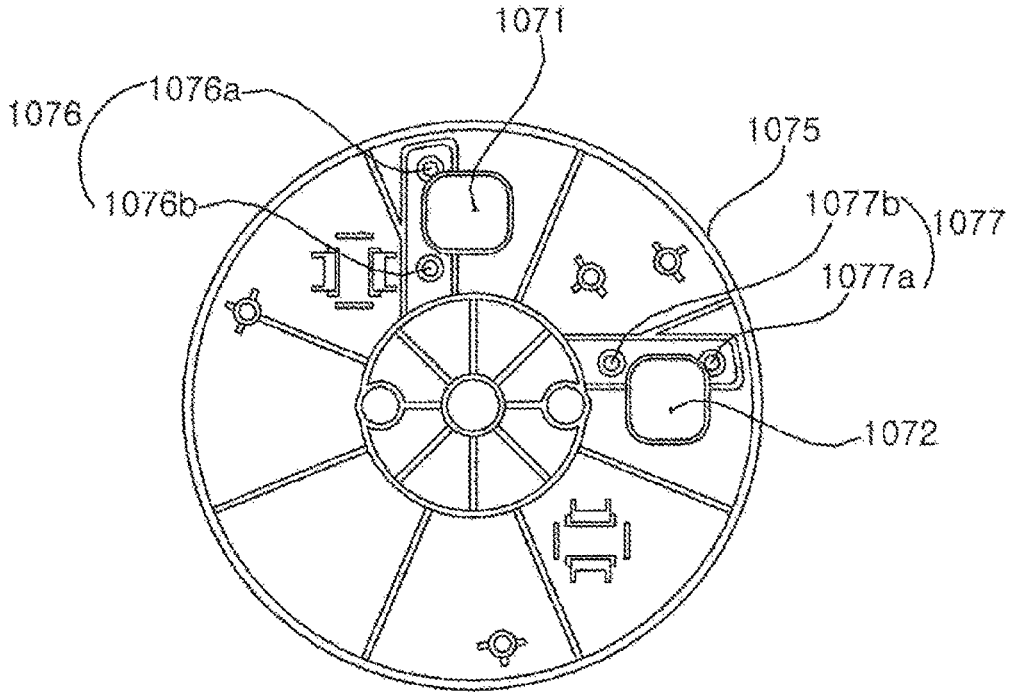
FIG. 23 is a rear view showing the steering base in FIG. 20.
Figure 24:
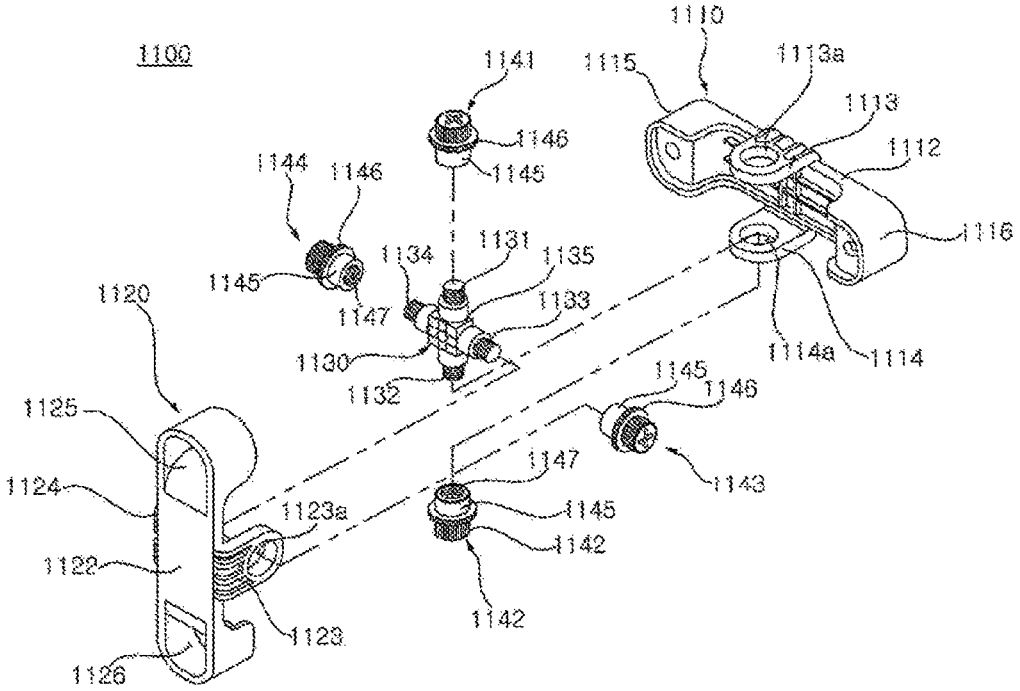
FIG. 24 is an exploded perspective view showing a joint assembly in FIG. 14.
Figure 25:
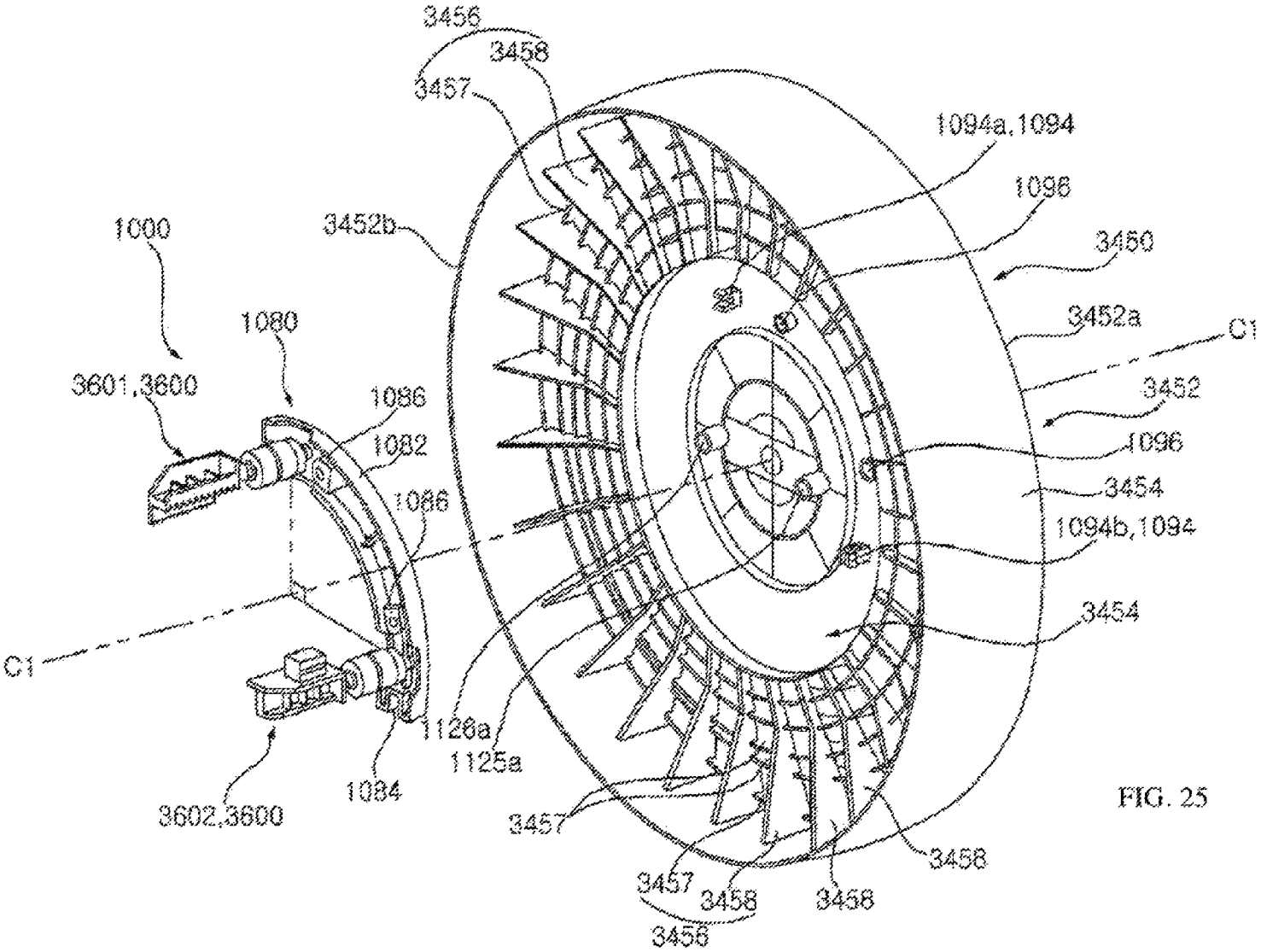
FIG. 25 is an exploded perspective view showing a rear side of a steering grill and a steering assembly in FIG. 14.
Figure 26:
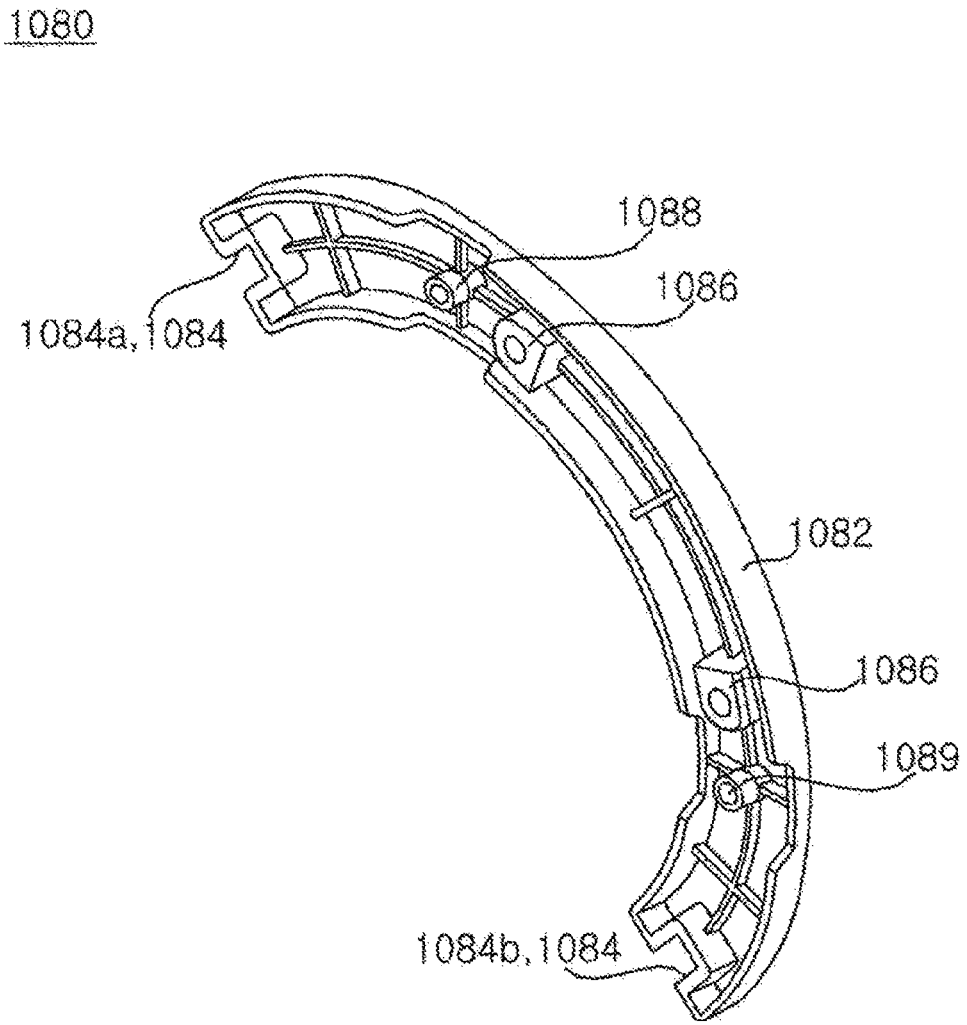
FIG. 26 is a rear perspective view showing a hub in FIG. 25.
Figure 27:
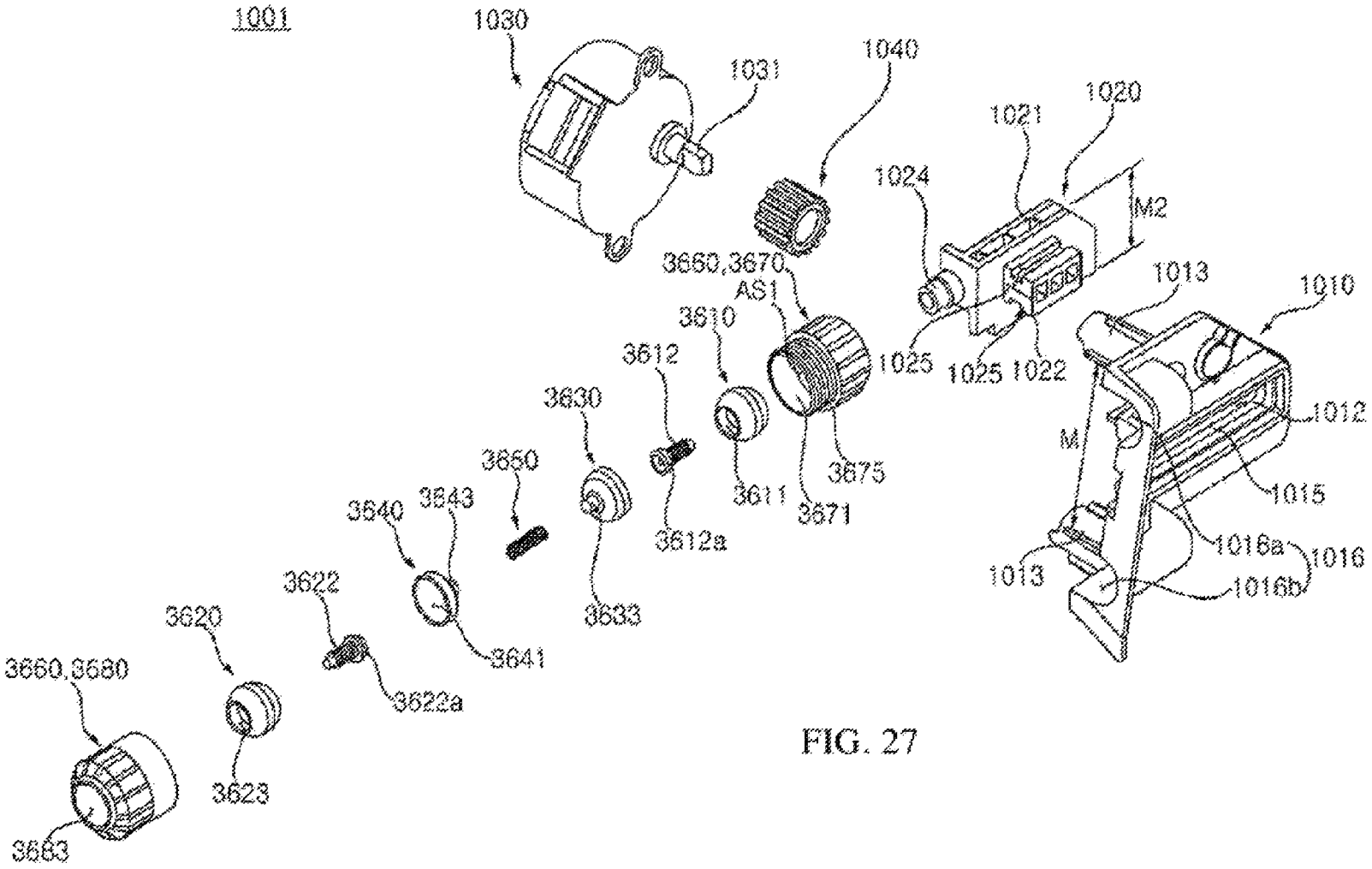
FIG. 27 is an exploded perspective view showing a steering assembly in FIG. 14.
Figure 28:
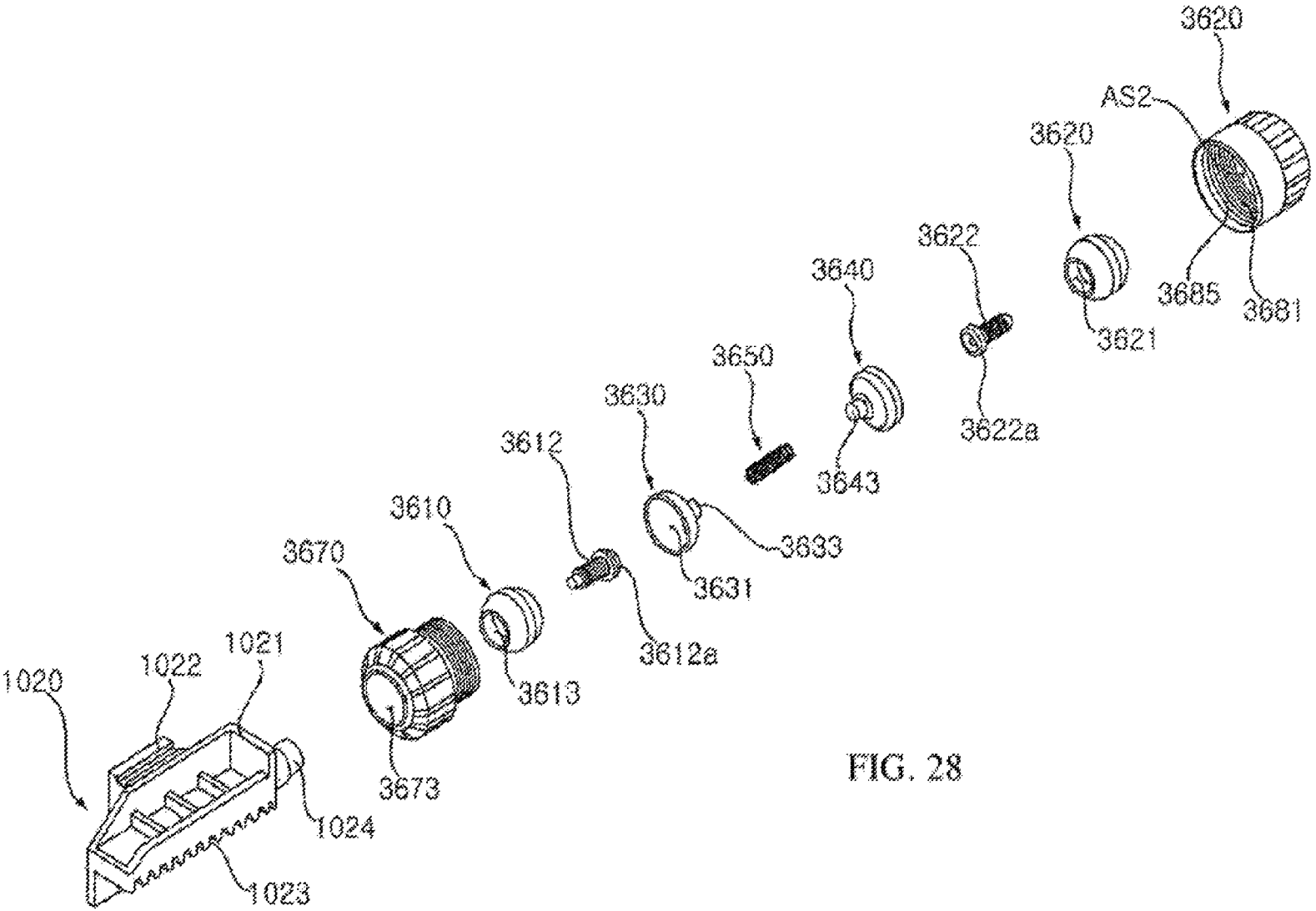
FIG. 28 is an exploded perspective view showing the steering assembly in FIG. 27 viewed from the rear.
Figure 29:
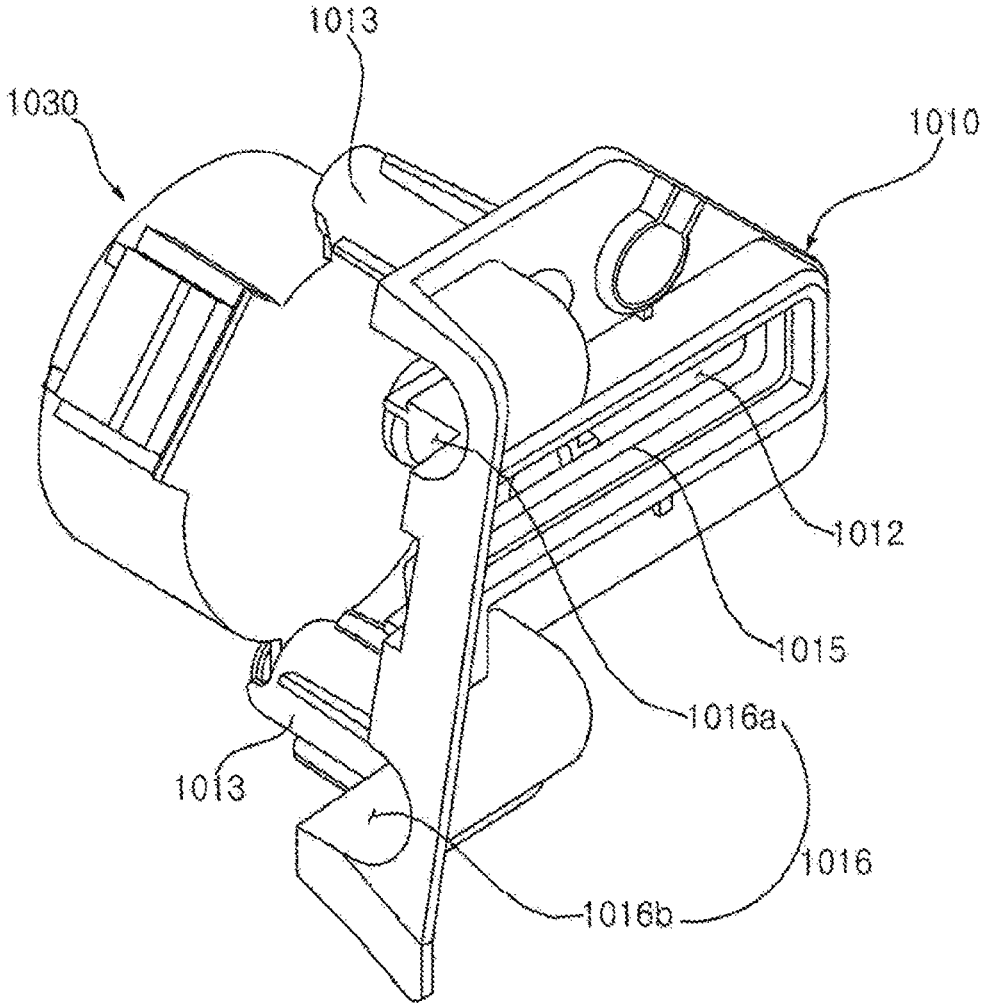
FIG. 29 is a perspective view showing an assembled steering body and steering motor in FIG. 27.
Figure 30:
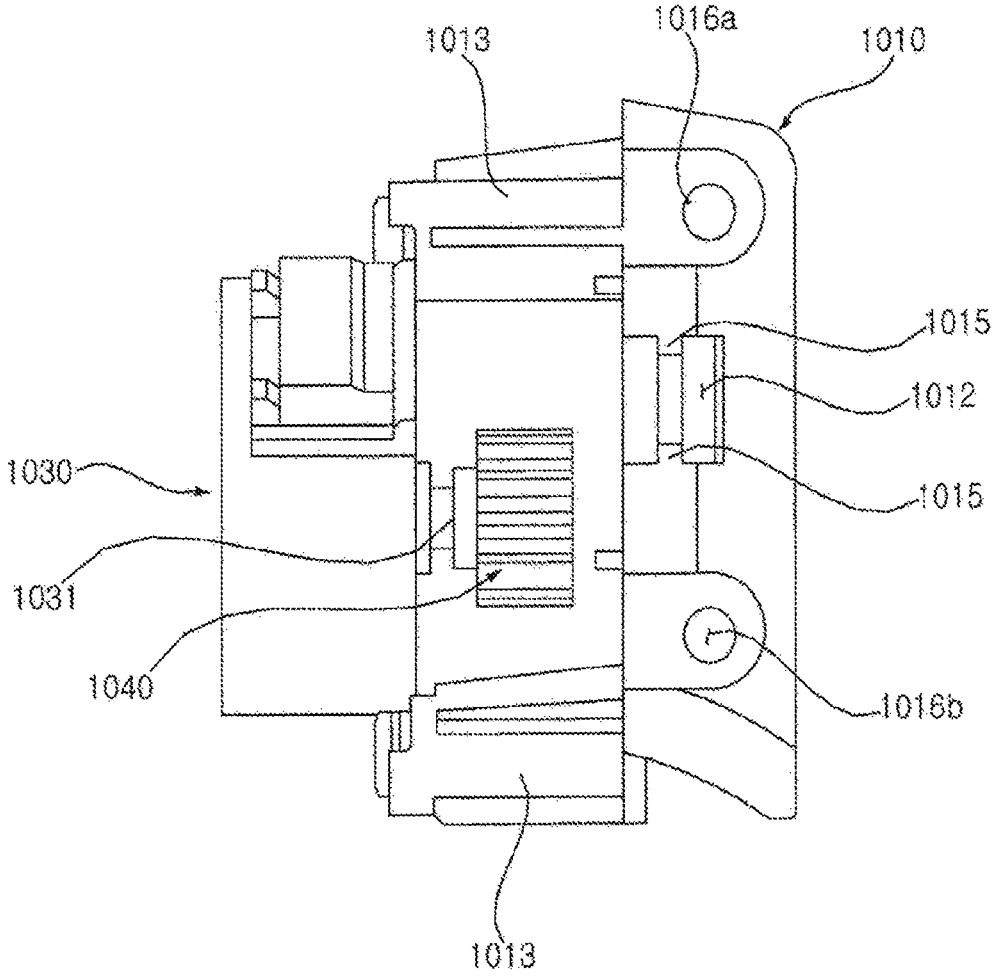
FIG. 30 is a front view showing the assembled steering body and steering motor in FIG. 29.

FIG. 20 is a perspective view showing a steering grill in FIG. 14. FIG. 21 is a front view showing a fan housing assembly in FIG. 10 from which a steering grill is separated. FIG. 22 is a perspective view showing a steering base in FIG. 14. FIG. 23 is a rear view showing the steering base in FIG. 20. FIG. 24 is an exploded perspective view showing a joint assembly in FIG. 14. FIG. 25 is an exploded perspective view showing a rear side of a steering grill and a steering assembly in FIG. 14. FIG. 26 is a rear perspective view showing a hub in FIG. 25. FIG. 27 is an exploded perspective view showing a steering assembly in FIG. 14. FIG. 28 is an exploded perspective view showing the steering assembly in FIG. 27 viewed from the rear. FIG. 29 is a perspective view showing an assembled steering body and steering motor in FIG. 27. FIG. 30 is a front view showing the assembled steering body and steering motor in FIG. 29.

<Configuration of Steering Grill>

The steering grill 3450 is disposed at a front side of the front fan housing 3430. A rear end of the steering grill 3450 may be partially inserted into the front fan housing 3430. The steering grill 3450 may be tilted in an upward direction, a downward direction, a leftward direction, a rightward direction, or a diagonal direction when the steering grill 3450 is inserted into the front fan housing 3430.

The rear end of the steering grill 3450 may be inserted into a space (S2) of the front fan housing 3430 through a first fan opening surface 3431 of the front fan housing 3430. The rear end of the steering grill 3450 may be disposed in front of the inner fan housing 3434.

The steering grill 3450 has a shape corresponding to the first fan opening surface 3431 of the front fan housing 3430. When viewed from the front, the first fan opening surface 3431 has a circular shape and the steering grill 3450 has a circular shape having a smaller diameter than that of the first fan opening surface 3431.

The steering grill 3450 includes a steering housing 3452 having openings at a front surface and a rear surface thereof and defining a space (S4), a steering cover 3454 disposed inside the steering housing 3452 and facing toward the front surface thereof, and a plurality of vanes 3456 disposed in the space (S4) of the steering housing 3452 and connecting the steering housing 3452 to the steering cover 3454.

The front shape of the steering housing 3452 corresponds to the shape of the first fan opening surface 3431 of the outer fan housing 3432. When viewed from the front, the steering housing 3452 has a circular shape.

An outer surface 3451 of the steering housing 3452 has a surface curved in the forward and rearward direction. When the steering grill 3450 is tilted, the outer surface 3451 of the steering housing 3452 having the curved surface may maintain a constant distance from the front fan housing 3430 (e.g., in one embodiment, the outer fan housing 3432).

The outer surface 3451 of the steering housing 3452 may correspond to a radius of rotation of the steering grill 3450. A center of curvature of the outer surface 3451 of the steering housing 3452 may be disposed on the central axis (C1). For example, the outer surface 3451 may have an arc shape with the central axis (C1).

The steering grill 3450 is tilted when the steering grill 3450 is inserted into the front fan housing 3430. A uniform distance (P) between the outer surface 3451 of the steering housing 3452 and the inner surface of the outer fan housing 3432 may be maintained during tilting due to the structure of the outer surface 3451 of the steering housing 3452 having the arc shape.

During tilting, as the distance (P) between the outer surface 3451 of the steering housing 3452 and the inner surface of the outer fan housing 3432 is minimized, an amount of discharged air leaking to an outside of the steering grill 3450 may be minimized.

When the air discharged through the distance (P) is cooled air, the edge of the front discharge outlet 201 may have dew formation. When the distance (P) is minimized, the dew condensation generated at the edge of the front discharge outlet 201 may be minimized.

In one embodiment, an axis center of the steering housing 3452 may be disposed on the axis center (C1) of the fan housing assembly 3400 and may be identical to that of the motor shaft of the fan motor 3440.

The steering cover 3454 may be disposed in the space (S4) and may be vertically disposed. The area and the shape of the steering cover 3454 correspond to the area and the shape of the steering base 1070.

The discharged air flows between the outside of the steering cover 3454 and the inside of the steering housing 3452. As the steering cover 3454 is disposed at the front side of the steering base 1070, air does not flow directly to the steering cover 3454.

The steering cover 3454 may be disposed between the front end 3452*a* and the rear end 3452*b* of the steering housing 3452 in the forward and rearward direction.

The steering cover 3454 may be connected to a steering assembly 1000 and may receive an operating force of the steering assembly 1000.

The vane 3456 includes a circular vane 3457 and a blade vane 3458.

A plurality of circular vanes 3457 are provided, and the circular vanes 3457 have different diameters, and centers of the circular vanes 3457 are disposed on the central axis (C1). For example, the circular vanes 3457 are concentric with each other with respect to the central axis (C1).

A plurality of blade vanes 3458 are provided and the plurality of blade vanes 3458 are radially disposed with respect to the central axis (C1). The circular vane 3457 crosses with the blade vane 3458.

An inner end of the blade vane 3458 is coupled to the steering cover 3454 and an outer end thereof is coupled to the steering housing 3452.

In one embodiment, the steering housing 3452, the steering cover 3454, the circular vane 3457, and the blade vane 3458 are integrated with one another through injection molding.

The steering grill 3450 may be tilted in an upward direction, a downward direction, a leftward direction, a rightward direction, or in any diagonal direction with respect to the axis center (C1). The steering grill 3450 may protrude further forward than the front discharge outlet 201.

When the fan housing assembly 3400 is moved forward, the front end 3452*a* of the steering housing 3452 is disposed in front of the front discharge outlet 201 and the rear end 3452*b* of the steering housing 3452 is disposed behind the front discharge outlet 201.

Even when the steering grill 3450 is tilted, the front end 3452*a* of the steering housing 3452 is disposed in front of the front discharge outlet 201 and the rear end 3452*b* of the steering housing 3452 is disposed behind the front discharge outlet 201.

<Configuration of Tilting Assembly>

The steering assembly 1000 may be disposed between the steering grill 3450 and a front fan housing 3430. The steering assembly 1000 may be disposed at a position where interference with discharged air is minimized.

The steering assembly 1000 may be disposed at a front side of the inner fan housing 3434 to minimize interference with the discharged air. In particular, the steering assembly 1000 is disposed at a front side of the fan motor 3440.

In one embodiment, a steering base 1070 is disposed to cover a space (S3) of the inner fan housing 3434 and the steering assembly 1000 is disposed on the steering base 1070. In another embodiment, the steering assembly 1000 may be disposed on a structure of the front fan housing 3430. For example, the steering assembly 1000 may be disposed on an inner fan housing 3434 or a motor mount 3442 to tilt the steering grill 3450.

The steering assembly 1000 provides a structure in which the steering grill 3450 has no restriction on a tilting direction or sequence. For example, the steering assembly 1000 provides a structure capable of horizontally tilting the steering grill 3450 or tilting in a diagonal direction after vertically tilting the steering grill 3450.

The steering assembly 1000 may immediately tilt the steering grill 3450 from a first direction to a second direction, and as there is no restriction in the tilting direction, the steering of the steering grill 3450 may be immediately implemented.

In one embodiment, the first direction is set to be a horizontal direction and the second direction is set to be a vertical direction. In another embodiment, the first direction and the second direction may each be arbitrarily changed. In one embodiment, the first direction and the second direction form an angle of 90 degrees.

The steering assembly 1000 includes a steering base 1070 disposed on the front fan housing 3430 and coupled to the rear side of the steering grill 3450, a joint assembly 1100 coupled to each of the steering base 1070 and the steering grill 3450, tiltably assembled to each of the steering base 1070 and the steering grill 3450, a first steering assembly 1001 disposed on the steering base 1070, assembled to be rotatable with the steering grill 3450, to push or pull the steering grill 3450 through the operation of a first steering actuator (e.g., a steering motor 1030 in one embodiment), and tilt the steering grill 3450 around the joint assembly 1100, and a steering assembly 1002 disposed on the steering base 1070, assembled to be rotatable relative to the steering grill 3450, to push or pull the steering grill 3450 through the operation of a second steering actuator (e.g., in one embodiment, the steering motor 1030), and tilt the steering grill 3450 around the joint assembly 1100.

The first steering assembly 1001 and the second steering assembly 1002 are each disposed at the rear side of the steering grill 3450.

The first steering assembly 1001 is assembled to the rear surface of the steering grill 3450 and moves the assembled portion of the steering grill 3450 in the forward and rearward direction. The second steering assembly 1002 is also assembled to the rear surface of the steering grill 3450 and moves the assembled portion of the steering grill 3450 in the forward and rearward direction.

In one embodiment, the first steering assembly 1001 and the second steering assembly 1002 are each disposed in the forward and rearward direction.

When viewed from the front or the rear, a portion at which the first steering assembly 1001 pushes or pulls the steering grill 3450 and a portion at which the second steering assembly 1002 pushes or pulls the steering grill 3450 forms an angle of 90 degrees with respect to the central axis (C1).

In one embodiment, the portion where the first steering assembly 1001 pushes or pulls the steering grill 3450 is vertically disposed above the central axis (C1). The portion where the second steering assembly 1002 pushes or pulls the steering grill 3450 may be disposed on the left side or right side of the central axis (C1).

The joint assembly 1100 provides a tilting center of the steering grill 3450. The tilting center of the joint assembly 1100 may be disposed on the central axis (C1) passing the center of the front discharge outlet 201 in the forward and rearward direction.

The joint assembly 1100 may be coupled to the rear surface of the steering grill 3450. The joint assembly 1100 provides a rotation center in which the steering grill 3450 may be tilted in any direction. The joint assembly 1100 provides the rotation center to face the steering grill 3450 upward, downward, leftward, rightward, leftward and upward, leftward and downward, rightward and upward, and rightward and downward viewed from the front.

A ball joint may be used as the joint assembly 1100. The ball joint may not provide a structure to support the load of the steering grill 3450, which generates deflection.

The joint assembly 1100 provides a structure to support the load of the steering grill 3450 when the steering grill 3450 is tilted.

In one embodiment, the joint assembly 1100 includes a first joint bracket 1110 assembled to the steering base 1070 to provide a rotational axis in a first direction (e.g., in one embodiment, a horizontal direction), a second joint bracket 1120 assembled to the steering grill 3450 to provide a rotational axis in a second direction (e.g., in one embodiment, a vertical direction), and a cross axle 1130 assembled to be rotatable relative to each of the first joint bracket 1110 and the second joint bracket 1120 to provide the rotational axis in the first direction and the second direction.

As the first joint bracket 1110 and the second joint bracket 1120 have the same configuration, the installation positions thereof may be reversed. When the installation positions are reversed, the first joint bracket 1110 provides the rotational axis in the second direction and the second joint bracket 1120 provides the rotational axis in the first direction.

The first joint bracket 1110 includes a first bracket body 1112 assembled to the steering base 1070, a 1-1 shaft supporter 1113 disposed on the first bracket body 1112 and protruding toward the second joint bracket 1120, and a 1-2 shaft supporter 1114 disposed on the first bracket body 1112, protruding toward the second joint bracket 1120, and facing the 1-1 shaft supporter 1123.

The first bracket body 1112 extends long, and in one embodiment, the first bracket body 1112 is horizontally disposed. The first bracket body 1112 defines fastening grooves 1115 and 1116 at a first side and a second side of the first bracket body 1112. The first bracket body 1112 defines the fastening grooves 1115 and 1116 that are each concave and face the steering base 1070.

In one embodiment, the 1-1 shaft supporter 1113 is disposed on the first bracket body 1112 and the 1-2 shaft supporter 1114 is disposed under first bracket body 1112. The 1-1 shaft supporter 1113 and the 1-2 shaft supporter 1114 are disposed vertically.

The second joint bracket 1120 includes a second bracket body 1122 assembled to the steering grill 3450, a 2-1 shaft supporter 1123 disposed on the second bracket body 1122 and protruding toward the first joint bracket 1110, and a 2-2 shaft supporter 1124 disposed on the second bracket body 1122, protruding toward the first joint bracket 1110, and facing the 2-1 shaft supporter 1123.

The second bracket body 1122 extends long, and in one embodiment, the second bracket body 1122 is vertically disposed. The second bracket body 1122 defines fastening grooves 1125 and 1126 at a first side and a second side of the second bracket body 1122. The fastening grooves 1125 and 1126 defined in the second bracket body 1122 are each concave and are disposed toward the steering grill 3450.

The 2-1 shaft supporter 1123 and the 2-2 shaft supporter 1124 each define a shaft hole 1123*a* and another shaft hole (not shown) and the shaft hole 1123*a* and the other shaft hole (not shown) face each other. The shaft hole 1123*a* and the other shaft hole (not shown) are each horizontally disposed.

In one embodiment, the 2-1 shaft supporter 1123 is disposed on the right side thereof and the 2-2 shaft supporter 1124 is disposed on the left side thereof. The 2-1 shaft supporter 1123 and the 2-2 shaft supporter 1124 are horizontally disposed.

The cross axle 1130 provides a vertical rotary shaft and a horizontal rotary shaft. The cross axle 1130 is preferably disposed on the axis center (C1) line.

The cross axle 1130 includes a "+"-shaped cross body 1135, a 1-1 rotary shaft 1131 disposed on the cross body 1135 in the second direction (e.g., in one embodiment, the vertical direction) and rotatably assembled to the 1-1 shaft supporter 1113, a rotary shaft 1131 disposed on the cross body 1135 in the second direction (e.g., in one embodiment, the vertical direction), rotatably assembled to the 1-2 shaft supporter 1114, and disposed at an opposite side of the 1-1 rotary shaft 1131, a 2-1 rotary shaft 1133 disposed on the cross body 1135 in the first direction (e.g., in one embodiment, a horizontal direction) and rotatably assembled to the 2-1 shaft supporter 1123, and a 2-2 rotary shaft 1134 disposed on the cross body 1135 in the first direction (e.g., in one embodiment, the horizontal direction), rotatably assembled to the 2-2 shaft supporter 1124, and disposed at the opposite side of the 2-1 rotary shaft 1133.

The rotary shafts 1131, 1132, 1133, and 1134 may be inserted into the shaft supporters 1113, 1114, 1123, and 1124, respectively, and may rotate. In this case, due to the length of the cross axle 1130, the shaft supporters 1113, 1114, 1123, and 1124 may be separately manufactured and then assembled to the bracket bodies 1112 and 1122.

In one embodiment, for convenience of assembly and disassembly, the first joint bracket 1110 and the second joint bracket 1120 are integrated with each other through injection molding.

The rotary shafts 1131, 1132, 1133, and 1134 of the cross axle 1130 each include screw threads and shaft caps 1141, 1142, 1143, and 1144 are coupled to the rotary shafts 1131, 1132, 1133, and 1134 by screws, respectively.

The shaft caps 1141, 1142, 1143, and 1144 have the same configuration, and for convenience of description, a shaft cap assembled to the 1-1 rotary shaft 1131 is referred to as a 1-1 shaft cap 1141. The shaft cap assembled to the 1-2 rotary shaft 1132 is referred to as a 1-2 shaft cap 1142, the shaft cap assembled to the 2-1 rotary shaft 1133 is referred to as a 2-1 shaft cap 1143, and the shaft cap assembled to the 2-2 rotary shaft 1134 is referred to as a 2-2 shaft cap 1144.

The shaft cap has a cylindrical shape and includes a shaft cap body 1145 inserted into and rotated in the shaft hole, a shaft cap supporter 1146 protruding radially and outwardly from the shaft cap body 1145, and supported by the shaft supporter, and a female screw thread 1147 disposed in the shaft cap body 1145.

The 1-1 shaft cap 1141 is inserted into the 1-1 shaft supporter 1113 and is assembled to the 1-1 rotary shaft 1131. The 1-2 shaft cap 1142 is inserted into the 1-2 shaft supporter 1114 and is assembled to the 1-2 rotary shaft 1132. An assembly direction of the 1-1 shaft cap 1141 and an assembly direction of the 1-2 shaft cap 1142 are opposite to each other.

In one embodiment, the 1-1 shaft cap 1141 and the 1-2 shaft cap 1142 are each vertically disposed and may be rotated in the horizontal direction.

The 2-1 shaft cap 1143 is inserted into the 2-1 shaft supporter 1123 and is assembled to the 2-1 rotary shaft 1133. The 2-2 shaft cap 1144 is inserted into the 2-2 shaft supporter 1124 and assembled to the 2-2 rotary shaft 1134. The assembly direction of the 2-1 shaft cap 1143 and the assembly direction of the 2-2 shaft cap 1144 are opposite to each other.

In one embodiment, the 2-1 shaft cap 1143 and the 2-2 shaft cap 1144 are each horizontally disposed and may be rotated in the vertical direction.

The steering grill 3450 defines, on a rear surface, fastening bosses 1125*a* and 1126*a* to which the second joint bracket 1120 is coupled. The fastening grooves 1125 and 1126 of the second joint bracket 1120 are inserted into the fastening bosses 1125*a* and 1126*a* of the steering grill 3450 and the second joint bracket 1120 is coupled to the steering grill 34350 through a fastening member (not shown).

The steering base 1070 covers the space (S3) of the inner fan housing 3434.

The steering base 1070 includes a base body 1075 coupled to the inner fan housing 3434, fastening bosses 1073 and 1074 defined on the front surface of the base body 1075 and to which the first joint bracket 1110 is assembled, a first through-hole 1071 penetrating the base body 1075 in the forward and rearward direction and through which the first steering assembly 1001 passes, a second through-hole 1072 penetrating the base body 1075 in the forward and rearward direction and through which the second steering assembly 1002 passes, a first base installation portion 1076 disposed on the rear surface of the base body 1075 and in which the first steering assembly 1001 is disposed, and a second base installation portion 1077 disposed on the rear surface of the base body 1075 and in which the second steering assembly 1002 is disposed.

The first steering assembly 1001 may be disposed at the front side of the steering base 1070. In one embodiment, the first steering assembly 1001 is disposed in the space (S3) to prevent an increase in the length of the fan housing assembly 3400 in the forward and rearward direction due to the installation of the first steering assembly 1001. The first steering assembly 1001 may be disposed in the space (S3), may be assembled to the rear surface of the steering base 1070, and may be assembled to the steering grill 3450 through the first through-hole 1071.

For the same reason, the second steering assembly 1002 may be disposed in the space (S3), may be assembled to the rear surface of the steering base 1070, and may be assembled to the steering grill 3450 through the first through-hole 1071.

The first steering assembly 1001 pushes or pulls the steering grill 3450 and the steering grill 3450 is tilted in the vertical direction with respect to the joint assembly 1100.

The second steering assembly 1002 pushes or pulls the steering grill 3450 and the steering grill 3450 is tilted in a horizontal direction with respect to the joint assembly 1100.

The steering grill 3450 may be tilted diagonally relative to the joint assembly 1100 by combining the operating direction of the first steering assembly 1001 with the operating direction of the second steering assembly 1002.

The first base installation portion 1076 fixes the first steering assembly 1001 and has a boss shape in one embodiment. The second base installation portion 1077 fixes the second steering assembly 1002 and has a boss shape in one embodiment.

The first base installation portion 1076 protrudes rearward from the rear surface of the steering base 1070 and is inserted into the steering body 1010 described below. A fastening member (not shown) is fastened through the steering body 1010 and the first base installation portion 1076.

When the steering body 1010 is fastened, the first base installation portions 1076 are disposed at two places to temporarily fix the fastening position of the steering body 1010. A first one thereof is referred to as a 1-1 base installation portion 1076*a* and a second one thereof is referred to as a 1-2 base installation portion 1076*b*.

The structure of the second base installation portion 1077 may be the same as the structure of the first base installation portion 1076.

The second base installation portion 1077 is also disposed in two places. One thereof is referred to as a 2-1 base installation portion 1077*a* and the other one thereof is referred to as a 2-2 base installation portion 1077*b*.

<Steering Assembly Configuration>

The first steering assembly 1001 and the second steering assembly 1002 have the same components. The positions thereof assembled to a steering grill 3450 may be different. In one embodiment, an example configuration of the first steering assembly 1001 is described. When the components of the first steering assembly 1001 are needed to be distinguished from the components of the second steering assembly 1002, they are classified into "the first" or "the second".

The first steering assembly 1001 includes a steering body 1010 coupled to the front fan housing 3430 or a steering grill 3450, a steering actuator (e.g., in one embodiment, a steering motor 1030) assembled to the steering body 1010, a moving rack 1020 movably assembled to the steering body 1010 and moving based on operation of the steering actuator, a rack guide 1012 disposed on the steering body 1010, movably assembled to the moving rack 1020 to guide a moving direction of the moving rack 1020, a steering gear 1040 coupled to the motor shaft 1031 of the steering motor 1030, engaged with the moving rack 1020 to provide a driving force to the moving rack 1020 based on the operation of the steering motor 1030, and an adjust assembly 3600 assembled to be rotatable relative to the moving rack 1020, assembled to be rotatable relative to the steering grill 3450, to adjust a distance and an angle between the steering grill 3450 and the moving rack 1020 when the moving rack 1020 moves.

The steering body 1010 may be coupled to the front fan housing 3430 or the steering grill 3450. In one embodiment, the steering body 1010 is disposed on the structure of the front fan housing 3430 in consideration of power supply and cable connection of the steering actuator.

When the steering body 1010 is disposed on the steering grill 3450 which is tilted based on a control signal, there is a problem that the cable is also tilted. In addition, when the steering body 1010 is assembled to the steering grill 3450, the load of the steering grill 3450 is increased, and there is a problem that a power of the steering actuator may also be increased to tilt the steering grill 3450.

In one embodiment, the steering actuator is disposed on the steering base 1070 coupled to the front fan housing 3430. In particular, the steering body 1010 is disposed on the rear surface of the steering base 1070 and the adjust assembly 3600 penetrates the steering base 1070 to minimize a separation distance between the steering grill 3450 and the steering base 1070.

The adjust assemblies 3600 pass through through-hole 1071 and 1072 of the steering base 1070 to minimize the distance between the steering base 1070 and the steering grill 3450. In addition, when the distance between the steering base 1070 and the steering grill 3450 is minimized, the length of the adjusting assembly 3600 may be minimized, and relative displacement and a relative angle of the adjusting assembly 3600 may be controlled more precisely.

The steering actuator moves the moving rack 1020 in the forward and rearward direction. A hydraulic cylinder may be used as the steering actuator. In one embodiment, a stepper motor is used as the steering actuator, which is referred to as a steering motor 1030.

The steering motor 1030 is assembled to the steering body 1010 and the moving rack 1020 is disposed between the steering motor 1030 and the steering body 1010.

The rack guide 1012 guides the moving direction of the moving rack 1020, and in one embodiment, the rack guide 1012 is disposed in the forward and rearward direction. In one embodiment, the rack guide 1012 is integrated with the steering body 1010. The rack guide 1012 may have a groove or slit shape. In one embodiment, the rack guide 1012 has a slit shape penetrating the steering body 1010 and the movable rack 1020 is inserted into the slit.

The steering motor 1030 may be assembled to the steering body 1010. The steering motor 1030 moves the moving rack 1020 in the forward and rearward direction when the steering motor 1030 is coupled to the steering body 1010.

A motor fixer 1013 fixes the steering motor 1030 to the steering body 1010. In one embodiment, the steering motor 1030 is coupled to the steering body 1010 by a fastening means (not shown).

The motor fixer 1013 protrudes from the steering body 1010 toward the steering motor 1030. The motor fixer 1013 is disposed in two places. The moving rack 1020 is disposed between the motor fixers 1013.

The motor fixer 1013 protrudes from the steering body 1010 to provide an installation space of the moving rack 1020. The rack guide 1012 is disposed between the motor fixers 1013. The motor fixer 1013 disposed at a first side thereof is referred to as "a first motor fixer" and the motor fixer 1013 disposed at a second side thereof is referred to as "a second motor fixer". A distance (M1) between the first motor fixer and the second motor fixer is greater than a height (M2) of the moving rack 1020.

The steering body 1010 includes a coupler 1016 to couple with the steering base 1070. The coupler 1016 may be disposed in the forward and rearward direction. As the first base installation portion 1076 and the second base installation portion 1077 each have a boss shape, the coupler 1016 may have a groove shape corresponding thereto.

A number of couplers 1016 corresponds to a number of first base installation portions 1076 and the coupler 1016 is disposed in two places.

The coupler 1016 disposed on the steering body 1010 of the first steering assembly 1001 is referred to as "a 1-1 coupler **1016*a*" and "a 1-2 coupler 1016*b*". The coupler (not shown) disposed on the steering body 1010 of the second steering assembly 1002** is referred to as "a 2-1 coupler (not shown)" and "a 2-2 coupler (not shown)".

The coupler 1016 may be disposed in front of the motor fixer 1013 or the rack guide 1012. The rack guide 1012 may be disposed between the 1-1 coupler **1016*a* and the 1-2 coupler 1016*b***.

The steering gear 1040 may be a pinion gear. The steering gear 1040 may be coupled to the motor shaft 1031.

The moving rack 1020 is moved in the forward and rearward direction by the operation of the steering motor 1030. The moving rack 1020 may be movably assembled to the steering body 1010 and moves forward or rearward along the rack guide 1012.

A moving distance of the moving rack 1020 is adjusted according to a number of revolutions of the steering gear 1040 and a moving direction of the moving rack 1020 is determined based on the rotation direction of the steering gear 1040.

The moving rack 1020 includes a moving rack body 1021, a moving rack gear 1023 disposed on the moving rack body 1021 and disposed in a longitudinal direction of the moving rack body 1021, a guide block 1022 disposed on the moving rack body 1021 and movably assembled to the rack guide 1012, and a moving rack coupler 1024 disposed on the moving rack body 1021 and coupled to the structure at the rear side of the adjust assembly 3600.

The guide block 1022, the moving rack gear 1023, and the adjust moving rack coupler 1024 may be integrated with the moving rack body 1021.

The moving rack gear 1023 may be disposed in the longitudinal direction of the moving rack body 1021. When considering the engagement with the steering gear 1040, the moving rack gear 1023 is preferably disposed on the upper surface or the lower surface of the moving rack body 1021, and in one embodiment, the moving rack gear 1023 is disposed on the lower surface of the moving rack body 1021.

The guide block 1022 is inserted into the rack guide 1012 and is moved. The guide block 1022 and the rack guide 1012 are not engaged with each other in the moving direction thereof, but are engaged with each other in other directions except for the moving direction thereof.

Cross-sections of the guide block 1022 and the rack guide 1012 correspond to each other, which are orthogonal to the moving directions thereof and the guide block 1022 is inserted into the rack guide 1012.

The guide block 1022 defines a guide protrusion 1025 in a moving direction and the rack guide 1012 defines a guide groove 1015 corresponding to the guide protrusion 1025. The guide groove 1015 and the guide protrusion 1025 are engaged with each other in the horizontal direction and the vertical direction except for the moving direction (e.g., in one embodiment, the forward and rearward direction).

In another embodiment, the guide groove 1015 may be defined in the guide block 1022 and the guide protrusion 1025 may be defined in the rack guide 1012.

<Adjust Assembly Configuration>

In one embodiment, the adjust assembly 3600 is disposed on a first steering assembly 1001 and a second steering assembly 1002. The adjust assemblies 3600 have the same configuration.

When the adjust assembly 3600 disposed in the first steering assembly 1001 needs to be distinguished from the adjust assembly 3600 disposed in the second steering assembly 1002, they may be distinguished as a first adjust assembly 3601 and a second adjust assembly 3602. Components of the adjust assembly 3600 may also be distinguished in the same manner.

The adjust assembly 3600 corrects a distance and a direction between the steering body 1010 and the steering grill 3450 when the moving rack 1020 moves forward or rearward.

The adjust assembly 3600 connects the steering grill 3450 to the moving rack 1020.

When the steering grill 3450 is tilted, a relative distance between the steering grill 3450 and the moving rack 1020 is varied and the adjust assembly 3600 resolves the variable distance difference. The adjust assembly 3600 supports the tilted steering grill 3450 and maintains the tilted state.

The adjust assembly 3600 corrects the relative displacement and relative angle between the steering grill 3450 and the moving rack 1020 and maintains the tilted state of the steering grill 3450.

In one embodiment, the adjust assembly 3600 corrects the relative displacement and the relative angle through a multi-joint structure.

In one embodiment, the steering assembly 1000 further includes a hub 1080 assembled to the rear surface of the steering grill 3450 and assembled to the adjust assembly 3600. The first steering assembly 1001 and the second steering assembly 1002 are each coupled to the hub 1080.

The hub 1080 includes a hub body 1082 assembled to a steering grill 3450, a hub fitting portion 1084 disposed on the hub body 1082 and coupled to the steering grill 3450, a hub fastener 1086 disposed on the hub body 1082, fastened to the steering grill 3450, a first adjust coupler 1088 and a second adjust coupler 1089 each disposed on the hub body 1082 and coupled to the adjust assembly 3600.

In one embodiment, the first adjust assembly 3601 and the second adjust assembly 3602 are each assembled to the hub body 1082. The hub 1080 may be omitted and the first adjust assembly 3601 and the second adjust assembly 3602 may be directly assembled to the steering grill 3450. In this case, there is a problem in that an assembly process of the first adjust assembly 3601 and the second adjust assembly 3602 is complicated.

In one embodiment, the hub 1080 is assembled to the steering grill 3450 when the first adjust assembly 3601 and the second adjust assembly 3602 are each assembled to the hub 1080. In this case, regardless of the steering grill 3450, the first adjust assembly 3601, the second adjust assembly 3602, and the hub 1080 may be prepared in an assembled state.

As the hub 1080 is assembled to the steering grill 3450, to which the first adjust assembly 3601 and the second adjust assembly 3602 are assembled, assembly may be simplified. In particular, in the structure, when the steering grill 3450 needs to be replaced, the adjust assembly 3600 may not need to be disassembled and the assembled adjust assembly 3600 may be reused without change.

The adjust assembly 3600 includes a first ball hinge 3610 coupled to a moving rack coupler 1024 of the moving rack 1020, a second ball hinge 3620 coupled to the adjust couplers 1088 and 1089 of the hub 1080, a first ball cap 3630 disposed between the first ball hinge 3610 and the second ball hinge 3620 and to cover a portion of an outer surface of the first ball hinge 3610 and be rotatable relative to the first ball hinge 3610, a second ball cap 3640 disposed between the first ball cap 3630 and the second ball cap 3620 to cover a portion of an outer surface of the second ball hinge 3620 and be rotatable relative to the second ball hinge 3620, an elastic member 3650 disposed between the first ball cap 3630 and the second ball cap 3640, to provide an elastic force to each of the first ball cap 3630 and the second ball cap 3640, contact the first ball cap 3630 to the first ball hinge 3610, and contact the second ball cap 3640 to the second ball hinge 3620, and an adjust housing 3660 to accommodate the first ball hinge 3610, the first ball cap 3630, the elastic member 3650, the second ball cap 3640, and the second ball hinge 3620, in which the adjust couplers 1088 and 1089 are inserted into the front side thereof and the moving rack coupler 1024 is inserted into the rear side thereof.

The elastic member 3650 may use a coil spring. In another embodiment, various types of elastic members may be used. The coil spring may be disposed between the first ball cap 3630 and the second ball cap 3640 and may provide an elastic force when the coil spring is fitted to the first ball cap 3630 and the second ball cap 3640. The coil spring is effective to maintain a right position between the first ball cap 3630 and the second ball cap 3640.

The first ball hinge 3610 and the second ball hinge 3620 each function as a joint. Relative rotation may occur at the first ball hinge 3610 or the second ball hinge 3620.

The first ball hinge 3610 has a spherical shape. The first ball hinge 3610 may be coupled to a moving rack coupler 1024 of the moving rack 1020.

The first ball hinge 3610 may be coupled to the moving force coupler 1024 by a fastening member 3612. The fastening member 3612 penetrates the first ball hinge 3610 in the forward and rearward direction.

The first ball hinge 3610 defines a first groove 3611 and a second groove 3613 into which the fastening member 3612 is inserted and the first groove 3611 and the second groove 3613 each are concave in the forward and rearward direction.

The first groove 3611 and the second groove 3613 have the same structure. In one embodiment, the fastening member 3612 is inserted into the first groove 3611. A head 3612*a* of the fastening member 3612 is inserted into the first groove 3611 to prevent the head 3612*a* of the fastening member 3612 from protruding outside the outer surface of the first ball hinge 3610.

A fastening hole (not shown) is connected to the first groove 3611, passes through the first ball hinge 3610, and the fastening hole is provided in a forward and rearward direction. The second groove 3613 may be concave from the rear side to the front side thereof, and the movable rack coupler 1024 may be inserted into the second groove 3613.

The fastening member 3612 may be coupled to the moving rack coupler 1024 through the first ball hinge 3610.

The second ball hinge 3620 has the same structure as the first ball hinge 3610.

The second ball hinge 3620 defines a first groove 3621 and a second groove 3623 into which the fastening member 3622 may be inserted and the first groove 3621 and the second groove 3623 are each concave in the forward and rearward direction.

The first groove 3621 and the second groove 3623 have the same structure. In one embodiment, the fastening member 3622 is inserted into the first groove 3621. The head 3622*a* of the fastening member 3622 is inserted into the first groove 3621 to prevent the head 3622*a* of the fastening member 3612 from protruding outside the outer surface of the second ball hinge 3620.

A fastening hole (not shown) is connected to the first groove 3621 and passes through the second ball hinge 3620, and is disposed in a forward and rearward direction. The second groove 3623 may be concave from the rear side to the front side thereof and the first adjust coupler 1088 or the second adjust coupler 1089 are inserted therein. The fastening member 3622 is coupled to the adjust coupler 1088 or the second adjust coupler 1089 through the second ball hinge 3620.

The first ball cap 3630 covers the first groove 3611 of the first ball hinge 3610 and surrounds the outer surface of the first ball hinge 3610. The first ball cap 3630 surrounds a front outer surface of the first ball hinge 3610.

The first ball cap 3630 includes a concave first ball cap groove 3631 corresponding to the outer surface of the first ball hinge 3610 and a first ball cap protrusion 3633 fitted to the elastic member 3650.

The first ball hinge 3610 is inserted into the first ball cap groove 3631 and the first ball cap groove 3631 minimizes friction with the first ball hinge 3610. The first ball hinge 3610 may contact the first ball cap groove 3631 and rotate.

The first ball cap protrusion 3633 protrudes toward the elastic member 3650. In one embodiment, the first ball cap protrusion 3633 is disposed in the forward and rearward direction and protrudes toward the front side thereof (e.g., toward the steering grill).

The second ball cap 3640 and the first ball cap 3630 have the same configuration and have the different directions.

The second ball cap 3640 covers the first groove 3621 of the second ball hinge 3620 and surrounds the outer surface of the second ball hinge 3620. The second ball cap 3640 surrounds the rear outer surface of the second ball hinge 3620.

The second ball cap 3640 includes a second ball cap groove 3641 that is concave and corresponding to the outer surface of the second ball hinge 3620 and a second ball cap protrusion 3643 fitted to the elastic member 3650.

The second ball hinge 3620 is inserted into the second ball cap groove 3641 and the second ball cap groove 3641 minimizes friction with the second ball hinge 3620. The second ball hinge 3620 may be rotated in contact with the second ball cap groove 3641.

The second ball cap protrusion 3643 protrudes toward the elastic member 3650. In one embodiment, the second ball cap protrusion 3643 is disposed in the forward and rearward direction and protrudes rearward (e.g., toward the moving rack).

The first ball cap protrusion 3633 and the second ball cap protrusion 3643 are disposed in a line, protrude toward each other, and are disposed in the forward and rearward direction in one embodiment.

The first ball cap groove 3631 and the second ball cap groove 3641 are disposed in opposite directions. For example, when the first ball cap groove 3631 is disposed toward the rear side thereof, the second ball cap groove 3641 is disposed toward the front side thereof.

The adjust housing 3660 accommodates the first ball hinge 3610, the first ball cap 3630, the elastic member 3650, the second ball cap 3640, and the second ball hinge 3620.

The adjust housing 3660 defines a first insertion hole 3673 into which the moving rack coupler 1024 may be inserted, at a rear side thereof, and the moving rack coupler 1024 may be inserted into the rear side of the adjust housing 3660 through the first insertion hole 3673.

The adjust housing 3660 defines a second insertion hole 3683 at a front side thereof, into which the first adjust coupler 1088 or the second adjust coupler 1089 is inserted and the first adjust coupler 1088 or the second adjust coupler 1089 is inserted into the front side of the adjust housing 3660 through the second insertion hole 3683.

In one embodiment, the adjust housing 3660 includes a first adjust housing 3670 and a second adjust housing 3680.

The first ball hinge 3610, the first ball cap 3630, the elastic member 3650, the second ball cap 3640, and the second ball hinge 3620 may be easily accommodated therein through assembly of the first adjust housing 3670 and the second adjust housing 3680.

The first adjust housing 3670 includes a first adjust housing body 3672 providing a space (AS1), the first insertion hole 3673 defined at a rear side of the first adjust housing body 3672 (e.g., in one embodiment, toward the moving rack coupler 1024) and communicating with the space (AS1), and a first opening surface 3671 disposed at a front side of the first adjust housing body 3672 (e.g., in one embodiment, toward the steering grill) and communicating with the space (AS1).

The second adjust housing 3680 includes a second adjust housing body 3682 providing a space (AS2), the second insertion hole 3683 disposed at the front side of the second adjust housing body 3682 (e.g., in one embodiment, toward the steering grill) and communicating with the space (AS2), and a second opening surface 3681 disposed at the rear side of the second adjust housing body 3682 (e.g., in one embodiment, toward the moving rack coupler 1024) and communicating with the space (AS2).

In one embodiment, the first adjust housing 3670 is coupled to the second adjust housing 3680 by a screw, and to this end, one thereof includes a female screw thread 3685 and the other one thereof includes a male screw thread 3675.

In one embodiment, the female screw thread 3685 is disposed on an inner surface of the second adjust housing body 3682 and the male screw thread 3675 is disposed on an outer surface of the first adjust housing body 3672.

The first ball hinge 3610 and the second ball hinge 3620 are each disposed inside the adjust housing 3660 and the first ball hinge 3610 and the second ball hinge 3620 may each be rotated.

The first ball hinge 3610 may be rotated relative to the steering grill 3450 and the second ball hinge 3620 may be rotated relative to the steering base 1070.

The movable rack coupler 1024 to which the first ball hinge 3610 is coupled may be rotated in the first insertion hole 3673 within a predetermined distance. The adjust couplers 1088 and 1089 to which the second ball hinge 3620 is coupled may be rotated in the second insertion hole 3685 within a predetermined distance.

The first ball hinge 3610 and the second ball hinge 3620 may be rotated independently of each other to respond to the tilting of the steering grill 3450.

The steering of the steering grill is described with reference to FIGS. 3 to 8 and FIGS. 26 to 30.

The long-distance fan assembly 400 provides a projection state in which the long-distance fan assembly 400 protrudes further forward than the front surface 200*a* of the door assembly 200 through the front discharge outlet 201. In the projection state, the direction of the steering grill 3450 is tilted.

In the projection state, the front end 3452*a* of the steering grill 3450 protrudes than the front surface 200*a* of the door assembly 200 and a protruding length (P) is provided between the front end 3452*a* of the steering grill 3450 and the front surface 200*a* of the door assembly 200. For example, the protruding length (P) may be a half of the thickness in the forward and rearward direction of the steering grill 3450.

In the projection state, a first half of the outer surface 3451 of the steering grill 3450 may be disposed outside the front discharge outlet 201 and a second half thereof may be disposed inside the front discharge outlet 201.

In particular, in the projection state, an outermost portion 3451*a* of the outer surface 3451 of the steering grill 3450 is disposed on the same line as the front discharge outlet 201 or the front surface 200*a* of the door assembly 200.

In the projection state, the joint assembly 1100 is preferably disposed in the front discharge outlet 201. More precisely, in the projection state, the cross axle 1030 preferably faces a front side thereof and is disposed on the same line as the front surface 200*a* of the door assembly 200.

When viewed from the front, the first steering assembly 1001 is disposed above the central axis (C1) and the second steering assembly 1002 is disposed on the left side of the central axis (C1).

When viewed from the front, the first steering assembly 1001 and the second steering assembly 1002 have an angle of 90 degrees with respect to the central axis (C1).

The arrangement is configured to minimize the operation of the first steering assembly 1001 or the second steering assembly 1002 when the steering grill 3450 is tilted.

A middle position between a maximum forward movement position and a maximum rearward movement position of the moving rack 1020 of the steering assembly is referred to as "an initial position". The moving rack 1020 of the first steering assembly 1001 or the second steering assembly 1002 is disposed at the initial position in the projection state.

In one embodiment, a tilting angle of the steering grill 3450 is from 0 to 15 degrees.

When the front surface of the steering grill 3450 (e.g., in one embodiment, the steering cover 3454) is orthogonal to the central axis (C1) or is parallel to the front surface 200*a* of the door assembly 200, a tilting angle is 0 degrees.

When the moving rack 1020 maximizes the forward movement or the rearward movement, the steering grill 3450 has a tilting angle of 15 degrees.

For example, when the moving rack 1020 of the first steering assembly 1001 is moved rearward with a maximum level, an upper end of the steering grill 3450 is tilted to the rear side, and the steering grill 3450 faces upward. In this case, the steering cover 3454 of the steering grill 3450 forms an angle of 15 degrees with respect to the central axis (C1). The tilting angle of the steering grill 3450 may be controlled based on the moving distance of the moving rack 1020.

The relation between the tilting direction of the steering grill 3450, the moving rack 1020 of the first steering assembly 1001, and the moving rack 1020 of the second steering assembly 1002 is shown in Table 1 as follows.

TABLE 1

| | MOVING RACK OF FIRST STEERING ASSEMBLY | MOVING RACK OF SECOND STEERING ASSEMBLY |
|---|---|---|
| LEFTWARD | INITIAL POSITION | MOVING REARWARD |
| RIGHTWARD | INITIAL POSITION | MOVING FORWARD |
| UPWARD | MOVING REARWARD | INITIAL POSITION |
| DOWNWARD | MOVING FORWARD | INITIAL POSITION |
| LEFTWARD AND UPWARD | MOVING REARWARD | MOVING REARWARD |
| LEFTWARD AND DOWNWARD | MOVING FORWARD | MOVING REARWARD |
| RIGHTWARD AND UPWARD | MOVING REARWARD | MOVING FORWARD |
| RIGHTWARD AND DOWNWARD | MOVING FORWARD | MOVING FORWARD |

As shown in FIG. 3, when the steering grill 3450 is tilted leftward with respect to a central axis (C1), only the second steering assembly 1002 is operated in one embodiment.

The moving rack 1020 of the first steering assembly 1001 is disposed at an initial position and the moving rack 1020 of the second steering assembly 1002 is moved rearward. In this case, the steering grill 3450 is rotated leftward about the joint assembly 1100.

As shown in FIG. 4, when the steering grill 3450 is tilted rightward with respect to the central axis (C1), only the second steering assembly 1002 is operated in this embodiment.

The moving rack 1020 of the first steering assembly 1001 is disposed at an initial position and the moving rack 1020 of the second steering assembly 1002 is moved forward. In this case, the steering grill 3450 is rotated rightward with respect to the joint assembly 1100.

As shown in FIG. 5, when the steering grill 3450 is tilted upward with respect to the central axis (C1), only the first steering assembly 1001 is operated in this embodiment.

In the projection state, the moving rack 1020 of the first steering assembly 1001 is moved rearward and the moving rack 1020 of the second steering assembly 1002 is disposed at the initial position. In this case, the steering grill 3450 is rotated upward with respect to the joint assembly 1100.

As shown in FIG. 6, when the steering grill 3450 is tilted downward with respect to the central axis (C1), only the first steering assembly 1001 is operated in this embodiment.

In the projection state, the moving rack 1020 of the first steering assembly 1001 is moved forward and the moving rack 1020 of the second steering assembly 1002 is disposed at the initial position. In this case, the steering grill 3450 is rotated downward with respect to the joint assembly 1100.

For example, when the steering grill 3450 is tilted upward, downward, leftward, or rightward with respect to the central axis (C1), only one of the first steering assembly 1001 or the second steering assembly 1002 is operated in this embodiment.

When the steering grill 3450 is tilted diagonally with respect to the central axis (C1), the first steering assembly 1001 and the second steering assembly 1002 are each operated.

For example, as shown in FIG. 7, when the steering grill 3450 is tilted diagonally leftward and downward with respect to the central axis (C1), in the projection state, the moving rack 1020 of the first steering assembly 1001 is moved forward and the moving rack 1020 of the second steering assembly 1002 is moved rearward. In this case, the steering grill 3450 is rotated leftward and downward with respect to the joint assembly 1100.

As shown in FIG. 8, when the steering grill 3450 is tilted diagonally upward and rightward with respect to the central axis (C1), the moving rack 1020 of the first steering assembly 1001 is moved rearward and the moving rack 1020 of the second steering assembly 1002 is moved forward.

Although not shown, when the steering grill 3450 is tilted diagonally leftward and upward with respect to the central axis (C1), the moving rack 1020 of the first steering assembly 1001 is moved rearward and the motor rack 1020 of the second steering assembly 1002 is moved rearward.

Although not shown, when the steering grill 3450 is tilted diagonally rightward and downward with respect to the central axis (C1), the moving rack 1020 of the first steering assembly 1001 is moved forward and the moving rack 1020 of the second steering assembly 1002 is moved forward.

FIGS. 2 to 7 show maximum movement of the moving rack 1020 of the first steering assembly 1001 or the moving rack 1020 of the second steering assembly 1002.

The degree of steering may be controlled by adjusting the forward or reward movement distance of each of the moving racks 1020.

In addition, according to one embodiment, when the steering assembly 1000 is changed from the steering state to the other steering state, the steering is immediately performed.

When the steering grill is tilted from the leftward steering in FIG. 3 to the diagonal rightward and upward in FIG. 8, the moving rack 1020 of the first steering assembly 1001 is moved rearward from the initial position thereof and the moving rack of the second steering assembly 1002 is moved forward from the rearward movement position.

As described above, according to one embodiment, there is an advantage in that the steering assembly 1000 may tilt the steering grill 3450 from a current tilting direction to a target tilting direction.

The steering grill 3450 may be tilted immediately to provide directed air movement to the target area even when the indoor target area is changed in real time.

For example, the location of the occupant may be determined in real time using the camera module, and when a directed air movement tracking mode is selected, the directed air movement may be provided to the occupant even if the occupant moves in the indoor space.

For example, when a directed air movement avoidance mode is selected, the directed air movement may be provided to a region with a greater temperature difference between a target temperature and a room temperature while avoiding the location of the occupant.

Embodiments of the present disclosure are described with reference to the accompanying drawings. The disclosure may, however, be embodied in many different manners and should not be construed as limited to the embodiments set forth herein. It is understood that a person having ordinary skill in the art to which the present disclosure art would implement this disclosure in other specific manners without changing the technical idea or necessary features of the present disclosure. For this reason, the disclosed embodiments are intended to be illustrative in all aspects, and not restrictive.

What is claimed is:

1. An air conditioner comprising:

a casing having a suction inlet and a discharge outlet defined therein communicating an inner space of the casing with an indoor space;

a grill configured to adjust a discharge direction of air discharged to the discharge outlet;

a fan housing disposed in rear of the grill;

a fan configured to flow air introduced through the suction inlet;

a fan motor configured to rotate the fan; and a tilting assembly disposed between the fan housing and the grill and configured to tilt the grill, wherein the tilting assembly includes:

a first steering assembly configured to push or pull a first point located above or under a central axis of the grill to tilt the grill around the central axis of the grill, and/or a second steering assembly configured to push or pull a second point located at a left or right side around the central axis of the grill to tilt the grill around the central axis of the grill; and a joint assembly tiltably coupled to the grill and providing a tilting center, wherein the tilting center coincides with the central axis, wherein the first steering assembly is installed on a structure of the fan housing, and wherein the fan housing includes:

a rear fan housing having a fan suction inlet defined therein; and a front fan housing disposed in front of the rear fan housing and coupled to the rear fan housing, wherein the front fan housing includes a motor installation portion on which the fan motor is installed.

2. The air conditioner of claim 1, wherein the first steering assembly includes:

a steering body installed on the structure of the fan housing;

a steering actuator coupled to the steering body;

a moving rack movably coupled to the steering body and movable based on an operation of the steering actuator; and an adjust assembly coupled to each of the moving rack and the grill so as to be rotatable relative thereto.

3. The air conditioner of claim 1, wherein the first steering assembly is disposed in front of the fan motor.

4. The air conditioner of claim 1, wherein the fan motor includes a motor mount coupled to the motor installation portion, wherein the first steering assembly is installed on the motor mount.

5. The air conditioner of claim 1, wherein the first steering assembly is installed on the front fan housing.

6. The air conditioner of claim 1, wherein the fan is disposed between the front fan housing and the rear fan housing, wherein the fan motor is disposed in front of the front fan housing.

7. The air conditioner of claim 1, wherein a rotary shaft of the fan motor coincides with the central axis.

8. The air conditioner of claim 1, wherein the second steering assembly is installed on a structure of the fan housing.

9. An air conditioner comprising:

a casing having a suction inlet and a discharge outlet defined therein communicating an inner space of the casing with an indoor space;

a grill configured to control a discharge direction of air discharged to the discharge outlet;

a fan housing disposed in rear of the grill;

a fan configured to flow air introduced through the suction inlet;

a fan motor configured to rotate the fan; and a tilting assembly disposed between the fan housing and the grill and configured to tilt the grill, wherein the tilting assembly includes:

a joint assembly tiltably coupled to the grill and providing a tilting center; and a steering assembly configured to push or pull a point of the grill spaced apart from the tilting center to tilt the grill, wherein the steering assembly is installed on a structure of the fan housing, and wherein the fan housing includes:

a rear fan housing having a fan suction inlet defined therein; and a front fan housing disposed in front of the rear fan housing and coupled to the rear fan housing, wherein the front fan housing includes a motor installation portion on which the fan motor is installed.

10. The air conditioner of claim 9, wherein the steering assembly includes:

a steering body installed on the structure of the fan housing;

a steering actuator coupled to the steering body;

a moving rack movably coupled to the steering body and movable based on an operation of the steering actuator; and an adjust assembly coupled to each of the moving rack and the grill so as to be rotatable relative thereto.

11. The air conditioner of claim 9, wherein the steering assembly is disposed in front of the fan motor.

12. The air conditioner of claim 9, wherein the fan motor includes a motor mount coupled to the motor installation portion, wherein the steering assembly is installed on the motor mount.

13. The air conditioner of claim 9, wherein the steering assembly is installed on the front fan housing.

14. The air conditioner of claim 9, wherein the fan is disposed between the front fan housing and the rear fan housing, wherein the fan motor is disposed in front of the front fan housing.

15. The air conditioner of claim 9, wherein a rotary shaft of the fan motor coincides with the tilting center.

* * * * *